US007253826B2

(12) United States Patent
Okada

(10) Patent No.: US 7,253,826 B2
(45) Date of Patent: Aug. 7, 2007

(54) THERMAL DEVELOPMENT APPARATUS

(75) Inventor: Koichi Okada, Kanagawa (JP)

(73) Assignee: Fujifilm Corporation, Tokyo (JP)

( * ) Notice: Subject to any disclaimer, the term of this patent is extended or adjusted under 35 U.S.C. 154(b) by 167 days.

(21) Appl. No.: 10/926,320

(22) Filed: Aug. 26, 2004

(65) Prior Publication Data

US 2005/0074235 A1 Apr. 7, 2005

(30) Foreign Application Priority Data

Aug. 29, 2003 (JP) ..... 2003-307831
Jul. 2, 2004 (JP) ..... 2004-196852

(51) Int. Cl.
*G03D 13/00* (2006.01)
*G03D 13/02* (2006.01)

(52) U.S. Cl. ..... 347/140; 430/350; 430/30; 355/26; 355/27

(58) Field of Classification Search ..... 430/350, 430/351, 353; 347/140; 355/26, 27
See application file for complete search history.

(56) References Cited

U.S. PATENT DOCUMENTS 6,268,094 B1 * 7/2001 Allen et al. ..... 430/30
6,335,153 B1 * 1/2002 Toya ..... 430/350

FOREIGN PATENT DOCUMENTS

JP 2000-221654 A 8/2000

* cited by examiner

*Primary Examiner*—Huan Tran
(74) *Attorney, Agent, or Firm*—Sughrue Mion, PLLC

(57) ABSTRACT

A thermal development apparatus is provided with: a thermal development section for heating a photosensitive thermal developable recording material to elicit a latent image recorded on an image-forming layer on both faces of the photosensitive thermal developable recording material by a heating unit, a cassette holder section for holding a cassette that houses the photosensitive thermal developable recording material therein, a conveyor unit for taking the photosensitive thermal developable recording material out of the cassette held in the cassette holder section and conveying the photosensitive thermal developable recording material to the thermal development section, and a control unit for controlling at least one of a heating temperature and a conveyance speed in the heating unit in the thermal development section, wherein the control unit is provided with a moisture correction information of the photosensitive thermal developable recording material and the control unit suitably corrects and controls the at least one of the heating temperature and the conveyance speed in the heating unit from a moisture content of the photosensitive thermal developable recording material on the basis of the moisture correction information thereof during thermal development of the photosensitive thermal developable recording material.

6 Claims, 7 Drawing Sheets

THERMAL DEVELOPMENT APPARATUS

This application is based on Japanese Patent application JP2003-307831, filed Aug. 29, 2003, and JP2004-196852, filed Jul. 2, 2004, the entire content of which is hereby incorporated by reference.

BACKGROUND OF THE INVENTION

1. Technical Field of the Invention

The present invention relates to a thermal development apparatus for heating a photosensitive thermal developable recording material having a latent image formed thereon, to thereby visualize the latent image recorded on the image-forming layer on both faces of the photosensitive thermal developable recording material.

2. Description of the Related Art

Heretofore, there is known an image-forming apparatus in which a photographic material is imagewise exposed, then attached to an image-receiving material and heated for thermal development to transfer the developed image onto the image-receiving material, as in JP-A 2000-221654. In the apparatus of JP-A 2000-221654, water is used as the image-forming solvent for transferring the image from the photographic material to the image-receiving material, and therefore the apparatus is provided with a moisture sensor for moisture control therein.

An image-forming apparatus that is referred to as a medical imager is for forming a print of a visible image from the image analyzed by a medical analyzer such as CT, MRI, etc. In the image-forming apparatus of the type, a photosensitive thermal developable recording material having a photothermographic image-forming layer on a support of PET film or the like is used. In this, briefly, such a photosensitive thermal developable recording material is imagewise exposed with light beams that have been modulated in accordance with the image data fed from the image data supply source such as MRI or the like, thereby forming a latent image on it, and then the exposed material is thermally developed in the built-in thermal development unit in the apparatus to give colored hard copies, and this does not require water at all for an image-forming solvent.

FIG. 6 shows an image-forming apparatus equipped with an ordinary thermal development unit such as medical imager.

The image-forming apparatus 300 basically is provided with a recording material supply section 310, an image exposure section 320 and a thermal development section 330 in that order in the conveyance direction of recording material A.

In the recording material supply section 310, one uppermost sheet of recording material is taken out of the magazine 311 with the pickup roller unit 312, and conveyed to the image exposure section 320.

The image exposure section 320 is a section for imagewise exposing the recording material by scanning exposure of light beams, and the image exposure is performed by imagewise scanning using the laser beams L from the exposure unit 321.

The recording material with a latent image recorded thereon in the image exposure section 320 is then conveyed to the thermal development section 330. In the thermal development section 330, the recording material is heated by a heating unit of curved heat plates 331(*a, b, c*) for thermal development to convert the latent image into a visible image. A number of conveyor rollers 332 are disposed along the inner face of the curved heat plates 331. The edges of these conveyor rollers 332 are rotated with a large rotary disc 333, whereby the recording material is slid, heated and conveyed between the inner face of the curved heat plates 331 and the conveyor rollers 332 along the inner face of the heat plates 331. In this case, the recording material is heated on its one face by the curved heat plates 331.

Thus kept in contact with the heat plates 331, the recording material is thermally developed by the heat of the heat plates 331, and then this is led to the take-out tray 360 via the pre-cooling section 340 and the cooling section 350, and is thus taken out.

In the drawing, 370 is a power/control unit for power supply to the operation units, for light control in the image exposure unit and for control of the conveyance speed through the units.

In the method of recording a latent image on a recoding material through exposure of the material to light beams that are modulated in accordance with the image data fed from an image data supply source such as MRI, the recording material generally has an image-forming layer formed on one face thereof. In the method, therefore, only one face of the material having the image-forming layer is an object for heating relating to the thermal development of the recording material, as shown in the above-mentioned related-art examples. Even in the thermal development section (thermal development apparatus) of the type for double-sided photosensitive films, heating may be performed also on the face of the recording material not having an image-forming layer thereon (by the auxiliary heat source provided on the side of the material not having an image-forming layer thereon) In this case, however, the temperature control is merely for auxiliary heat control of the image-forming layer formed on one face of the material.

On the other hand, in a double-sided photosensitive pick-up method where an object is put between an X-ray tube and a film and a latent image of the object is recorded on the film by the X-ray having passed through the object, a fluorescent intensifying screen is disposed on both faces of the film (however, when the double-sided photosensitive film has a fluorescent sensitizer layer therein, the sheet is not disposed) and the film is housed in a cassette. When exposed to X-ray, the film may form an image thereon by the action of the fluorescent intensifying screen capable of being excited to give fluorescence through exposure to X-ray. Different from the films for the above-mentioned medical imagers such as CT and MRI, the double-sided photo sensitive films are characterized in that they have an image-forming layer formed on both faces of the support thereof.

If those films having an image-forming layer formed on both faces thereof are processed with the ordinary thermal development apparatus where only one face of films is heated, then the heat transfer to non-heated side of the image-forming layer may be delayed. The development delay often causes discoloration of the image-forming layer into brown or the like. In addition, if sufficient heat could not be transferred to the image-forming layer on the non-heated side, then the development will be insufficient and it may cause image density reduction or fluctuation.

Given that situation, a thermal development apparatus capable of uniformly heating both faces of double-sided photosensitive films has been developed.

FIG. 7 shows the thermal development apparatus capable of uniformly heating both faces of double-sided photosensitive films.

In the drawing, 400 is a thermal development apparatus for double-sided photosensitive films; P (P1, P2, P3 . . . ) is a double-sided photosensitive film; 10' is a cassette; 11 is an openable lid; 20 is a conveyor unit; 21 is a sucker; 22 is a conveyor roller pair; 23 is a conveyor guide; 30 is a thermal development section; 31 is a first heating unit (heat roller); 32 is a built-in heater; 35 is a second heating unit (heat plate); 36 is a surface heater; 40 is a pre-cooling section; 50 is a cooling section; 60 is a conveyor unit; 61 and 62 are take-out roller pairs; 63 is a conveyor guide; and 70 is a tray. 80 is a power/control unit for power supply to the operation units and for conveyance speed control; 90 is a cassette holder section for holding the cassette 10'.

In the thermal development apparatus 400 of FIG. 7, the double-sided photosensitive film P (in the drawing, P is changed to P1, P2, P3, . . . in accordance with the site where the double-sided photosensitive film is put) (recording material) is heated and the latent image recorded on the image-recording layer of the film is thereby visualized. The double-sided photosensitive film P to be processed in the thermal development apparatus 400 has an image-forming layer of a photosensitive material on both of one and the other faces of the support thereof.

The double-sided photosensitive film P1 having a latent image formed on the image-forming layer on both faces thereof is housed in the cassette 10', and the cassette 10' with the film therein is inserted into the cassette holder section 90 of the thermal development apparatus 400. When the cassette 10' is inserted into the cassette holder section 90, then the openable lid 11 of the cassette 10' is automatically opened, and the double-sided photosensitive film P1 is taken out of the cassette 10' by a take-up unit with the sucker 21 or the like (it may be a pickup roller).

The thermal development apparatus 400 may be provided with a magazine (not shown) capable of housing therein a number of double-sided photosensitive films P each with a latent image formed thereon. In this case, double-sided photosensitive films P each with a latent image formed thereon are taken out of the cassette 10' in a dark room or the like, and piled up in the magazine. The double-sided photosensitive films P1 thus piled up and housed in the magazine is also taken out one by one by the sucker 21.

Thus taken out, the double-sided photosensitive film P2 is conveyed toward the thermal development section 30 existing downstream in the conveyance direction, via the conveyor unit that has the conveyor roller pair 22 and the conveyor guide 23. Between the conveyor roller pair 22 and the thermal development section 30, there may be provided a positioning unit of correctly positioning the taken-out double-sided photosensitive film P2 in the direction perpendicular to the conveyance direction thereof to thereby correctly control the position of the double-sided photosensitive film P3 in the thermal development section 30 that is downstream of the apparatus.

In the thermal development section 30, there are provided the first heating unit 31 for heating the first face of the double-sided photosensitive film P3 and the second heating unit for heating the back thereof, in such a manner that they sandwich the conveyance route of the double-sided photosensitive film P3 between them. In this, the first heating unit 31 is provided with a number of heat rollers 31 each having a built-in heater in the center thereof; and the second heating unit 35 is a curved plate heater with a built-in surface heater 35 therein. As illustrated, nine heat rollers 31 are disposed at regular intervals along the inner face of the curved plate heater 35. These nine heat rollers 31 are driven to rotate in the clockwise direction by a common driving disc (not shown) at their edges.

Accordingly, the double-sided photosensitive film P3 having been conveyed to the inlet of the thermal development section 30 is led into the conveyance route formed by the distance between the first heating unit 31 and the second heating unit 35, and conveyed through them while its first face is heated by the heat rollers 31 and the opposite face is heated with the curved plate heater 35.

After both faces of the double-sided photosensitive film P3 has been uniformly heated in the thermal development section 30 in that manner as above, the film is then led to the pre-cooling section 40 disposed downstream in the conveyance direction. The pre-cooling section 40 is provided with a number of cooling roller pairs 41, in which the thermally-developed double-sided photosensitive film P4 is gradually cooled so that it is not wrinkled.

Thus gradually cooled in the pre-cooling section 40, the double-sided photosensitive film P5 is further cooled with the metal plates in the cooling section 50 so that it does not cause skin burns. The double-sided photosensitive film P thus finally cooled so that it gives not hot feel is further led downstream of the conveyance direction by the conveyor unit 60 that is provided with the take-out roller pairs 61 and 63 and the conveyor guide 63, and then taken out in the tray 70.

Since both the face and the back of the double-sided photosensitive film are subjected to simultaneous thermal development in the manner as above, there occurs no temperature difference between the two faces of the film, and therefore the double-sided photosensitive film can be developed uniformly with neither discoloration nor density fluctuation of the image formed thereon.

However, we the present inventors have found that, when the thermal development apparatus as described in FIG. 7 is used, then the image density is delicately unstable in that the image formed may be thick in some cases while it may be thin in some other cases. Having investigated the reasons for it, we have found that the moisture data in the apparatus are not reflected on the thermal development temperature therein.

On the other hand, the imager as described in FIG. 6 is free from the density instability of the images formed. The reason is because, in the imager of FIG. 6, films are set in the tray and their moisture content is relatively stable in one and the same pack.

As opposed to this, in the apparatus of FIG. 7, one double-sided photosensitive film is set in one cassette and brought out to various positions and the film in the cassette is imagewise exposed and developed in different environments. Accordingly, the double-sided photosensitive film is influenced by the humidity of the environment in which it is put, and the moisture content of the film therefore changes in different environments. Accordingly, since the heat of moisture vaporization from the films varies and it has some influence on the thermal development efficiency and, as a result, the image density becomes unstable.

SUMMARY OF THE INVENTION

Figure 1:
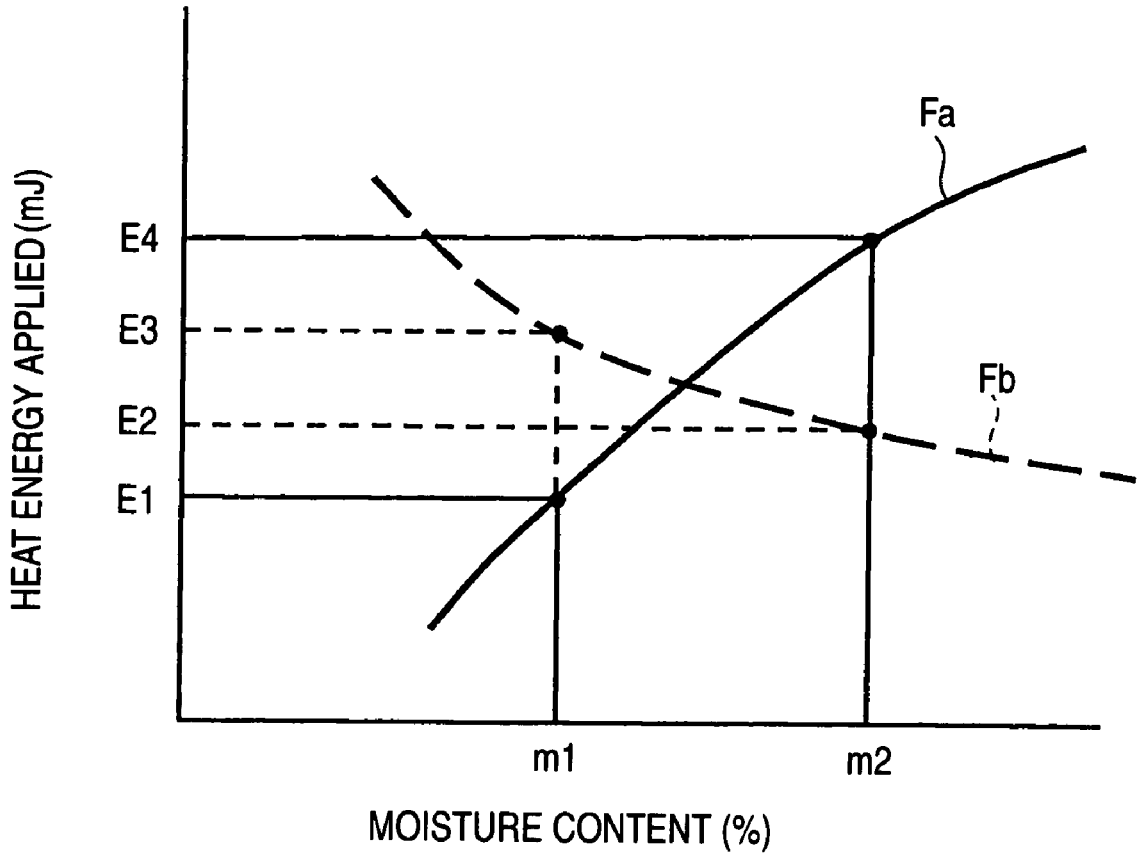
FIG. 1 is a thermal energy characteristic diagram to show the moisture content of double-sided photosensitive film vs the thermal energy to be applied to the film, necessary for producing a predetermined image density.

An object of the present invention is to solve the problems as above, and to provide a double-sided thermal development apparatus which ensures stable thermal development with no moisture influence by reflecting the moisture data in the thermal development temperature.

The first aspect of the invention is a thermal development apparatus having a thermal development section for heating a photosensitive thermal developable recording material to thereby visualize the latent image recorded on the image-forming layer on both faces of the photosensitive thermal developable recording material, a cassette holder section for holding a cassette that houses the photosensitive thermal developable recording material therein, a conveyor unit of taking the photosensitive thermal developable recording material out of the cassette held in the cassette holder and conveying it to the thermal development section, and a control unit of controlling the heating temperature or the conveyance speed in the heating unit in the thermal development section, wherein the control unit is provided with the moisture correction information of the photosensitive thermal developable recording material and it suitably corrects and controls the heating temperature or the conveyance speed in the heating unit from the moisture content of the photosensitive thermal developable recording material on the basis of the moisture correction information thereof during thermal development of the photosensitive thermal developable recording material.

Preferably in the thermal development apparatus, the moisture content of the photosensitive thermal developable recording material is determined by monitoring the humidity inside or around the apparatus.

The second aspect of the invention is a cassette to be held in the thermal development apparatus of the first aspect of the invention, which is equipped with a moisture sensor.

Preferably, the moisture sensor is for monitoring the humidity inside or around the cassette.

Also preferably, the cassette is provided with a memory unit of memorizing the monitor information from the moisture sensor.

Also preferably, the moisture sensor and the memory unit are on the side face of the cassette.

Also preferably, the thermal development apparatus is provided with a reader unit of reading the monitor information out of the memory unit.

According to the first aspect of the invention that provides the thermal development apparatus as above, the control unit is provided with the relational information of moisture/heating temperature of the photosensitive thermal developable recording material being processed in the apparatus, and the heating temperature or the conveyance speed in the heating unit is thereby controlled on the basis of the moisture content of the photosensitive thermal developable recording material during thermal development thereof. Accordingly, the apparatus enables stable thermal development not depending on the moisture content of the photosensitive thermal developable recording material.

Preferably in the thermal development apparatus, the moisture content of the photosensitive thermal developable recording material is determined by monitoring the humidity inside or around the apparatus. Accordingly, the data that are near to the moisture content of the photosensitive thermal developable recording material being processed in the apparatus can be readily obtained, therefore enabling accurate control in thermal development of the material.

According to the second aspect of the invention, the cassette that houses the photosensitive thermal developable recording material to be processed in the apparatus is equipped with a moisture sensor, and the moisture sensor is for monitoring the humidity inside or around the cassette. Accordingly, the output data of the moisture sensor of the cassette are directly near to the moisture content of the photosensitive thermal developable recording material being processed in the apparatus, therefore enabling accurate control in thermal development of the material.

Preferably, the cassette is provided with a memory unit of memorizing the monitor information from the moisture sensor. The memory unit stores and releases the moisture content history of the photosensitive thermal developable recording material being processed in the apparatus.

Also preferably, the moisture sensor and the memory unit are on the side face of the cassette, and the cassette may be handled in the same manner as that for ordinary cassettes.

Also preferably, the thermal development apparatus is provided with a reader unit of reading the monitor information out of the memory unit. Accordingly, the apparatus can readily take the moisture information from the cassette and enables suitable heating control or conveyance speed control in the thermal development section therein.

DETAILED DESCRIPTION OF THE INVENTION

The best mode for carrying out the invention is described in detail hereinunder with reference to the drawings attached hereto.

The relationship between the moisture content of the photosensitive thermal developable recording material (double-sided photosensitive film) to be processed in the apparatus of the invention and the thermal energy to be applied to the material is described.

FIG. 1 is a thermal energy characteristic diagram to show the moisture content of double-sided photosensitive film vs the thermal energy to be applied to the film, necessary for producing a predetermined image density, in which the vertical axis indicates the thermal energy (mJ) applied to a double-sided photosensitive film, and the horizontal axis indicates the moisture content (%) of the film.

The moisture content vs energy characteristic of a double-sided photosensitive film necessary for producing a predetermined image density was investigated. As in the drawing, it has been found that there are two types of double-sided photosensitive film, film Fa and film Fb. Specifically, the type of the double-sided photosensitive film Fa is as follows: When its moisture content is low (m1), then the thermal energy to be applied to the film for producing a predetermined image density may be small (E1); but when its moisture content increases (m2), then the film requires an increased amount of thermal energy (E4).

On the other hand, the type of the double-sided photosensitive film Fb is as follows: When its moisture content is low (m1), then the thermal energy to be applied to the film for producing a predetermined image density must be large (E3); but when its moisture content increases (m2), then the thermal energy to be applied thereto decreases (E2). The material of the double-sided photosensitive film P to be processed herein is described hereinunder.

The correction tendency varies depending on the type of the double-sided photosensitive film to be processed. Accordingly, the control unit in the thermal development apparatus of the invention is provided with a table or relational equation data (moisture correction information) of thermal energy vs moisture content of every type of double-sided photosensitive films to be processed in the apparatus, and the apparatus is further provided with a moisture sensor of monitoring the humidity around the double-sided photosensitive films during thermal development thereof.

In thermal development, the type of the double-sided photosensitive film to be processed is previously inputted into the control unit from an inputting unit (not shown), and the moisture content of the film is transferred from the moisture sensor to the control unit. Accordingly, the control unit determines the thermal energy to be applied to the double-sided photosensitive film in accordance with the type of the film and the moisture content thereof during thermal development, and controls the heating mode (when a large quantity of heat energy is to be imparted to the film; then the film is heated at a higher temperature in the heating unit; but when a small quantity of heat energy is to be imparted to the film; then the film is heated at a lower temperature in the heating unit), or the conveyance speed mode (when a large quantity of heat energy is to be imparted to the film, then the film is conveyed slowly; but when a small quantity of heat energy is to be imparted to the film, then the film is conveyed rapidly) so as to attain the determined thermal energy.

FIRST EMBODIMENT OF THE INVENTION

Figure 2:
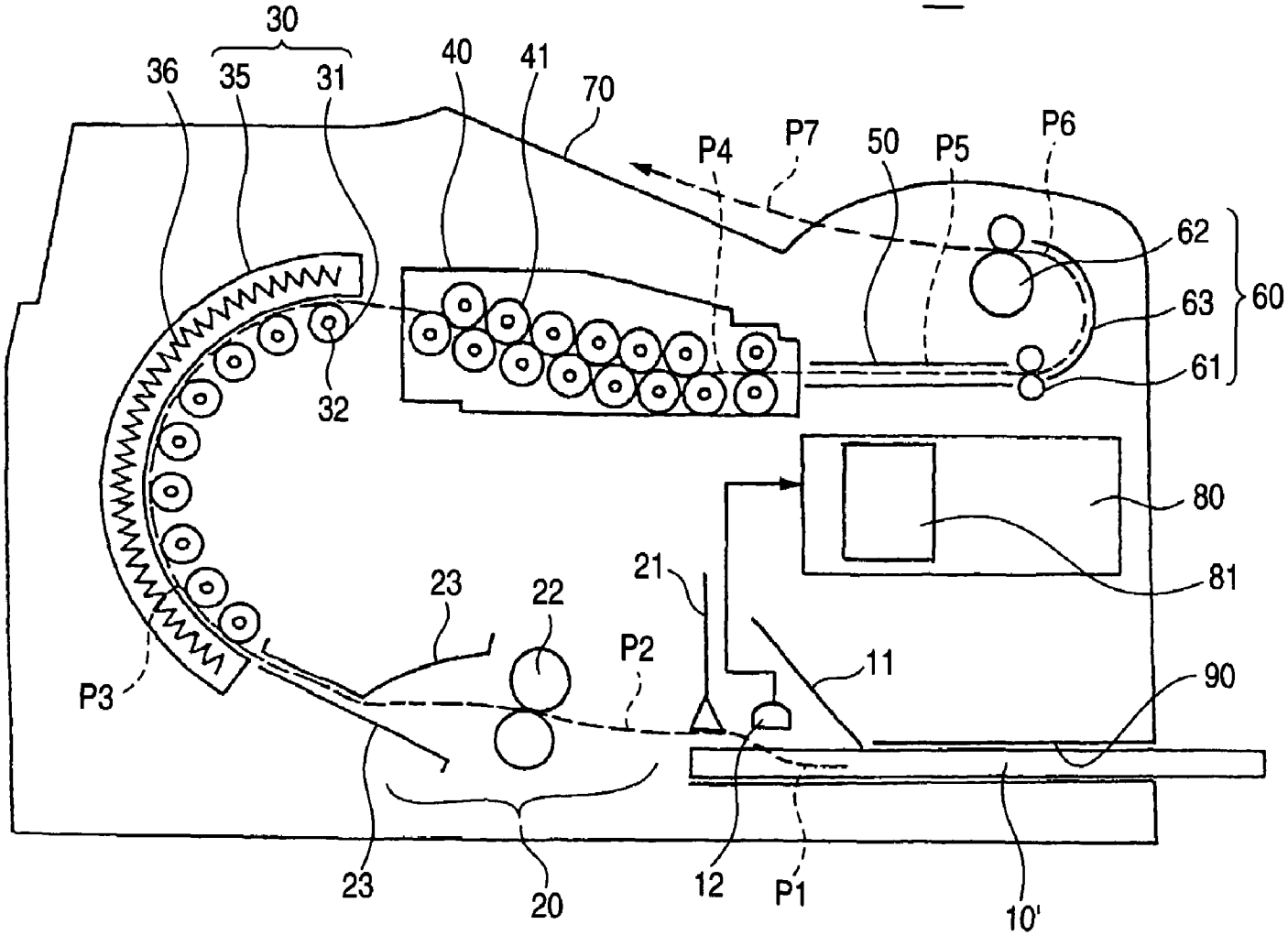
FIG. 2 shows a thermal development apparatus of the first embodiment of the invention, which uniformly heats the two faces of a double-sided photosensitive film.

FIG. 2 shows a thermal development apparatus of the first embodiment of the invention, which uniformly heats the two faces of a double-sided photosensitive film.

In the drawing, 100 is a thermal development apparatus for double-sided photosensitive films; P (P1, P2, P3, . . . ) is a double-sided photosensitive film; 101 is a cassette; 11 is a openable rid; 12 is a moisture sensor provided therein according to the invention; 20 is a conveyor unit; 21 is a sucker; 22 is a conveyor roller pair; 23 is a conveyor guide; 30 is a thermal development section; 31 is a first heating unit (heat roller); 32 is a built-in heater; 35 is a second heating unit (heat plate); 36 is a surface heater; 40 is a pre-cooling section; 50 is a cooling section; 60 is a conveyor unit; 61 and 62 are take-out roller pairs; 63 is a conveyor guide; and 70 is a tray. 80 is a power/control unit for power supply to the operation units and for control of the conveyance speed through the units; 81 is a moisture correction information unit provided in the apparatus according to the invention; and 90 is a cassette holder section of holding the cassette 10' therein.

The thermal development apparatus 100 of the first embodiment of the invention is characterized in that the moisture sensor 12 is fitted inside the apparatus and that the power/control unit 80 is provided with the moisture correction information unit 81.

Figure 7:
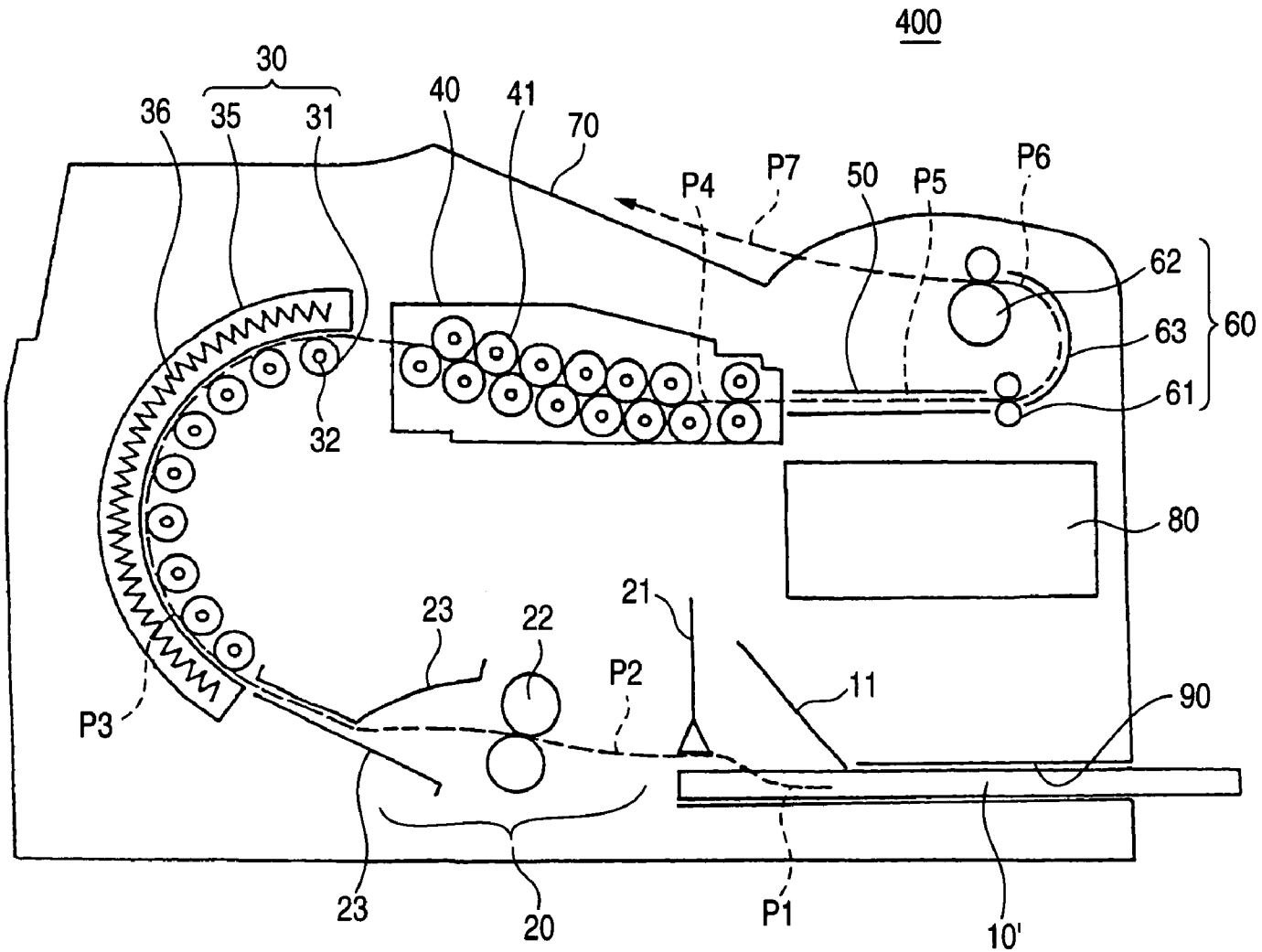
FIG. 7 shows a thermal development apparatus capable of uniformly heating both faces of double-sided photosensitive films.

The other constitution of the apparatus of FIG. 2 is the same as that of the thermal development apparatus 400 of FIG. 7.

When the cassette 10' is inserted into the cassette holder section 90, then the openable lid 11 is automatically opened, and the double-sided photosensitive film P1 is taken out of the cassette 10' by the sucker 21. Then, this is conveyed to the thermal development section 30 existing downstream in the conveyance direction via the conveyor unit 20. The thermal development section 30 is provided with the first heating unit 31 and the second heating unit 35, in which the film is heated while passing between the two.

On the other hand, the moisture sensor 12 detects the humidity inside the apparatus and transmits the moisture information to the control unit 80. The control unit 80 determines the suitable thermal energy to be applied to the double-sided photosensitive film from the moisture correction information given by the moisture correction information unit 81 on the basis of the moisture information transferred from the moisture sensor 12 and the already-inputted data of the type of the film to be processed in the apparatus, and controls the heating mode in the first heating unit 31 and the second heating unit 35 or controls the conveyance speed of the heat rollers 31 so as to attain the determined data.

When the apparatus is provided with any other heating unit than the second heating unit 35, then the second heating unit 35 may be mere rollers.

For controlling the heating mode thereof, the heating unit may be at a higher temperature when a larger quantity of heat energy is to be applied to the film, and it may be at a lower temperature when a smaller quantity of heat energy is to be applied to the film.

For controlling the conveyance speed of the film, the running speed of the heat rollers 31 that are the first heating unit and serve also for film conveyance is controlled. Concretely, the rollers are driven slowly when a large quantity of heat energy is to be applied to the film; and they are driven rapidly when a small quantity of heat energy is to be applied to the film.

After the moisture-corrected thermal development thereof is finished in the manner as above, the double-sided photosensitive film P4 is conveyed to the pre-cooling section 40 in which it is gradually cooled so that it is not wrinkled, and then conveyed to the cooling section 50 in which it is further cooled so that it does not cause skin burns. With that, the film is conveyed by the conveyance unit 60 and it is taken out in the tray 70.

According to the invention, the moisture sensor is disposed inside the thermal development apparatus 100, and in place of the essential measurement of the moisture content of the double-sided photosensitive film to be processed, the humidity inside the apparatus 100 is measured. Based on the data in the moisture correction information unit 81, the thermal energy to be imparted to the film is computed, and the apparatus attains the heat control or the conveyance speed control in accordance with the thus-computed data.

In that manner, the humidity data inside the thermal development apparatus 100 are reflected on the thermal development temperature, and therefore stable thermal development may be attained in the apparatus with no moisture influence thereon.

Regarding the position of the moisture sensor 12 in the first embodiment of the invention, the sensor is preferably disposed near to the film take-out mouth of the film cassette. Not limited to it, however, the sensor may be disposed anywhere inside the thermal development apparatus 100.

If desired, the sensor may be disposed outside the apparatus so as to attain the moisture correction on the basis of the humidity in the operation room. It has been confirmed that this embodiment also attains a remarkable correction effect as compared with the case with no moisture correction.

SECOND EMBODIMENT OF THE INVENTION

Figure 3:
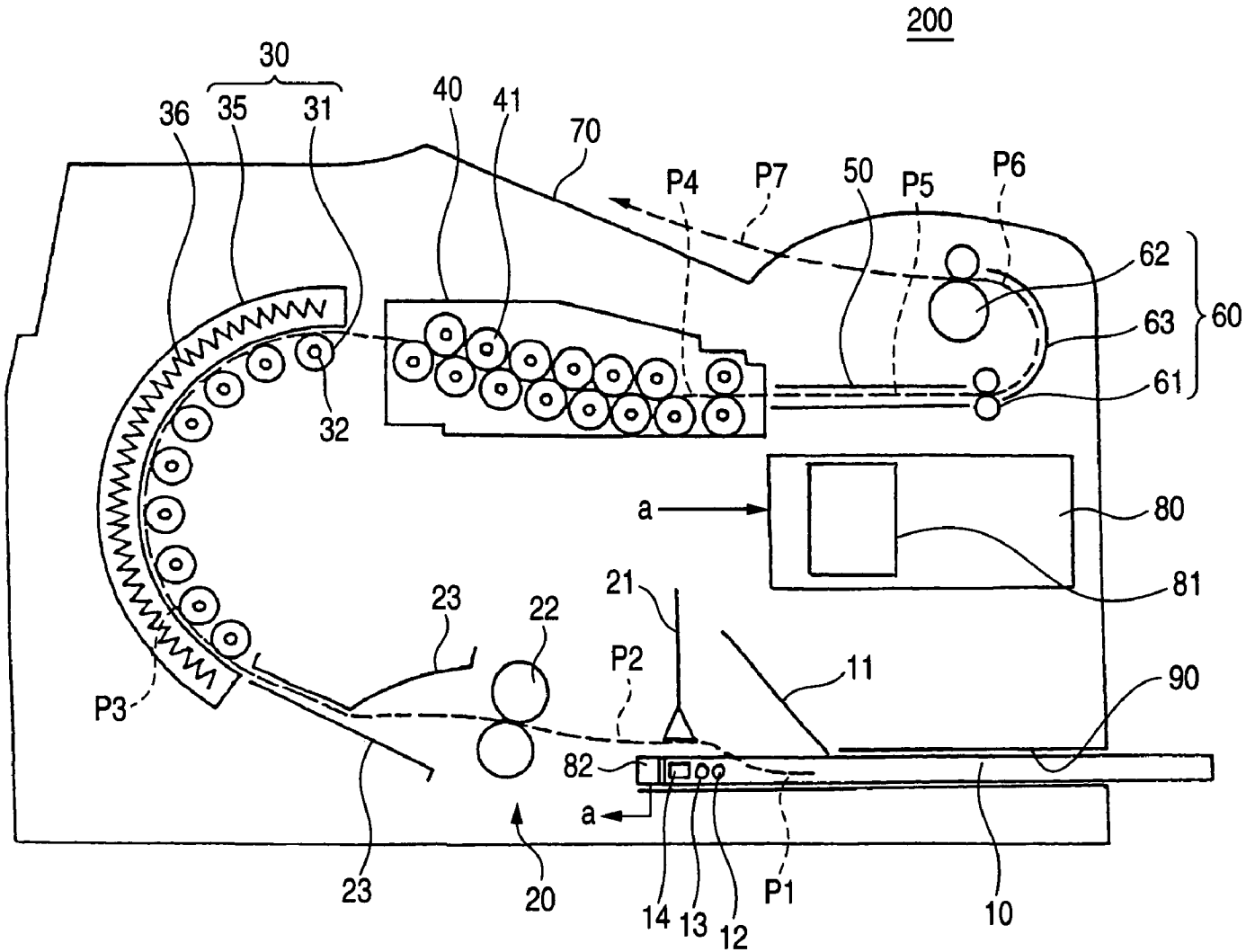
FIG. 3 shows a thermal development apparatus of the second embodiment of the invention.

FIG. 3 shows a thermal development apparatus of the second embodiment of the invention.

In the drawing, 200 is a thermal development apparatus for double-sided photosensitive films; 10 is a cassette of the second embodiment of the invention; 11 is an openable lid; 12 is a moisture sensor provided therein according to the invention; 13 and 14 are a battery and an IC chip provided therein according to the second embodiment of the invention; 80 is a power/control unit for power supply to the operation units and for conveyance speed control; and 81 is a moisture correction information unit provided therein according to the invention.

The other constitution of the apparatus of FIG. 3 is the same as that of the thermal development apparatus 400 of FIG. 7, and its description is omitted herein.

The thermal development apparatus 200 of the second embodiment of the invention is characterized in that the moisture sensor 12 is fitted to the cassette 10, not inside the apparatus (or in the operation room) as in the first embodiment mentioned above, and that the IC chip 14 and the battery 13 to drive it are fitted to the cassette 10.

Figure 4:
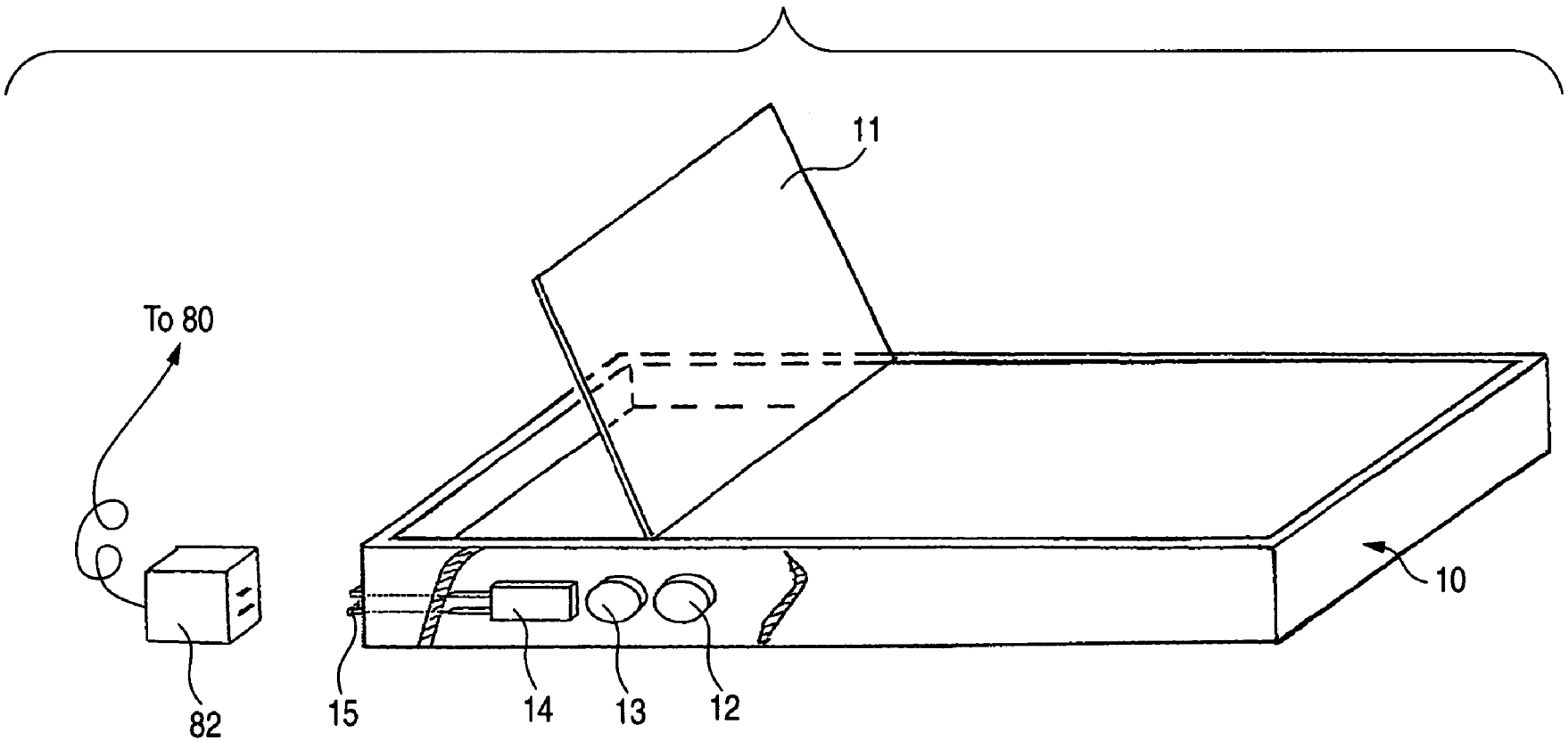
FIG. 4 is a perspective view of the cassette of the second embodiment of the invention.

FIG. 4 is a perspective view of the cassette of the second embodiment of the invention.

In the drawing, 10 is the cassette of the second embodiment of the invention; 11 is an openable lid; 12 is a moisture sensor provided therein according to the invention; 13 is a battery; 14 is an IC chip provided therein according to the second embodiment of the invention; 15 is a connector for transmitting the moisture information to the thermal development apparatus 200. 82 is a moisture information receiver unit of receiving the moisture information from the IC chip 14. This is provided inside the thermal development apparatus 200. When the cassette 10 is put into the apparatus, then the receiver unit is kept connected to the connector 15, and it receives the moisture information from the IC chip in that condition. Thus having received the moisture information, the moisture information receiver unit 82 then transmits it to the control unit 80.

Based on the moisture information transferred from the IC chip 14 and the already-inputted data of the type of the double-sided photosensitive film to be processed in the apparatus, the control unit 80 determines the thermal energy to be applied to the film, and controls the heating mode in the first heating unit 31 and the second heating unit 35 in the thermal development section 30 or controls the conveyance speed of the heat rollers 31 serving for film conveyance, so as to attain the determined data.

When the cassette 10 is inserted into the cassette holder section 90, then the openable lid 11 is automatically opened, and the double-sided photosensitive film P1 is taken out of the cassette 10 by the sucker 21. Then, this is conveyed to the thermal development section 30 existing downstream in the conveyance direction via the conveyor unit 20. The thermal development section 30 is provided with the first heating unit 31 and the second heating unit 35, in which the film is heated while passing between the two.

On the other hand, the moisture sensor 12 detects the humidity inside the cassette 10 and its data are successively memorized by the IC chip 14. The memory data are transferred to the control unit 80 via the moisture information receiver unit 82. The control unit 80 determines the suitable thermal energy to be applied to the double-sided photosensitive film from the moisture correction information from the moisture correction information unit 81, on the basis of the memory data transferred from the moisture sensor 12 and the already-inputted data of the type of the double-sided photosensitive film to be processed in the apparatus, and controls the heating mode in the first heating unit 31 and the second heating unit 35 or controls the conveyance speed of the heat rollers 31 so as to attain the determined data.

For controlling the heating mode thereof, the heating unit may be at a higher temperature when a larger quantity of heat energy is to be applied to the film, and it may be at a lower temperature when a smaller quantity of heat energy is to be applied to the film. For controlling the conveyance speed of the film, the running speed of the heat rollers 31 that serve also for film conveyance is controlled. Concretely, the rollers are driven slowly when a large quantity of heat energy is to be applied to the film; and they are driven rapidly when a small quantity of heat energy is to be applied to the film.

In the second embodiment of the invention, the moisture sensor 12 is fitted to the cassette 10. Therefore, when the cassette 10 with a double-sided photosensitive film therein is carried out of the thermal development apparatus, the moisture sensor may detect the moisture content of the film that is exposed to the outside environment. Accordingly, as compared with the first embodiment of the invention mentioned above in which the moisture content of the double-sided photosensitive film to be processed is detected inside the thermal development apparatus, the second embodiment ensures more accurate moisture information detection and therefore ensures more accurate heat control and conveyance speed control.

In the second embodiment of the invention, the moisture sensor 12 is fitted to the side face of the cassette 10. Not limited to it, however, the moisture sensor may be fitted anywhere around the cassette 10 so far as it can detect the humidity inside and around the cassette 10.

When the memory unit 14 of memorizing the monitor information from the moisture sensor 12 and the battery 13 for power supply to the memory unit 14 are fitted to the cassette 10 so that the monitor information from the moisture sensor 12 could be successively memorized by the memory unit 14, then not only the real-time moisture information but also the past-time moisture information can be known from it. Accordingly, the actual humidity environment×time for which the film to be processed is actually exposed to the environment can be computed, and the real-time water content of the film being processed can be accurately computed.

In the second embodiment of the invention mentioned above, the moisture sensor is fitted to the cassette 10. Accordingly, the moisture content of the double-sided photosensitive film to be processed may be determined through the moisture detection inside the cassette 10, and the second embodiment ensures more accurate moisture information detection and therefore ensures more accurate heat control and conveyance speed control.

The photosensitive thermal developable recording material to be processed in the thermal development apparatus of the invention is described in detail hereinunder. The photosensitive thermal developable recording material is not one on which image information is written through scanning exposure to laser light or the like, but one on which images are recorded through surface exposure.

Heretofore, the photosensitive thermal developable recording material of the type is generally used in the field of photographic materials for wet development, and there are known direct or indirect X-ray films and mammographic films for medical use; photomechanical films for printing; recording film for industrial use; and picture-taking films for ordinary cameras. For example, some patent references disclose blue fluorescent intensifying screen-having, double-coated photosensitive thermal developable recording materials for X-ray exposure (e.g., see Japanese Patent No. 3,229,344); tabular silver bromoiodide grains-containing photosensitive thermal developable recording materials (e.g., see JP-A 59-142539); or photographic materials for medical use produced by applying (100) main face-having, tabular, high-silver-chloride grains to both faces of a support (e.g., see JP-A 10-282606). In addition, double-coated photosensitive thermal developable recording materials are disclosed in other patent references (e.g., see JP-A2000-227642, 2001-22027, 2001-109101, 2002-90941). In these known examples, however, when fine silver halide grains of at most 0.1 μm in size are used, then the sensitivity of the materials is low though the haze resistance thereof is not worsened, and the materials of the type are impracticable for taking pictures. On the other hand, when silver halide grains having a grain size of 0.3 μm or more are used, then the haze resistance of the materials is worsened owing to the silver halide grains remaining therein and the quality of the images printed out on the materials is significantly worsened, and therefore the materials of the type are also impracticable.

Photographic materials that comprise tabular silver halide grains are known in the field of wet development (e.g., see JP-A 59-119344, 59-119350), but are not used in the field of thermal development. The reason is because of their low sensitivity as so mentioned hereinabove, and there is not known any effective method for sensitizing them. Another reason is that the technical barrier in the field of thermal development is high.

Photosensitive thermal developable recording materials for taking pictures are desired to have a further higher sensitivity and, in addition, they must be on a further higher level in point of the image quality thereof including the haze resistance of the materials.

Photosensitive thermal developable recording materials mentioned below will be useful for those satisfying the above-mentioned requirements.

1. Photosensitive Thermal Developable Recording Materials:

The photosensitive thermal developable recording material of this embodiment has, on at least one face of the support thereof, an image-forming layer that contains a photosensitive silver halide, a non-photosensitive organic silver salt, a reducing agent, and a binder. Preferably, a surface-protective layer may be formed on the image-forming layer, or a back layer or a back-protective layer may be formed on the opposite side of the image-forming layer.

The constitution of these layers and their preferred ingredients are described in detail hereinunder.

(Compound Capable of Substantially Reducing the Photosensitive Silver Halide-Derived Visible Light Absorption After Thermal Development)

In this embodiment, the photosensitive thermal developable recording material preferably contains a compound capable of substantially reducing the photosensitive silver halide-derived visible light absorption after thermal development relative to that before thermal development.

In this embodiment, the compound capable of substantially reducing the photosensitive silver halide-derived visible light absorption after thermal development is preferably a silver iodide complex-forming agent.

(Description of Silver Iodide Complex-Forming Agent)

In the compound for the silver iodide complex-forming agent in this embodiment, at least one nitrogen or sulfur atom may be a coordinated atom (electron donor: Lewis base) that contributes to Lewis acid-base reaction for electron donation to silver ions. The stability of the complex may be defined by the successive stability constant or the total stability constant thereof, depending on the combination of the three, silver ion, iodide ion and the silver complex-forming agent. As a general guideline, the complex may obtain a large stability constant as a result of the chelate effect in intramolecular chelate ring formation or of the increase in the acid/base dissociation constant of the ligand.

Though not definitely clarified, the effect and the mechanism of the silver iodide complex-forming agent in this embodiment may be presumed as follows: The agent may form a stable complex of at least three components including iodide ion and silver ion, thereby solubilizing silver iodide. The ability of the silver iodide complex-forming agent in this embodiment to solubilize silver bromide and silver chloride is poor, but the agent reacts specifically with silver iodide.

The details of the mechanism of the silver iodide complex-forming agent in this embodiment to improve the image storability of the photosensitive thermal developable recording material that contains the agent are not clarified. However, it may be considered that the silver iodide complex-forming agent in this embodiment will react at least partly with the photosensitive silver halide in the material during thermal development of the material to form a complex, whereby the photosensitivity of the material may be lowered or the material may lose its photosensitivity. As a result, the image storability of the material may be significantly improved especially under exposure to light. At the same time, in addition, the film turbidity owing to the silver halide in the material is also reduced, and, as a result, the material gives clear and high-quality images. This is another characteristic advantage of the material. The film turbidity reduction may be confirmed through the reduction in the UV to visible light absorption in the light absorption spectrum of the material.

In this embodiment, the UV to visible light absorption spectrum of the photosensitive silver halide in the material may be determined according to a transmission method or a reflection method. When the absorption derived from the other compounds added to the photosensitive thermal developable recording material overlaps with the absorption by the photosensitive silver halide in the material, then differential spectrometry between them or removal of the other compounds with a solvent may be employed singly or as combined to thereby observe the UV to visible light absorption spectrum of the photosensitive silver halide alone.

The silver iodide complex-forming agent in this embodiment clearly differs from ordinary silver ion complex-forming agents in that it indispensably requires an iodide ion for forming a stable complex. Ordinary silver ion complex-forming agents have the ability to dissolve silver ion-containing salts such as silver bromide, silver chloride or organic silver salts, e.g., silver behenate, but the silver iodide complex-forming agent in this embodiment is active only in the presence of silver iodide. This is one characteristic feature of the silver iodide complex-forming agent in this embodiment.

Specific compounds for the silver iodide complex-forming agent in this embodiment may be the same as those described in detail in Japanese Patent Application nos. 2002-367661, 2002-367662, 2002-367663. Examples of the compounds described in these patent application specifications may also be referred to herein as specific examples of the compounds for the silver iodide complex-forming agent in this embodiment.

For significantly improving the image storability especially that under exposure to light of the photosensitive thermal developable recording material of this embodiment, it is desirable that the absorption intensity of the UV to visible light absorption spectrum of the photosensitive silver halide in the thermally-developed material is at most 80%, more preferably at most 40%, even more preferably at most 20%, most preferably at most 10%, as compared with the absorption intensity thereof before thermal development.

The silver iodide complex-forming agent in this embodiment may be added to the coating solution in any form of solution, emulsified dispersion or solid particle dispersion in order that it may be incorporated into the photosensitive thermal developable recording material.

A well-known emulsifying dispersion method may be employed for it. Concretely, the agent is dissolved in an oil such as dibutyl phthalate, tricresyl phosphate, glyceryl triacetate or diethyl phthalate in the presence of an auxiliary solvent such as ethyl acetate or cyclohexanone, and this is mechanically emulsified to give its dispersion.

(Description of Photosensitive Silver Halide)

1) Halogen Composition:

Importantly, the photosensitive silver halide for use in this embodiment has a high silver iodide content of from 40 mol % to 100 mol %. The other than silver iodide is not specifically defined, and may be selected from silver halide such as silver chloride or silver bromide, or organic silver salt such as silver thiocyanate or silver phosphate. Preferably, it is silver bromide or silver chloride. Using the silver halide that has such a high silver iodide content makes it possible to design good photosensitive thermal developable recording materials having good image storability after thermal development, especially having good fogging resistance under exposure to light.

More preferably, the silver iodide content of the photosensitive silver halide is from 70 mol % to 100 mol %, even more preferably from 80 mol % to 100 mol %, still more preferably from 90 mol % to 100 mol % in view of the image storability of the processed material especially under exposure to light.

Regarding the halogen composition distribution in each silver halide grain, the composition may be uniform throughout the grain, or may stepwise vary, or may continuously vary. Core/shell structured silver halide grains are preferred for use herein. Preferably, the core/shell structure of the grains has from 2 to 5 layers, more preferably from 2 to 4 layers. High-silver iodide-core grains in which the silver iodide content of the core is high; or high-silver iodide-shell grains in which the silver iodide content of the shell is high are also preferably used herein. A technique of localizing epitaxially-grown silver chloride or silver bromide in the surfaces of grains is also preferably employed herein.

Silver iodide in this embodiment may have any desired B-phase and γ-phase content. The β-phase indicates a high-silver iodide structure having a hexagonal-system wurtzite structure; and the γ-phase indicates a high-silver iodide structure having a cubic-system zinc blend structure. The γ-phase content is determined according to the method proposed by C. R. Berry. In this method, the β-phase content is determined on the basis of the peak ratio of the β-phase (100), (101), (002) of silveriodide to the γ-phase (111) in powdery X-ray spectrometry. For its details, for example, referred to is the description given in *Physical Review, Volume* 161, No. 3. pp. 848-851 (1967).

2) Grain Size:

The high-silver iodide grains for use in this embodiment may be satisfactorily large grains necessary for attaining high sensitivity. The mean sphere-corresponding diameter of the silver halide grains for use in this embodiment is preferably from 0.3 μm to 5.0 μm, more preferably from 0.5 μm to 3.0 μm. The sphere-corresponding diameter as referred to herein means the diameter of a sphere having the same volume as that of one silver halide grain. To determine the size thereof, the silver halide grains are observed with an electronic microscope and the grain volume is obtained from the projected area and the thickness of each grain. From the grain volume thus measured, a sphere having the same volume as it is derived, and the diameter thereof is measured.

3) Coating Amount:

In general, in a photosensitive thermal developable recording material where silver halide remains as it is after thermal development, when the coating amount of silver halide is increased, then the film transparency decreases and is unfavorable for image quality. In this, therefore, the coating amount of silver halide is limited to a low level despite of the requirement of increasing the sensitivity of the material. In this embodiment, however, the film haze owing to silver halide can be reduced through thermal development, and therefore a larger amount of silver halide may be in the material. In the invention, the amount of the silver halide is preferably from 0.5 mol % to 100 mol %, more preferably from 5 mol % to 50 mol %, relative to one mol of silver of the non-photosensitive organic silver salt in the material.

4) Method of Grain Formation:

Methods of forming the photosensitive silver halides are well known in the art, for example, as in *Research Disclosure* 17029 (June 1978), and U.S. Pat. No. 3,700,458, and any known method is employable in the invention. Concretely, a silver source compound and a halogen source compound are added to gelatin or any other polymer solution to prepare a photosensitive silver halide, and it is then mixed with an organic silver salt. This method is preferred for the invention. Also preferred are the method described in JP-A 11-119374, paragraphs [0217] to [0244]; and the methods described in JP-A 11-352627 and 2000-347335.

For the formation of tabular silver iodide grains, preferred are the method described in JP-A 59-119350 and 59-119344.

5) Grain Morphology:

The silver halide grains for use in the invention are preferably tabular grains. Precisely, they include tabular 8-hedral grains, tabular 14-hedral grains and tabular 20-hedral grains, as grouped on the basis of the plane structure thereof. Of those, preferred are tabular 8-hedral grains and tabular 14-hedral grains. The tabular 8-hedral grains as referred to herein are grains having {0001} and { 1(−1)00} planes, or grains having {0001}, {1(−2)10} and {(−1)2(−1)0} planes; the tabular 14-hedral grains are grains having {0001}, {1(−1)00} and {1(−1)01} planes, or grains having {0001}, {1(−2)10}, {(−1)2(−1)0}, {1(−2)11} and {(−1)2(−1)1} planes, or grains having {0001}, {1(−1)00} and {1(−1)0(−1)} planes, or grains having {0001}, {1(−2)10}, {(−1)2(−1)0}, {1(−2)1(−1)} and {(−1)2(−1) (−1)} planes; and tabular 20-hedral grains are grains having {0001}, {1(−1)00}, {1(−1)01} and {1(−1)0(−1)} planes, or grains having {0001}, {1(−2)10}, {(−1)2(−1)0}, {1(−2)11}, {(−1)2(−1)

1}, {1(−2)1(−1)} and {(−1)2(−1) (−1)} planes. The expression of {0001} and others indicates the crystal plane group having the equivalent plane index as the (0001) plane. Any other tabular grains than those mentioned above are also preferably used in the invention.

12-hedral, 14-hedral and 8-hedral grains of silver iodide may be prepared with reference to the descriptions given in Japanese Patent Application Nos. 2002-08120, 2003-287835, 2003-287836.

The projected area-corresponding diameter of the tabular silver halide grains for use in the invention is preferably from 0.4 μm to 8.0 μm, more preferably from 0.5 μm to 3 μm. The projected area-corresponding diameter as referred to herein means the diameter of the circle having the same area as the projected area of one silver halide grain. To determine the size thereof, the silver halide grains are observed with an electronic microscope and the grain area is obtained from the projected area of each grain. From the grain area thus measured, a circle having the same area as it is derived, and the diameter thereof is measured.

the thickness of the photosensitive silver halide grains for use in the invention is preferably at most 0.3 μm, more preferably at most 0.2 μm, even more preferably at most 0.15 μm. The aspect ratio of the grains is preferably from 2 to 100, more preferably from 5 to 50.

The silver halide having a high silver iodide content for use in this embodiment may have different types of morphology. One preferred morphology of the grains for use herein are conjugate grains, for example, as in R. L Jenkins et al., *J. of Phot. Sci.,* Vol. 28 (1980), FIG. 1 on page 164. Also preferred are the tabular grains shown in FIG. 1 of the reference. Also preferred are corner-rounded silver halide grains. The surface index (Miller index) of the outer surface of the photosensitive silver halide grains for use in the invention is not specifically defined, but is desirably such that the proportion of [100] plane, which ensures higher spectral sensitization when it has adsorbed a color-sensitizing dye, in the outer surface is larger. Preferably, the proportion of [100] plane in the outer surface is at least 50%, more preferably at least 65%, even more preferably at least 80%. The Miller index indicated by the proportion of [100] plane can be identified according to the method described by T. Tani in *J. Imaging Sci.,* 29, 165 (1985), based on the adsorption dependency of sensitizing dye onto [111] plane and [100] plane.

6) Heavy Metal:

The photosensitive silver halide grains for use in this embodiment may contain a metal or metal complex of Groups 3 to 14 of the Periodic Table (including Groups 1 to 18). The metal of Groups 8 to 10, or the center metal of the metal complex is preferably rhodium, ruthenium or iridium. In the invention, one metal complex may be used alone, or two or more metal complexes of one and the same type of metal or different types of metals may also be used herein as combined. The metal or metal complex content of the grains preferably falls between $1\times10^{-9}$ mols and $1\times10^{-3}$ mols per mol of silver. Such heavy metals and metal complexes, and methods of adding them to silver halide grains are described in, for example, JP-A 7-225449; JP-A 11-65021, paragraphs [0018] to [0024]; and JP-A 11-119374, paragraphs [0227] to [0240].

Silver halide grains that contain a hexacyano-metal complex are preferred for use in this embodiment. The hexacyano-metal complex includes, for example, $[Fe(CN)_6]^{4-}$, $[Fe(CN)_6]^{3-}$, $[Ru(CN)_6]^{4-}$, $[Os(CN)_6]^{4-}$, $[Co(CN)_6]^{3-}$, $[Rh(CN)_6]^{3-}$, $[Ir(CN)_6]^{3-}$, $[Cr(CN)_6]^{3-}$, and $[Re(CN)_6]^{3-}$.

The hexacyano-metal complex may be added to silver halide grains in the form of a solution thereof in water or in a mixed solvent of water and an organic solvent miscible with water (for example, alcohols, ethers, glycols, ketones, esters, amides), or in the form of a mixture thereof with gelatin.

The amount of the hexacyano-metal complex to be added to the silver halide grains preferably falls between $1\times10^{-8}$ mols and $1\times10^{-2}$ mols, per mol of silver of the grains, more preferably between $1\times10^{-7}$ mols and $1\times10^{-3}$ mols.

The metal atoms (e.g., in $[Fe(CN)_6]^{4-}$) that may be added to the silver halide grains for use in this embodiment, as well as the methods of desalting or chemical sensitization of the silver halide emulsions are described, for example, in JP-A 11-84574, paragraphs [0046] to [0050]; JP-A11-65021, paragraphs [0025] to [0031]; and JP-A 11-119374, paragraphs [0242] to [0250].

7) Gelatin:

Gelatin of different types may be used in preparing the photosensitive silver halide emulsions for use in this embodiment. For better dispersion of the photosensitive silver halide emulsion in the organic silver salt-containing coating liquid in producing the photosensitive thermal developable recording material of the invention, preferred is low-molecular gelatin having a molecular weight of from 500 to 60,000. The low-molecular gelatin of the type may be used in forming the silver halide grains or in dispersing the grains after the grains have been desalted. Preferably, it is used in dispersing the desalted grains.

8) Chemical Sensitization:

The photosensitive silver halide grains for use in this embodiment may not be subjected to chemical sensitization but are preferably subjected to at least one chemical sensitization of chalcogen sensitization, gold sensitization or reduction sensitization. The chalcogen sensitization includes sulfur sensitization, selenium sensitization and tellurium sensitization.

In sulfur sensitization, unstable sulfur compounds may be used. For example, unstable sulfur compounds described in P. Grafkides, *Chimie et Physique Photographique* (Paul Montel, 1987, 5th Ed.); and *Research Disclosure,* Vol. 307, No. 307105 may be used.

Concretely, known sulfur compounds such as thiosulfates (e.g., hypo), thioureas (e.g., diphenylthiourea, triethylthiourea, N-ethyl-N'-(4-methyl-2-thiazolyl)thiourea, carboxymethyltrimethylthiourea), thioamides (e.g., thioacetamide), rhodanines (e.g., diethylrhodanine, 5-benzylidene-N-ethylrhodanine), phosphine sulfides (e.g., trimethylphosphine sulfide), thiohydantoins, 4-oxo-oxazolidine-2-thiones, disulfidesorpolysulfides (e.g., dimorpholine disulfide, cystine, lenthionine (1,2,3,5,6-pentathiepane)), polythionic acid salts, elemental sulfur, as well as active gelatin may be used. In particular, thiosulfuric acid salts, thioureas and rhodanines are preferred.

In selenium sensitization, unstable selenium compounds are used. For example, selenium compounds described in JP-B 43-13489, 44-15748; JP-A 4-25832, 4-109340, 4-271341, 5-40324, 5-11385; Japanese Patent Application Nos. 4-202415, 4-330495, 4-333030, 5-4203, 5-4204, 5-0¥106977, 5-236538, 5-241642, 5-286916 may be used.

Concretely, colloidalmetalselenium, selenoureas (e.g., N,N-dimethylselenourea, trifluoromethylcarbonyl-trimethylselenourea, acetyl-trimethylselenourea), selenamides (e.g., selenamide, N,N-diethylphenylselenamide), phosphine selenides (e.g., triphenylphosphine selenide, pentafluorophenyl-triphenylphosphine selenide), selenophosphates (e.g., tri-p-tolyl selenophosphate, tri-n-butyl selenophosphate), selenoketones (e.g., selenobenzophenone), isoselenocyanates, selenocarboxylic acids, selenoesters, diacylselenides may be used. In addition, non-unstable selenium compounds such as those described in JP-B 46-4553, 52-34492, for example, selenious acid, selenocyanic acid salts, selenazoles, and selenides may also be used. In particular, phosphine selenides, selenoureas and selenocyanic acid salts are preferred.

Intellurium sensitization, unstable tellurium compounds may be used. For example, unstable tellurium compounds described in JP-A 4-224595, 4-271341, 4-333043, 5-303157, 6-27573, 6-175258, 6-180478, 6-208186, 6-208184, 6-317867, 7-140579, 7-301879, 7-301880 may be used.

Concretely, phosphine tellurides (e.g., butyl diisopropyl phosphine telluride, tributyl phosphine telluride, tributoxy phosphine telluride, ethoxydiphenyl phosphine telluride), diacyl(di)tellurides (e.g., bis(diphenylcarbamoyl)ditelluride, bis(N-phenyl-N-methylcarbamoyl)ditelluride, bis(N-phenyl-N-methylcarbamoyl)telluride, bis(N-phenyl-N-benzylcarbamoyl)telluride, bis(ethoxycarbonyl)telluride), tellureoureas (e.g., N,N'-dimethylethylenetellurourea, N,N'-diphenylethylenetellurourea), telluramides, telluroesters may be used. In particular, diacyl(di)tellurides and phosphine tellurides are preferred. More preferred are the compounds described in JP-A 11-65021, paragraph [0030]; and the compounds of formulae (II), (III) and (IV) given in JP-A5-313284.

For the chalcogen sensitization in this embodiment, preferred are selenium sensitization and tellurium sensitization; and more preferred is tellurium sensitization.

In gold sensitization, usable are gold sensitizers such as those described in P. Grafkides, *Chimie et Physique Photographique* (Paul Montel, 1987, 5th Ed.); and *Research Disclosure,* Vol. 307, No. 307105. Concretely, chloroauric acid, potassium chloroaurate, potassium aurithiocyanate, gold sulfide, and gold selenide may be used. In addition to these, also usable are the gold compounds described in U.S. Pat. Nos. 2,642,361, 5,049,484, 5,049,485, 5,169,751, 5,252,455, and Belgian Patent No. 691,857. Noble metal salts of platinum, palladium or indium except gold, such as those described in P. Grafkides, *Chimie et Physique Photographique* (Paul Montel, 1987, 5th Ed.); and *Research Disclosure,* Vol. 307, No. 307105 are also usable herein.

The gold sensitization may be effected alone, but is preferably combined with the above-mentioned chalcogen sensitization. Concretely, the combination includes gold-sulfur sensitization, gold-selenium sensitization, gold-tellurium sensitization, gold-sulfur-selenium sensitization, gold-sulfur-tellurium sensitization, gold-selenium-tellurium sensitization, and gold-sulfur-selenium-tellurium sensitization.

In this embodiment, the photosensitive silver halides may be chemically sensitized in any stage after their formation but before their coating. For example, they may be chemically sensitized after desalted, but (1) before spectral sensitization, or (2) along with spectral sensitization, or (3) after spectral sensitization, or (4) just before coating.

The amount of the chalcogen sensitizer to be used in this embodiment varies, depending on the type of the silver halide grains to be sensitized therewith and the condition for chemically ripening the grains, but may fall generally between $10^{-8}$ and $10^{-1}$ mols, preferably between $10^{-7}$ and $10^{-2}$ mols or so, per mol of the silver halide.

The amount of the gold sensitizer to be used in this embodiment also varies depending on various conditions. In general, it may fall between $10^{-7}$ and $10^{-2}$ mols, preferably between $10^{-6}$ and $5\times10^{-3}$ mols, per mol of the silver halide. Not specifically defined, the condition for chemical sensitization of the silver halide emulsions may be such that the pAg is at most 8, preferably at most 7.0, more preferably at most 6.5, even more preferably at most 6.0, the pAg is at least 1.5, preferably at least 2.0, more preferably at least 2.5; the pH is from 3 to 10, preferably from 4 to 9; the temperature falls between 20 and 95° C., preferably between 25 and 80° C. or so.

In this embodiment, the chalcogen sensitization and the gold sensitization may be further combined with reduction sensitization. Especially preferably, the chalcogen sensitization is combined with reduction sensitization. For the reduction sensitization, preferred are ascorbic acid, thiourea dioxide, dimethylamine-borane. In addition to these, also preferred are stannous chloride, aminoiminomethanesulfinic acid, hydrazine derivatives, borane compounds, silane compounds, and polyamine compounds. The reduction sensitizer may be added to the grains in any stage of preparing the photosensitive emulsions including the stage of grain growth to just before coating the emulsions. Preferably, the emulsions are subjected to such reduction sensitization while they are kept ripened at a pH of 8 or more and at a pAg of 4 or less. Also preferably, they may be subjected to reduction sensitization while the grains are formed with a single addition part of silver ions being introduced thereinto.

The amount of the reduction sensitizer to be added to the grains varies, depending on various conditions. In general, it may fall between $10^{-7}$ and $10^{-1}$ mols, preferably between $10^{-6}$ and $5\times10^{-2}$ mols, per mol of the silver halide.

The silver halide emulsions for use in this embodiment may contain a thiosulfonic acid compound that may be added thereto according the method described in European Patent No. 293,917.

The photosensitive silver halide grains for use in this embodiment are preferably subjected to at least one chemical sensitization of gold sensitization or chalcogen sensitization for favorably planning the photosensitive thermal developable recording material of high sensitivity.

9) Compound of Which One-Electron Oxidation Product Formed Through One-Electron Oxidation Can Release One or More Electrons:

Preferably, the photosensitive thermal developable recording material of this embodiment contains a compound of which one-electron oxidation product formed through one-electron-oxidation can release one or more electrons. The compound may be used singly or as combined with any other various chemical sensitizer such as those mentioned above, and it increases the sensitivity of silver halides.

The compound of which one-electron oxidation product formed through one-electron oxidation can release one or more electrons and which may be in the photosensitive thermal developable recording material of this embodiment may be selected from those of the following type 1 to type 5.

(Type 1)

Compound of which one-electron oxidation product formed through one-electron oxidation may release further 2 or more electrons through subsequent bond cleavage.

(Type 2)

Compound of which one-electron oxidation product formed through one-electron oxidation may release still another electron through subsequent bond cleavage and which has at least two silver halide-adsorptive groups in one and the same molecule.

(Type 3)

Compound of which one-electron oxidation product formed through one-electron oxidation may release further one or more electrons after subsequent bond formation.

(Type 4)

Compound of which one-electron oxidation product formed through one-electron oxidation may release further one or more electrons after subsequent intramolecular ring cleavage.

(Type 5)

Compound of X-Y in which X indicates a reducing group and Y indicates a leaving group. Its one-electron oxidation product formed through one-electron oxidation at the reducing group of X thereof forms a radical X after having released Y through subsequent X-Y bond cleavage, and releases still another electron from it.

Of the compounds of type 1 and types 3 to 5 mentioned above, preferred are "compounds having silver halide-adsorptive group in the molecule" or "compounds having a partial structure of spectral sensitizer in the molecule". More preferred are "compounds having silver halide-adsorptive group in the molecule". Of the compounds of types 1 to 4, more preferred are "compounds having, as the adsorptive group, a nitrogen-containing heterocyclic group substituted with at least 2 mercapto groups".

The compounds of types 1 to 4 for use in this embodiment are the same as those described in detail in JP-A 2003-114487, 2003-114486, 2003-140287, 2003-75950, 2003-114488, and Japanese Patent Application Nos. 2003-25886, 2003-33446. Specific examples of the compounds described in the patent references may also apply to this embodiment for the specific examples of the compounds of types 1 to 4. In addition, the descriptions of these patent references are referred to for production examples for the compounds of types 1 to 4 for this embodiment.

For additional specific examples of the compounds of type 5 for use in this embodiment, further referred to are JP-A9-211769 (compounds PMT-1 to S-37 described in Table E and Table F on pp. 28-32); JP-A 9-211774; JP-A 11-95355 (compounds INV 1 to 56); JP-T 2001-500996 (compounds 1 to 74, 80 to 87, 92 to 122) (the term "JP-T" as used herein means a published Japanese translation of a PCT patent application); U.S. Pat. Nos. 5,747,235, 5,747,236; European Patent No. 786,692A1 (compounds INV 1 to 35); European Patent No. 893,732A1; U.S. Pat. Nos. 6,054,260, 5,994,051. The compounds that are referred to as "one-photon two-electron sensitizers" or "de-protonating electron-donating sensitizers" in these patent references may directly apply to this embodiment of the present invention.

The compounds of types 1 to 5 mentioned herein may be added to photosensitive silver halide emulsions in any stage of preparing the emulsions or producing photosensitive thermal developable recording materials. For example, the compound may be added to the emulsion while photosensitive silver halide grains are formed, or desalted or chemically sensitized, or just before the emulsion is applied to a support. If desired, the compound may be divided into some portions and they may be separately added to the emulsion in these steps. Regarding the time at which the compound is added to the emulsion, it is desirable that the compound is added thereto after photosensitive silver halide grains have been formed but before they are desalted, or while the grains are chemically sensitized (precisely, just before the start of chemical sensitization and just after the finish thereof), or just before the emulsion is applied to a support. More preferably, the compound is added to the emulsion while the grains are chemically sensitized and before they are mixed with a non-photosensitive organic silver salt.

Preferably, the compounds of types 1 to 5 are added to the emulsion after dissolved in water or a water-soluble solvent such as methanol or ethanol or in a mixed solvent of these. In case where the compound is dissolved in water, its pH may be increased or decreased if the compound is more soluble therein at an increased or decreased pH.

Preferably, the compounds of types 1 to 5 are added to the emulsion layer that contains a photosensitive silver halide and a non-photosensitive organic silver salt. However, it may also be added to a protective layer or an interlayer that is adjacent to an emulsion layer containing a photosensitive silver halide and a non-photosensitive organic silver salt, so that the compound may diffuse into the emulsion layer. The time when the compound is added to the layer is not specifically defined and may be any time before or after the addition of sensitizer dye thereto. Preferably, the amount of the compound to be added to the silver halide emulsion layer is from $1\times10^{-9}$ to $5\times10^{-1}$ mols, more preferably from $1\times10^{-8}$ to $5\times10^{-2}$ mols per mol of silver halide in the layer.

10) Adsorptive Redox Compound Having Adsorptive Group and Reducing Group:

Preferably, the photosensitive thermal developable recording material in this embodiment contains an adsorptive redox compound having a silver halide-adsorptive group and a reducing group in the molecule. Also preferably, the adsorptive redox compound is represented by the following general formula (I).

$$A-(W)n-B \quad (I)$$

wherein A represents a silver halide-adsorptive group (hereinafter this is referred to as "adsorptive group"); W represents a divalent linking group; n indicates 0 or 1; and B represents a reducing group.

In formula (I), the adsorptive group of A is a group that may be directly adsorbed by silver halide, or a group that promotes the adsorption of the compound to silver halide. Concretely, for example, it includes a mercapto group (or its salts), a thione group (—C(═S)—), a heterocyclic group that contains at lest one atom selected from nitrogen, sulfur, selenium and tellurium atoms, a sulfido group, a disulfide group, a cationic group, and an ethynyl group.

The mercapto group (or its salt) for the adsorptive group may be a mercapto group (or its salt) itself, but is more preferably a heterocyclic, aryl or alkyl group substituted with at least one mercapto group (or its salt). The heterocyclic group is an at least 5-membered to 7-membered, monocyclic or condensed cyclic, aromatic or non-aromatic heterocyclic group, including, for example, an imidazole ring residue, a thiazole ring residue, an oxazole ring residue, a benzimidazole ring residue, a benzothiazole ring residue, a benzoxazole ring residue, a triazole ring residue, a thiadiazole ring residue, an oxadiazole ring residue, a tetrazole ring residue, a purine ring residue, a pyridine ring residue, a quinoline ring residue, an isoquinoline ring residue, a pyrimidine ring residue, and a triazine ring residue. It may also be a quaternary nitrogen-containing heterocyclic group, in which the substituting mercapto group may be dissociated to give a meso ion. When the mercapto group forms a salt, its counter ion may be a cation of alkali metals, alkaline earth metals or heavy metals (e.g., $Li^+$, $Na^+$, $K^+$, $Mg^{2+}$, $Ag^+$, $Zn^{2+}$), an ammonium ion, a quaternary nitrogen-containing heterocyclic group, or a phosphonium ion.

The adsorptive mercapto group may also be in the form of its tautomer, thione group.

The adsorptive thione group includes a linear or cyclic thioamido group, a thioureido group, a thiourethane group, and a dithiocarbamate group.

The adsorptive heterocyclic group that contains at least one atom selected from nitrogen, sulfur, selenium and tellurium atoms is a nitrogen-containing heterocyclic group that has a group of —NH— capable of forming imino silver (>NAg) as the partial structure of the hetero ring thereof, or a heterocyclic group that has a group of "—S—", "—Se—", "—Te—" or "═N—" capable of coordinating with a silver ion via a coordination bond, as the partial structure of the hetero ring thereof. Examples of the former are a benzotriazole group, a triazole group, an indazole group, a pyrazole group, a tetrazole group, a benzimidazole group, an imidazole group, and a purine group; and examples of the latter are a thiophene group, a thiazole group, an oxazole group, a benzothiophene group, a benzothiazole group, a benzoxazole group, a thiadiazole group, an oxadiazole group, a triazine group, a selenazole group, a benzoselenazole group, a tellurazole group, and a benzotellurazole group. [0101]

The adsorptive sulfido or disulfide group is any and every group that has a partial structure of "—S—" or "—S—S—".

The adsorptive cationic group means a group that contains a quaternary nitrogen atom, and is concretely an ammonio group or a quaternary nitrogen-containing heterocyclic group. The quaternary nitrogen-containing heterocyclic group includes, for example, a pyridinio group, a quinolinio group, an isoquinolinio group, and an imidazolio group.

The adsorptive ethynyl group means a group of —C≡CH, in which the hydrogen atom may be substituted.

The above-mentioned adsorptive groups may have any desired substituent.

Examples of the adsorptive groups are described, for example, in JP-A 11-95355, pp. 4-7.

Preferred for the adsorptive group of A in formula (I) are a mercapto-substituted heterocyclic group (e.g., 2-mercaptothiadiazole group, 2-mercapto-5-aminothiadiazole group, 3-mercapto-1,2,4-triazole group, 5-mercaptotetrazole group, 2-mercapto-1,3,4-oxadiazole group, 2-mercaptobenzoxazole group, 1,5-dimethyl-1,2,4-triazolium-3-thiolate group, 2,4-dimercaptopyrimidine group, 2,4-dimercaptotriazine group, 3,5-dimercapto-1,2,4-triazole group, 2,5-dimercapto-1,3-thiazole group), and a nitrogen-containing heterocyclic group that has, as the partial structure of the hetero ring thereof, a group —NH— capable of forming imino silver (>NAg) (e.g., benzotriazole group, benzimidazole group, imidazole group). More preferred adsorptive groups are 2-mercaptobenzimidazole group and 3,5-dimercapto-1,2,4-triazole group.

In formula (I), W represents a divalent linking group. The linking group maybe any one not having any negative influence of the photographic properties of the photosensitive thermal developable recording material. For example, it may be a divalent linking group that comprise carbon, hydrogen, oxygen, nitrogen and/or sulfur atoms. Concretely, it includes an alkylene group having from 1 to 20carbon atoms (e.g., methylene, ethylene, trimethylene, tetramethylene, hexamethylene), an alkenylene group having from 2 to 20 carbon atoms, an alkynylene group having from 2 to 20 carbon atoms, an arylene group having from 6 to 20 carbon atoms (e.g., phenylene, naphthylene), —CO—, —$SO_2$—, —O—, —S—, —$NR_1$—, and combinations of these linking groups. $R_1$ represents a hydrogen atom, an alkyl group, a heterocyclic group or an aryl group.

The linking group of W may have any desired substituent.

In formula (I), the reducing group of B is a group that has the ability to reduce silver ions. For example, it includes a formyl group, an amino group, a triple bond group such as acetylene or propargyl group, a mercapto group, as well as residues that are derived from compounds selected from hydroxylamines, hydroxamic acids, hydroxyureas, hydroxyurethanes, hydroxysemicarbazides, reductones (including reductone derivatives), anilines, phenols (including chroman-6-ols, 2,3-dihydrobenzofuran-5-ols, aminophenols, sulfonamidophenols, and polyphenols such as hydroquinones, catechols, resorcinols, benzenetriols, bisphenols), acylhydrazines, carbamoylhydrazides and 3-pyrazolidones by removing one hydrogen atom from them. Needless-to-say, these may have any desired substituent.

In formula (I), the oxidation potential of the reducing group of B may be measured according to the process described in Akira Fujishima, *Electrochemical Determination,* pp. 150-208 (by Gihodo Publishing) or in *Lecture of Experimental Chemistry,* 4th Ed., Vol. 9, pp. 182-344 by the Chemical Society of Japan (by Maruzen). For example, it may be measured through rotary disc voltammetry. Concretely, the sample is dissolved in a solution of methanol/(pH 6.5Britton-Robinson buffer)=10%/90% (by volume), and bubbled with nitrogen gas for 10 minutes. A rotary disc electrode (RDE) of glassy carbon is used as the working electrode; a platinum wire is as the counter electrode; and a saturated calomel electrode is as a reference electrode. At 25° C., at a revolution of 1000 rpm and at a sweeping rate of 20 mV/sec, the sample solution is analyzed. From the voltamograph thus obtained, the half-wave potential (E1/2) of the sample is obtained.

When measured according to the method mentioned above, the oxidation potential of the reducing group B in this embodiment is preferably from about −0 3 V to about 1.0 V, more preferably from about −0.1 V to about 0.8 V, even more preferably from about 0 to about 0.7 V.

Preferably, the reducing group of B in formula (I) is a residue derived from hydroxylamines, hydroxamic acids, hydroxyureas, hydroxysemicarbazides, reductones, phenols, acylhydrazines, carbamoylhydrazines or 3-pyrazolidones by removing one hydrogen atom from them.

Specific examples of the reducing group of B are mentioned below, to which, however, this embodiment should not be limited. In the following, * indicates the position at which the group bonds to A or W in formula (I).

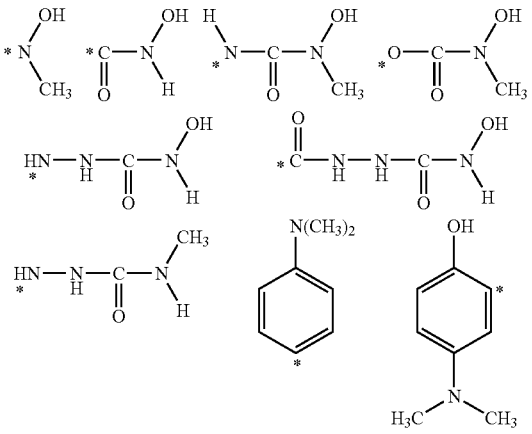

-continued

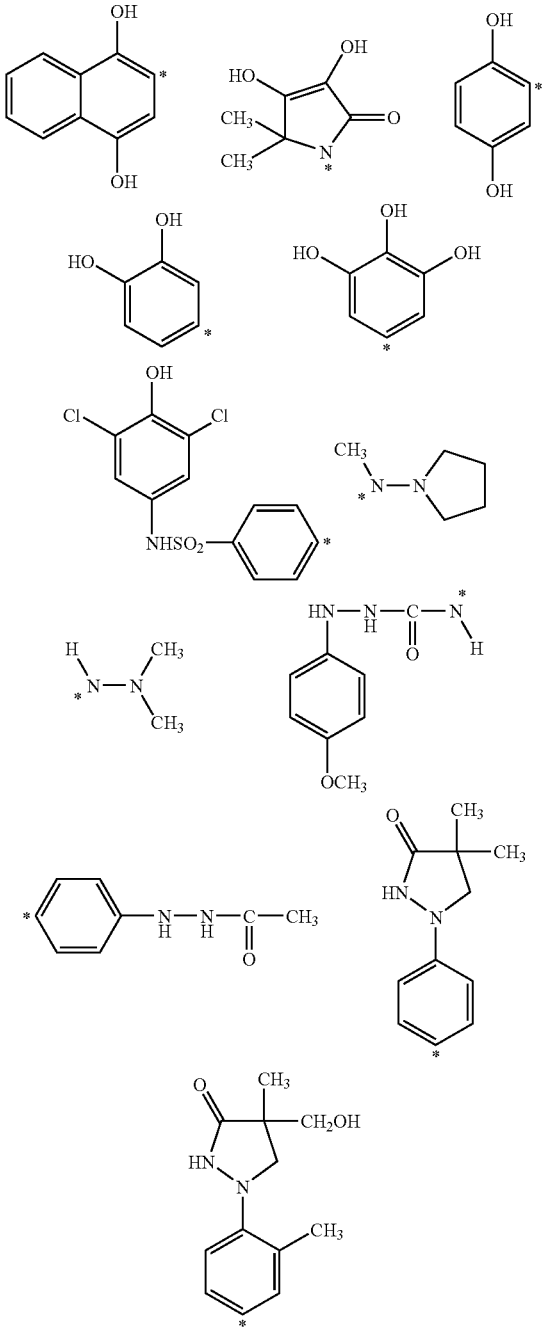

The compounds of formula (I) for use in this embodiment may have a ballast group or a polymer chain that is generally seen in passive photographic additives such as couplers. For the polymer, for example, referred to are those mentioned in JP-A 1-100530.

The compounds of formula (I) may be in any form of bis compounds or tris compounds. Preferably, the compounds of formula (I) have a molecular weight of from 100 to 10000, more preferably from 120 to 1000, even more preferably from 150 to 500.

The adsorptive redox compounds having a silver halide-adsorptive group and a reducing group in the molecule for use in this embodiment are the same as those described in detail in Japanese Patent Application Nos. 2002-328531, 2002-379884. Specific examples of the adsorptive redox compounds having a silver halide-adsorptive group and a reducing group in the molecule, described in the patent references may also apply to this embodiment for the specific examples of the adsorptive redox compounds for use in this embodiment.

The compounds for use in this embodiment may be readily produced in any known manner.

One or more different types of the compounds of formula (I) may be used in this embodiment either singly or as combined. When two or more compounds are used together, then they may be added to one and the same layer or may be separately added to different layers. They may be added in the same manner or in different methods.

Preferably, the compound of formula (I) is added to silver halide emulsion layers, more preferably to them while the emulsions are prepared. In case where the compound is added to the emulsion being prepared, it may be added thereto in any stage of emulsion production. For example, the compound may be added to silver halide grains being formed, or may be added thereto before the start of desalting them, during desalting them, before the start of chemically ripening them, during chemically ripening them, or before the finished emulsion is formulated. If desired, the compound may be divided into some portions and they may be separately added to the emulsion in these steps. Preferably, the compound is added to emulsion layers, but it may also be added to a protective layer or an interlayer that is adjacent to emulsion layers so that it may diffuse into the adjacent emulsion layers.

The preferred amount of the compound to be added varies significantly depending on the method of the addition and on the type of the compound to be added, but in general, it may be from $1\times10^{-6}$ to 1 mol, preferably from $1\times10^{-5}$ to $5\times10^{-1}$ mols, even more preferably from $1\times10^{-4}$ to $1\times10^{-1}$ mols, per mol of the photosensitive silver halide in the emulsion.

The compound of formula (I) to be added may be dissolved in water or in a water-soluble solvent such as methanol or ethanol, or in a mixed solvent of these. In this stage, the pH of the solution may be suitably controlled by acid or base, or surfactant may be added to the solution. If desired, the compound to be added may be dispersed in a high-boiling-point organic solvent to form an emulsified dispersion thereof. Also if desired, a solid dispersion of the compound may be added.

11) Sensitizing Dye:

Sensitizing dyes usable in this embodiment are those which, after adsorbed by silver halide grains, can spectrally sensitize the grains within a desired wavelength range. Depending on the spectral characteristics of the light source to be used for exposure, favorable sensitizing dyes having good spectral sensitivity are selected for use in the photosensitive thermal developable recording material of the invention. Preferably, the photosensitive thermal developable recording material of this embodiment is spectrally sensitized so that it has a spectral sensitivity peak within a range of from 600 nm to 900 nm or within a range of from 300 nm to 500 nm. For the details of sensitizing dyes usable herein and methods for adding them to the photosensitive thermal developable recording material of the invention, referred to are paragraphs [0103] to [0109] in JP-A 11-6501; compounds of formula (II) in JP-A 10-186572; dyes of formula (I) and paragraph [0106] in JP-A 11-119374; dyes described in U.S. Pat. Nos. 5,510,236, 3,871,887 (Example 5); dyes described in JP-A 2-96131 and 59-48753; from page 19, line 38 to page 20, line 35 of EP-A No. 0803764A1; Japanese Patent Application Nos. 2000-86865, 2000-102560, 2000-205399. One or more such sensitizing dyes may be used herein either singly or as combined.

The amount of the sensitizing dye to be in the photosensitive thermal developable recording material of this embodiment varies, depending on the sensitivity and the fogging resistance of the material. In general, it preferably falls between $10^{-6}$ and 1 mol, more preferably between $10^{-4}$ and $10^{-1}$ mols, per mol of the silver halide in the photosensitive layer of the material.

For its better spectral sensitization, the photosensitive thermal developable recording material of this embodiment may contain a supersensitizer. For the supersensitizer, for example, usable are the compounds described in EP-A No. 587,338, U.S. Pat. Nos. 3,877,943 and 4,873,184, and JP-A 5-341432, 11-109547 and 10-111543.

12) Combined Use of Silver Halides:

The photosensitive thermal developable recording material of this embodiment may contain only one type or two or more different types of photosensitive silver halide grains (these will differ in their mean grain size, halogen composition or crystal habit, or in the condition for their chemical sensitization), either singly or as combined. Combining two or more types of photosensitive silver halide grains differing in their sensitivity will enable to control the gradation of the images to be formed in the photosensitive thermal developable recording material. For the technique relating to it, referred to are JP-A 57-119341, 53-106125, 47-3929, 48-55730, 46-5187, 50-73627 and 57-150841. The sensitivity difference between the combined silver halide grains is preferably such that the respective emulsions differ from each other at least by 0.2 logE.

13) Mixing of Silver Halide and Oganic Silver Salt:

In this embodiment, it is desirable that the photosensitive silver halide grains are formed and chemically sensitized in the absence of a non-photosensitive organic silver salt. This is because a method of adding a halogenating agent to an organic silver salt to form a silver halide could not attain sufficient sensitivity.

The silver halide may be mixed with an organic silver salt, as follows: The photosensitive silver halide and an organic silver salt that have been prepared separately are mixed in a high-performance stirrer, a ball mill, a sand mill, a colloid mill, a shaking mill, a homogenizer or the like; or the photosensitive silver halide grains having been prepared are added to an organic silver salt being prepared, in any desired timing to produce the organic silver salt mixed with the silver halide grains. Any of these methods are preferred in this embodiment.

14) Mixing of Silver Halide in Coating Liquid:

The preferred time at which the silver halide grains are added to the coating liquid which is to form the image-forming layer of the photosensitive thermal developable recording material of this embodiment may fall between 180 minutes before coating the liquid and a time just before the coating, preferably between 60 minutes before the coating and 10 seconds before it. However, there is no specific limitation thereon, so far as the method and the condition employed for adding the grains to the coating liquid ensure the advantages of the invention. Concretely for mixing them, employable is a method of adding the grains to the coating liquid in a tank in such a controlled manner that the mean residence time for the grains in the tank, as calculated from the amount of the grains added and the flow rate of the coating liquid to a coater, could be a predetermined period of time; or a method of mixing them with a static mixer, for example, as in N. Harunby, M. F. Edwards & A. W. Nienow's *Liquid Mixing Technology*, Chap. 8 (translated by Koji Takahasi, published by Nikkan Kogyo Shinbun, 1989).

(Description of Organic Silver Salt)

The non-photosensitive organic silver salt for use in this embodiment is relatively stable to light, but, when heated at 80° C. or higher in the presence of an exposed photosensitive silver halide and a reducing agent, it forms a silver image. The organic silver salt may be any and every organic substance that contains a source of reducing a silver ion. Some non-photosensitive organic silver salts of that type are described, for example, in JP-A 10-62899, paragraphs [0048] to [0049]; EP-A No. 0803763A1, from page 18 line 24 to page 19, line 37; EP-A No. 0962812A1; JP-A 11-349591, 2000-7683 and 2000-72711. Preferred for use herein are silver salts of organic acids, especially silver salts of long-chain (C10 to C30, preferably C15 to C28) aliphatic carboxylic acids. Preferred examples of silver salts of fatty acids are silver behenate, silver arachidate, silver stearate, silver oleate, silver laurate, silver caproate, silver myristate, silver palmitate, and their mixtures. Of the silver salts of fatty acids, especially preferred in this embodiment are those having a silver behenate content of from 50 mol % to 100 mol %. More preferred are those having a silver behenate content of from 75 mol % to 98 mol %.

The organic silver salt for use in the invention is not specifically defined for its morphology, and may be in any form of acicular, rod-like, tabular or scaly grains.

Scaly organic silver salts are preferred for use in this embodiment. The flaky organic silver salt is defined as follows: A sample of an organic silver salt to be analyzed is observed with an electronic microscope, and the grains of the salt seen in the field are approximated to rectangular parallelopipedons. The three different edges of the thus-approximated, one rectangular parallelopipedone are represented by a, b and c. a is the shortest, c is the longest, and c and b may be the same. From the shorter edges a and b, x is obtained according to the following equation:

$$x=b/a.$$

About 200 grains seen in the field are analyzed to obtain the value x, and the data of x are averaged. Samples that satisfy the requirement of x (average)≧1.5 Sare scaly. For scaly grains, preferably, 30≧x (average)≧1.5, more preferably 15≧x (average)≧1.5. In this connection, the value x of acicular grains falls within a range of 1≦x (average)<1.5.

In the scaly grains, it is understood that a corresponds to the thickness of tabular grains of which the main plane is represented by b×c. In the scaly organic silver salt grains for use herein, a (average) preferably falls between 0.01 μm and 0.3 μm, more preferably between 0.1 μm and 0.23 μm; and c/b (average) preferably falls between 1 and 6, more preferably between 1 and 4, even more preferably between 1 and 3, most preferably between 1 and 2.

Regarding its grain size distribution, the organic silver salt is preferably a mono-dispersed one. Mono-dispersion of grains referred to herein is such that the value (in terms of percentage) obtained by dividing the standard deviation of the minor axis and the major axis of each grain by the minor axis and the major axis thereof, respectively, is preferably at most 100%, more preferably at most 80%, even more preferably at most 50%. To determine its morphology, a dispersion of the organic silver salt may be analyzed on its image taken by the use of a transmission electronic microscope. Another method for analyzing the organic silver salt for mono-dispersion morphology comprises determining the standard deviation of the volume weighted mean diameter of the salt grains. In the method, the value in terms of percentage (coefficient of variation) obtained by dividing the standard deviation by the volume weighted mean diameter of the salt grains is preferably at most 100%, more preferably at most 80%, even more preferably at most 50%. Concretely, for example, a sample of the organic silver salt is dispersed in a liquid, the resulting dispersion is exposed to a laser ray, and the self-correlation coefficient of the salt grains relative to the time-dependent change of the degree of fluctuation of the scattered ray is obtained. Based on this, the grain size (volume weighted mean diameter) of the salt grains is obtained.

For preparing and dispersing the organic silver salts for use in this embodiment, employable is any known method. For it, for example, referred to are JP-A 10-62899; EP-A Nos. 0803763A1 and 0962812A1; JP-A11-349591, 2000-7683, 2000-72711, 2001-163827, 2001-163889, 2001-163890, 11-203413; and Japanese Patent Application Nos. 2001-188313, 2001-83652, 2002-6442, 2002-31870, 2001-107868.

An aqueous, organic silver salt dispersion may be mixed with an aqueous, photosensitive silver salt dispersion to prepare a coating liquid for the photosensitive thermal developable recording material of this embodiment. Mixing two or more different types of aqueous, organic silver salt dispersions with two or more different types of aqueous, photosensitive silver salt dispersions is preferred for controlling the photographic properties of the resulting mixture.

The amount of the organic silver salt to be in the photosensitive thermal developable recording material of this embodiment is not specifically defined, and may be any desired one. Preferably, the silver amount falls between 0.1 and 5 g/m$^2$, more preferably between 1 and 3.0 g/m$^2$, even more preferably between 1.2 and 2.5 g/m$^2$.

(Nucleating Agent)

The photosensitive thermal developable recording material of the invention preferably contains a nucleating agent.

The nucleating agent is a compound capable of producing a compound that reacts with a developed product as a result of initial development to induce additional development. Heretofore, it has been known to use such a nucleating agent in ultra-hard photographic materials suitable to printing plates. Ultra-hard photographic materials have a mean gradation of at least 10, and are therefore unsuitable to ordinary photographic materials for taking pictures, and also to medical applications that require especially high diagnosis performance. In addition, since the images formed on ultra-hard photographic materials are rough in the graininess and do not have good sharpness, they are quite unsuitable to medical diagnosis applications. The nucleating agent for use in the invention absolutely differs from that in ordinary ultra-hardphotographic materials in point of its effect. The nucleating agent for use in the invention is not one for hardening the image gradation. The nucleating agent for use in the invention is a compound capable of inducing sufficient development even when the number of the photosensitive silver halide grains is greatly reduced relative to the non-photosensitive organic silver salt in the photosensitive thermal developable recording material. Though not clear, the mechanism of the of the nucleating agent may be as follows: When the nucleating agent is used in thermal development of the photosensitive thermal developable recording material in the invention, then it has been clarified that the number of the developed silver grains is larger than the number of the photosensitive silver halide grains in the maximum density area, and it is presumed that the nucleating agent in the invention may have the ability to form development spots (development nuclei) in the area not having silver halide grains therein.

The nucleating agent for use in the invention may be the same as the compounds described in detail in Japanese Patent Application No. 2004-136053. Specific examples of the compounds described in the patent reference may also be referred to as the specific examples of the nucleating agent for use in this embodiment.

Preferred compounds for the nucleating agent are mentioned below, to which, however, the invention should not be limited.

SH-1

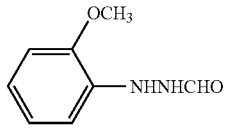

SH-2

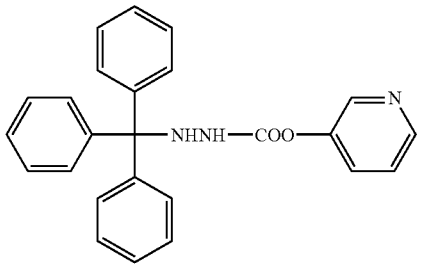

SH-3

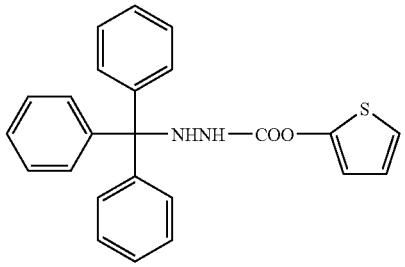

SH-4

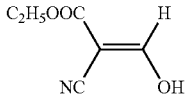

SHO-5

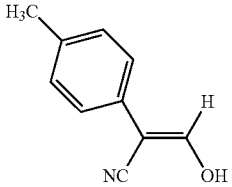

SH-6

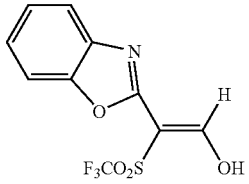

-continued

SH-7

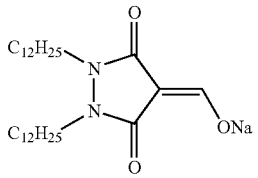

SH-8

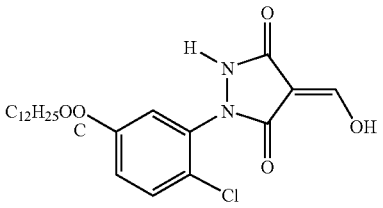

SH-9

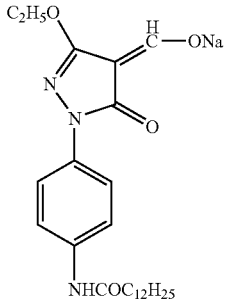

SH-10

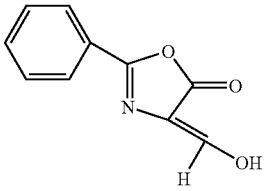

SH-11

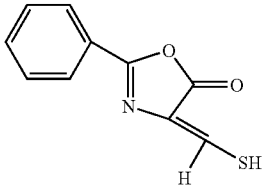

SH-12

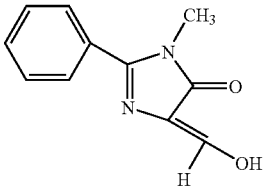

The nucleating agent may be in any form of solution, emulsified dispersion or fine solid particle dispersion, and may be added to the coating liquid in any known method so as to be incorporated into the photosensitive thermal developable recording material of the invention.

One well known method of emulsifying the nucleating agent to prepare its dispersion comprises dissolving the nucleating agent in an oil such dibutyl phthalate, tricresyl phosphate, dioctyl sebacate or tri (2-ethylhexyl) phosphate in the presence of a auxiliary solvent such as ethyl acetate or cyclohexanone, then adding thereto a surfactant such as sodium dodecylbenzenesulfonate, sodium oleoyl-N-methyltaurate or sodium di(2-ethylhexyl)sulfosuccinate, and mechanically emulsifying it to give a dispersion. In this stage, an α-methylstyrene oligomer or a polymer such as poly(t-butylacrylamide) may be preferably added to the system for controlling the viscosity and the refractivity of the oil drops in the resulting dispersion.

For preparing a fine solid particle dispersion of the nucleating agent, for example, employable is a method that comprises dispersing a powder of the nucleating agent in water or in any other suitable solvent by the use of a ball mill, a colloid mill, a shaking ball mill, a sand mill, a jet mill or a roller mill, or ultrasonically dispersing it therein to thereby prepare the intended solid dispersion of the nucleating agent. In this method, optionally used is a protective colloid (e.g., polyvinyl alcohol), and a surfactant (e.g., anionic surfactant such as sodium triisopropylnaphthalenesulfonate—this is a mixture of the salts in which the three isopropyl groups are all in different positions). In these mills, generally used are beads of zirconia or the like that serve as a dispersion medium. Zr or the like may dissolve out of the beads and will often contaminate the dispersion formed. Though varying depending on the dispersion condition, the contaminant content of the dispersion formed may generally fall between 1 ppm and 1000 ppm. So far as the Zr content of the photosensitive thermal developable recording material finally fabricated herein is not larger than 0.5 mg per gram of silver in the material, the contaminant will cause no practical problem.

Preferably, the aqueous dispersion contains a preservative (e.g., sodium benzoisothiazolinone).

Especially preferred in the invention is preparing a solid particle dispersion of the nucleating agent, in which the mean particle size of the nucleating agent particles is preferably from 0.01 μm to 10 μm, more preferably from 0.05 μm to 5 μm, even more preferably from 0.1 μm to 2 μm. In the invention, it is desirable that the particle sizes of the other solid dispersions also fall within the range.

In the invention, the nucleating agent may be added to the image-forming layer or to the layer adjacent to the image-forming layer of the photosensitive thermal developable recording material. Preferably, however, it is added to the image-forming layer. The amount of the nucleating agent to be added may fall between $10^{-5}$ and 1 mol, preferably between $10^{-4}$ and $5\times10^{-1}$ mols, per mol of the organic silver salt in the layer. One or more different types of the nucleating agent may be used herein either singly or as combined.

The photosensitive thermal developable recording material of the invention may have two or more, photosensitive silver halide-containing, image-forming layers. When it has two or more such layers, then the nucleating agent may be added to any of these layers. Preferably, the photosensitive thermal developable recording material of the invention has at least two image-forming layers, in which one layer contains the nucleating agent and the other does not.

(Reducing Agent)

1) Infection-Developable Reducing Agent:

The photosensitive thermal developable recording material of the invention preferably contains an infection-developable reducing agent. The infection-developable reducing agent may be any one having the function of infection development.

Preferred examples of the infection-developable reducing agent for use in the invention are compounds of the following formula (R1):

(R1)

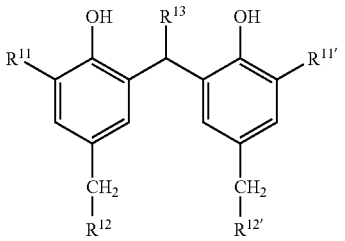

In formula (R1), $R^{11}$ and $R^{11'}$ each independently represent a secondary or tertiary alkyl group having from 3 to 20 carbon atoms; $R^{12}$ and $R^{12'}$ each independently represent a hydrogen atom, or a group bonding to the compound via a nitrogen, oxygen, phosphorus or sulfur atom; $R^{13}$ represents a hydrogen atom or an alkyl group having from 1 to 20 carbon atoms.

The infection-developable reducing agent for use in the invention may be the same as the compounds described in detail in Japanese Patent Application No. 2004-136052. Specific examples of the compounds disclosed in the patent reference may also be referred to herein for the specific examples of the nucleating agent for use in this embodiment.

Specific examples of the reducing agent of formula (R1) are mentioned below, to which, however, the invention should not be limited.

R1-9

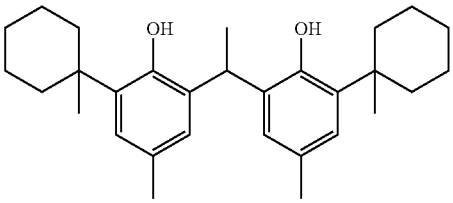

R1-10

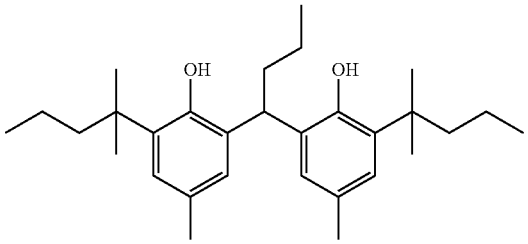

R1-11

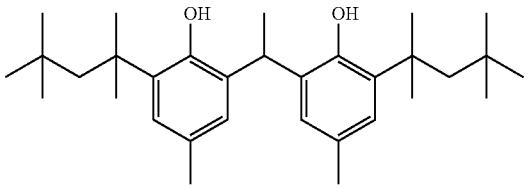

-continued

R1-12

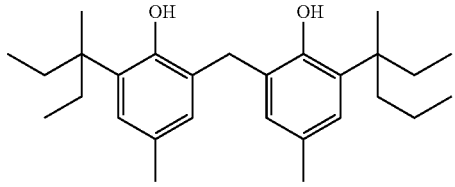

R1-13

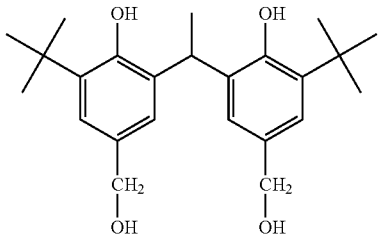

R1-14

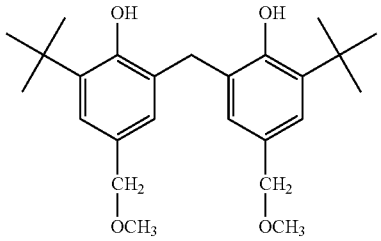

R1-15

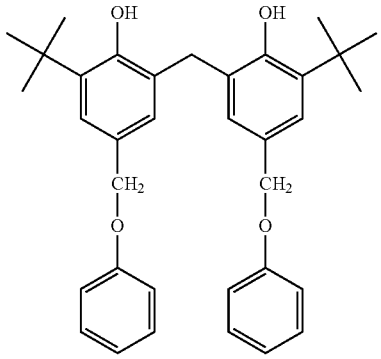

R1-16

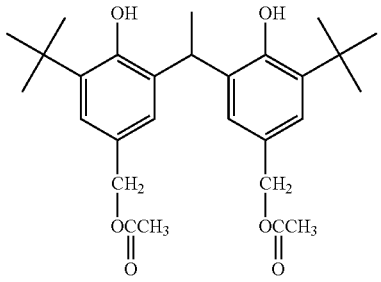

-continued
R1-17
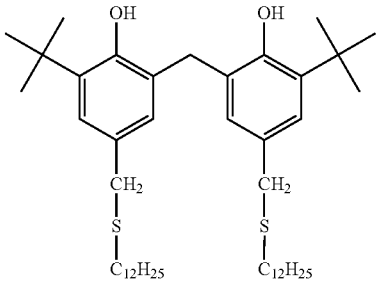
R1-18
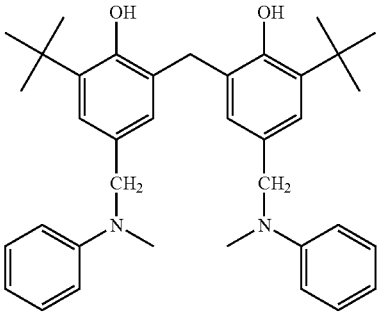
R1-19
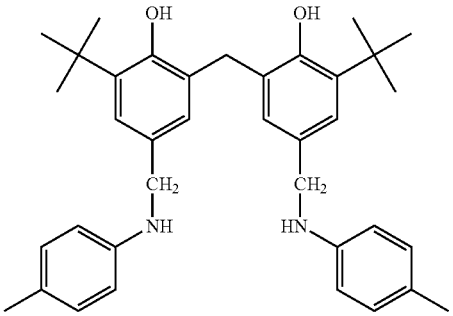
R1-20
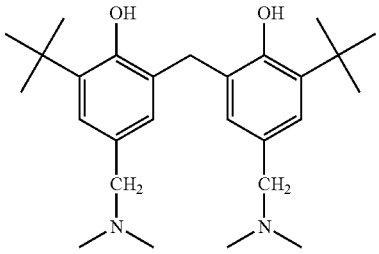
R1-21
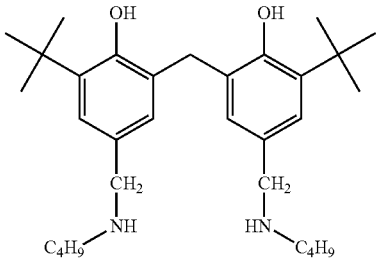
-continued
R1-22
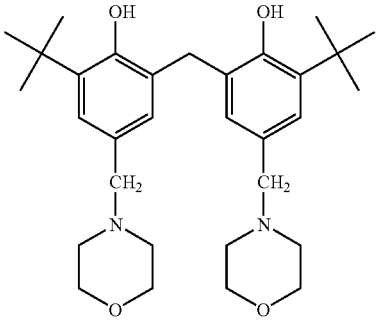
R1-23
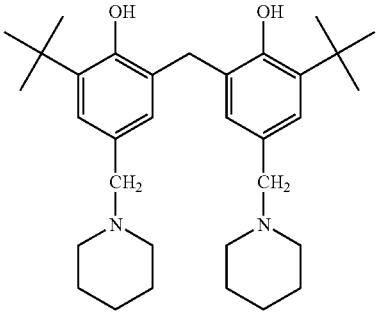
R1-24
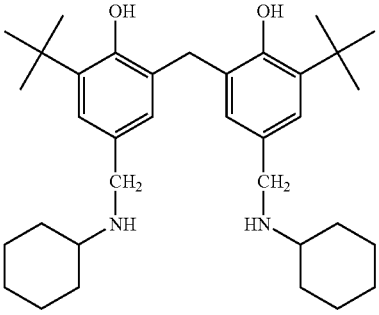
R1-25
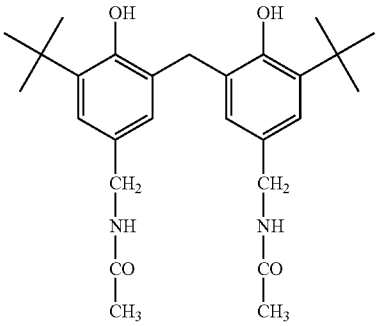
R1-26
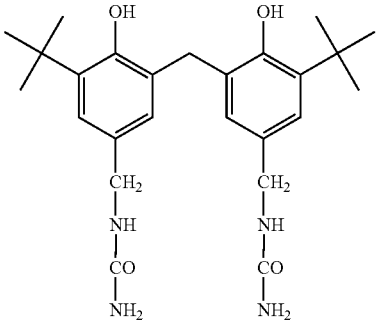

-continued
R1-27
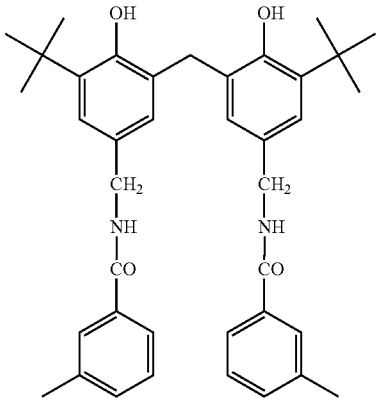
R1-28
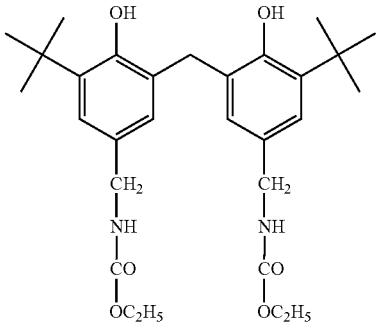
R1-29
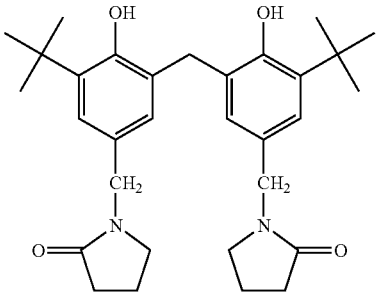
R1-30
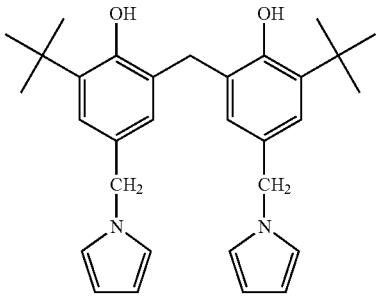
-continued
R1-31
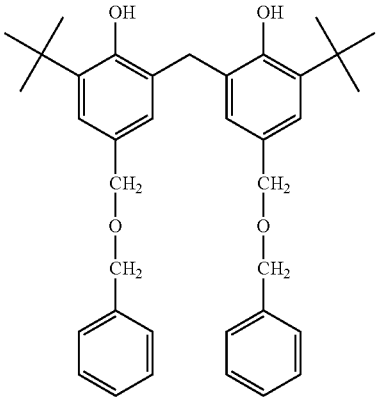
R1-32
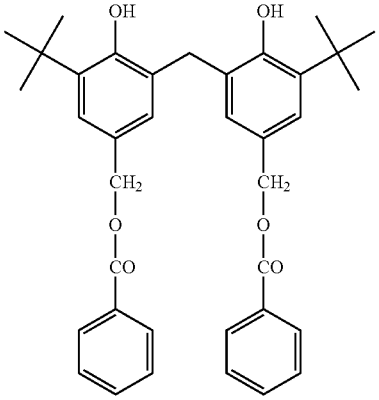
R1-33
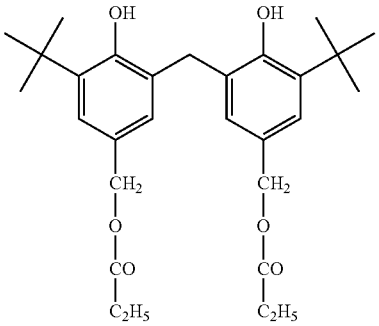
R1-34
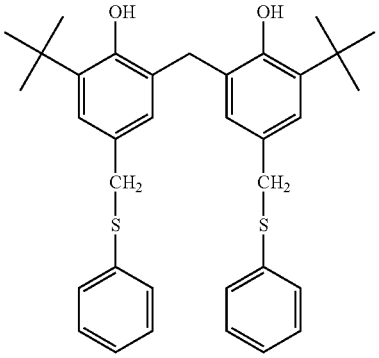

-continued

R1-35

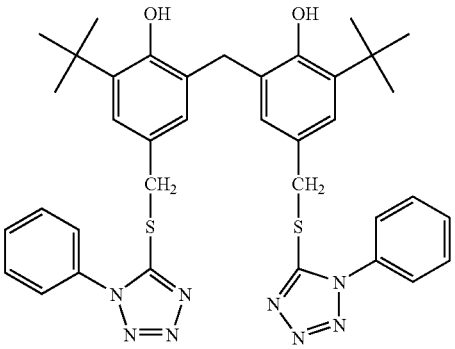

R1-36

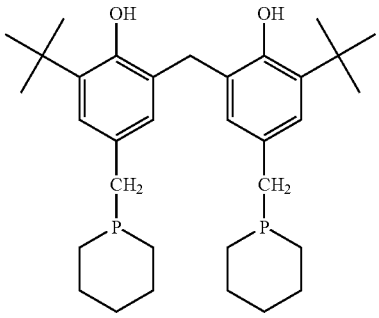

The amount of the reducing agent to be added falls preferably between 0.01 g/m$^2$ and 5.0 g/m$^2$, more preferably between 0.1 g/m$^2$ and 3.0 g/m$^2$. Also preferably, the reducing agent is on the face having an image-forming layer of the photosensitive thermal developable recording material, in an amount of from 5 mol % to 50 mol %, more preferably from 10 mol % to 40 mol % per mol of silver thereon.

Preferably, the reducing agent of formula (R1) is in the image-forming layer. In particular, it is more desirable that the reducing agent of formula (R1) is in the image-forming layer that contains a low-sensitivity silver halide emulsion.

2) Reducing Agent:

In the invention, any other reducing agent may be used along with the reducing agent of formula (R1). The additional reducing agent may be any substance capable of reducing silver ion into metal silver (but is preferably an organic substance). Some examples of the reducing agent are described in JP-A 11-65021, paragraphs [0043] to [0045] and in EP-A No. 0803764A1, from page 7, line 34 to page 18, line 12.

Preferred for the reducing agent for use in this embodiment are hindered phenol-type reducing agents having an ortho-substituent relative to the phenolic hydroxyl group therein, or bisphenol-type reducing agents; and more preferred are compounds of the following formula (R):

(R)

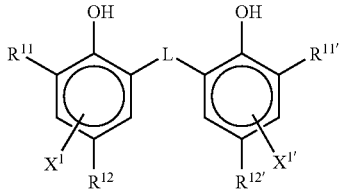

In formula (R), $R^{11}$ and $R^{11'}$ each independently represent an alkyl group having from 1 to 20 carbon atoms; $R^{12}$ and $R^{12'}$ each independently represent a hydrogen atom, or a substituent substitutable to the benzene ring; L represents a group of —S— or —$CHR^{13}$—; $R^{13}$ represents a hydrogen atom or an alkyl group having from 1 to 20 carbon atoms; $X^1$ and $X^{1'}$ each independently represent a hydrogen atom, or a substituent substitutable to the benzene ring.

The substituents are described in detail.

1) $R^{11}$ and $R^{11'}$:

$R^{11}$ and $R^{11'}$ each independently represent a substituted or unsubstituted alkyl group having from 1 to 20 carbon atoms. The substituent for the alkyl group is not specifically defined, but preferably includes an aryl group, a hydroxyl group, an alkoxy group, an aryloxy group, an alkylthio group, an arylthio group, an acylamino group, a sulfonamido group, a sulfonyl group, a phosphoryl group, an acyl group, a carbamoyl group, an ester group, and a halogen atom.

2) $R^{12}$ and $R^{12'}$, $X^1$ and $X^{1'}$:

$R^{12}$ and $R^{12'}$ each independently represent a hydrogen atom, or a substituent substitutable to the benzene ring.

$X^1$ and $X^{1'}$ each independently represent a hydrogen atom, or a substituent substitutable to the benzene ring. Preferred examples of the substituent substitutable to the benzene ring are an alkyl group, an aryl group, a halogen atom, an alkoxy group, and an acylamino group.

3) L:

L represents a group of —S— or —$CHR^{13}$—. $R^{13}$ represents a hydrogen atom or an alkyl group having from 1 to 20 carbon atoms. The alkyl group may be substituted.

Examples of the unsubstituted alkyl group for $R^{13}$ are methyl, ethyl, propyl, butyl, heptyl, undecyl, isopropyl, 1-ethylpentyl and 2,4,4-trimethylpentyl groups.

Examples of the substituent for the alkyl group may be the same as those for $R^{11}$, including, for example, a halogen atom, an alkoxy group, an alkylthio group, an aryloxy group, an arylthio group, an acylamino group, a sulfonamido group, a sulfonyl group, a phosphoryl group, an oxycarbonyl group, a carbamoyl group, and a sulfamoyl group.

4) Preferred Substituents:

For $R^{11}$ and $R^{11'}$, preferred is a secondary or tertiary alkyl group having from 3 to 15 carbon atoms, including, for example, isopropyl, isobutyl, t-butyl, t-amyl, t-octyl, cyclohexyl, cyclopentyl, 1-methylcyclohexyl and 1-methylcyclopropyl groups. For $R^{11}$ and $R^{11'}$, more preferred is a tertiary alkyl group having from 4 to 12 carbon atoms; even more preferred are t-butyl, t-amyl and 1-methylcyclohexyl groups; and most preferred is a t-butyl group.

For $R^{12}$ and $R^{12'}$, preferred is an alkyl group having from 1 to 20 carbon atoms, including, for example, methyl, ethyl, propyl, butyl, isopropyl, t-butyl, t-amyl, cyclohexyl, 1-methylcyclohexyl, benzyl, methoxymethyl and methoxymethyl groups. More preferred are methyl, ethyl, propyl, isopropyl and t-butyl groups.

For $X^1$ and $X^{1'}$, preferred are a hydrogen atom, a halogen atom and an alkyl group; and more preferred is a hydrogen atom.

L is preferably —$CHR^{13}$—.

$R^{13}$ is preferably a hydrogen atom or an alkyl group having from 1 to 15 carbon atoms. For the alkyl group, preferred are methyl, ethyl, propyl, isopropyl and 2,4,4-trimethylpentyl groups. More preferably, $R^{13}$ is a hydrogen atom, a methyl group, a propyl group or an isopropyl group.

In case where $R^{13}$ is a hydrogen atom, then $R^{12}$ and $R^{12'}$ each are preferably an alkyl group having from 2 to 5 carbon atoms, more preferably an ethyl or propyl group, most preferably an ethyl group.

In case where $R^{13}$ is a primary or secondary alkyl group having from 1 to 8 carbon atoms, then $R^{12}$ and $R^{12'}$ are preferably both methyl groups. For the primary or secondary alkyl group having from 1 to 8 carbon atoms for $R^{13}$, preferred are methyl, ethyl, propyl and isopropyl groups; and more preferred are methyl, ethyl and propyl groups.

In case where $R^{11}$, $R^{11'}$, $R^{12}$ and $R^{12'}$ are all methyl groups, then $R^{13}$ is preferably a secondary alkyl group. The secondary alkyl group for $R^{13}$ is preferably any of isopropyl, isobutyl or 1-ethylpentyl group, and more preferably an isopropyl group.

Depending on the combination of the groups $R^{11}$, $R^{11'}$, $R^{12}$, $R^{12'}$ and $R^{13}$ therein, the reducing agents exhibit different heat-developability. Combining two or more different types of the reducing agents in different blend ratios makes it possible to control the heat-developability of the resulting mixtures. Therefore, combining two or more different types of the reducing agents in the photosensitive thermal developable recording material is preferred, depending on the object of the material.

Specific examples of the compounds of formula (R) for use in this embodiment are mentioned below, to which, however, this embodiment should not be limited.

(R-1)

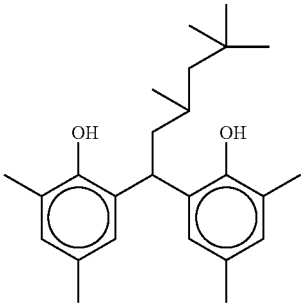

(R-2)

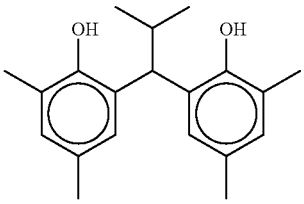

(R-3)

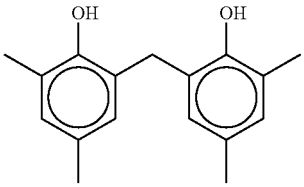

-continued (R-4)

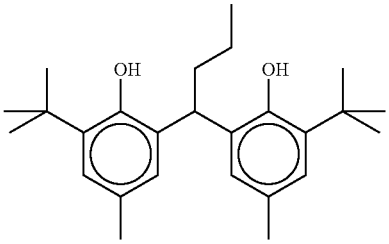

(R-5)

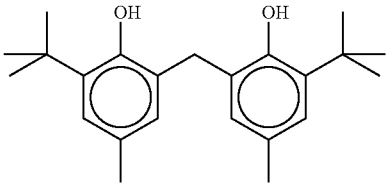

(R-6)

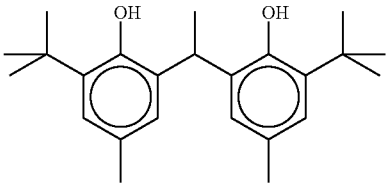

(R-7)

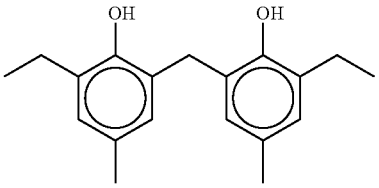

(R-8)

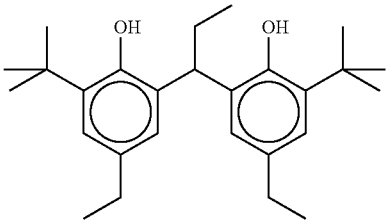

(R-9)

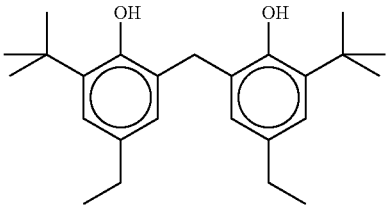

(R-10)

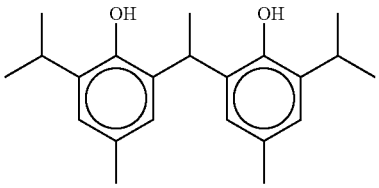

-continued
(R-11)
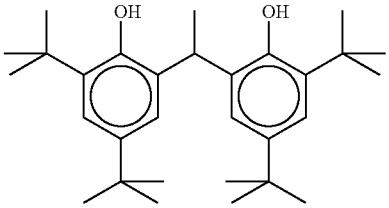
(R-12)
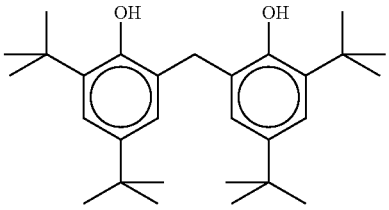
(R-13)
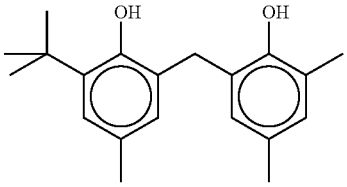
(R-14)
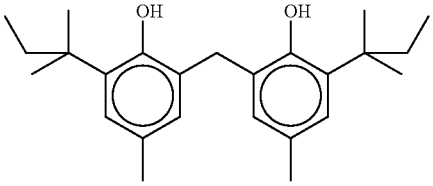
(R-15)
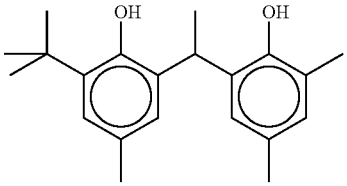
(R-16)
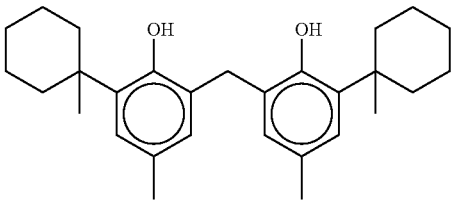
(R-17)
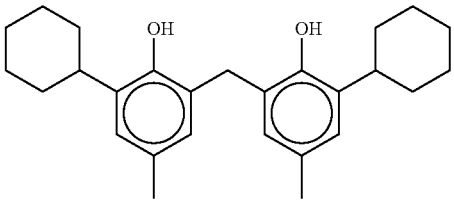
-continued
(R-18)
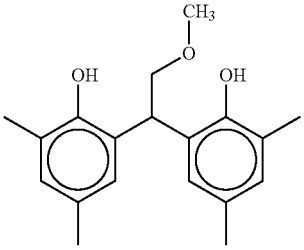
(R-19)
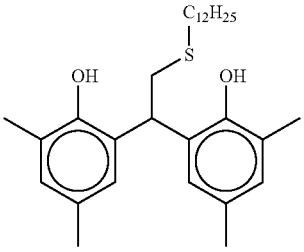
(R-20)
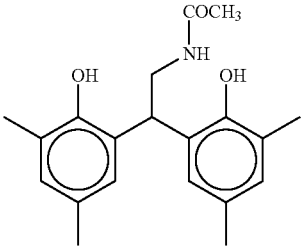
(R-21)
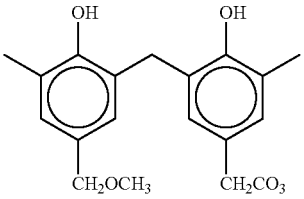
(R-22)
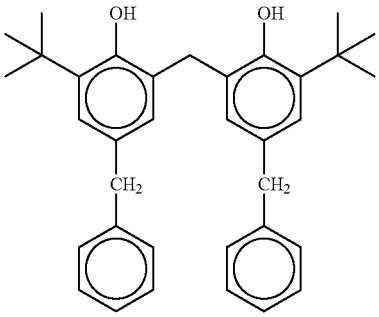
(R-23)
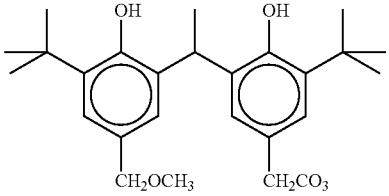

-continued (R-24)

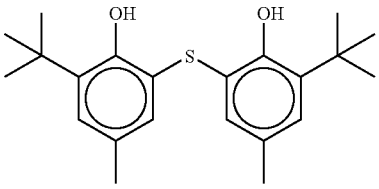

(R-25)

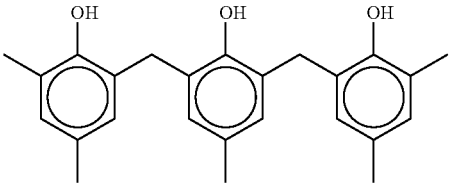

(R-26)

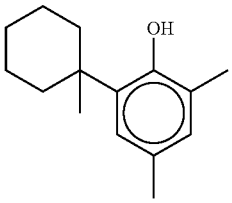

(R-27)

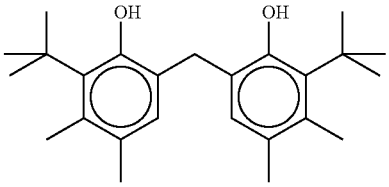

(R-28)

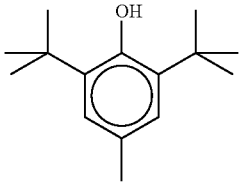

(R-29)

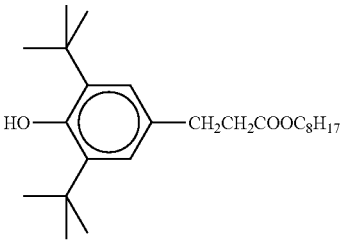

(R-30)

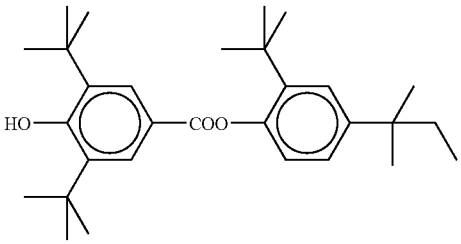

-continued (R-31)

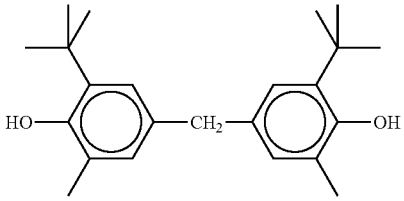

(R-32)

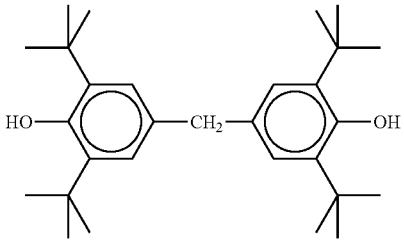

(R-33)

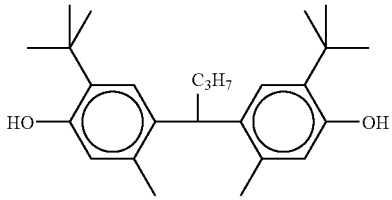

(R-34)

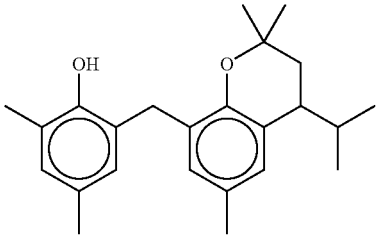

In particular, compounds (R-1) to (R-20) are preferred for use herein.

The amount of the reducing agent to be added in this embodiment preferably falls between 0.01 and 5.0 g/m$^2$, more preferably between 0.1 and3.0 g/m$^2$. Also preferably, the amount of the reducing agent to be therein falls between 5 and 50 mol %, more preferably between 10 and 40 mol %, per mol of silver existing in the face having the image-forming layer thereon of the material.

In this embodiment, the reducing agent may be added to the image-forming layer that contains an organic silver salt and a photosensitive silver halide and to the layer adjacent thereto, but is preferably added to the image-forming layer.

The reducing agent may be in any form of solution, emulsified dispersion or fine solid particle dispersion, and may be added to the coating liquid in any known method so as to be incorporated into the photosensitive thermal developable recording material of the invention.

One well known method of emulsifying the reducing agent to prepare its dispersion comprises dissolving the reducing agent in an oil such as dibutyl phthalate, tricresyl phosphate, glyceryl triacetate or diethyl phthalate in the presence of an auxiliary solvent such as ethyl acetate or cyclohexanone, followed by mechanically emulsifying it into a dispersion.

For preparing a fine solid particle dispersion of the reducing agent, for example, employable is a method that comprises dispersing a powder of the reducing agent in water or in any other suitable solvent by the use of a ball mill, a colloid mill, a shaking ball mill, a sand mill, a jet mill or a roller mill, or ultrasonically dispersing it therein to thereby prepare the intended solid dispersion of the reducing agent. Preferably, a sand mill is used for dispersion. In this method, optionally used is a protective colloid (e.g., polyvinyl alcohol), and a surfactant (e.g., anionic surfactant such as sodium triisopropylnaphthalenesulfonate—this is a mixture of the salts in which the three isopropyl groups are all in different positions). The aqueous dispersion may contain a preservative (e.g., sodium benzoisothiazolinone).

Especially preferred in the invention is preparing a solid particle dispersion of the reducing agent, in which the mean particle size of the reducing agent particles is preferably from 0.01 μm to 10 μm, more preferably from 0.05 μm to 5 μm, even more preferably from 0.1 μm to 1 μm. In the invention, it is desirable that the particle sizes of the other solid dispersions also fall within the range.

(Description of Development Promoter)

Preferably, the photosensitive thermal developable recording material of this embodiment contains a development promoter. Preferred examples of the development promoter are sulfonamidophenol compounds of formula (A) in JP-A 2000-267222 and 2000-330234; hindered phenol compounds of formula (II) in JP-A2001-92075; compounds of formula (I) in JP-A 10-62895 and 11-15116; hydrazine compounds of formula (I) in Japanese Patent Application No. 2001-074278; phenol or naphthol compounds of formula (2) in Japanese Patent Application No. 2000-76240. The amount of the development promoter to be in the material may fall between 0.1 and 20 mol %, but preferably between 0.5 and 10 mol %, more preferably between 1 and 5 mol % relative to the reducing agent therein. The development promoter may be introduced into the material like the reducing agent thereinto. Preferably, however, it is added to the material in the form of its solid dispersion or emulsified dispersion. In case where it is added to the material in the form of its emulsified dispersion, then the emulsified dispersion thereof is preferably prepared by emulsifying and dispersing the development promoter in a mixed solvent of a high-boiling point solvent that is solid at room temperature and an auxiliary solvent having a low boiling point; or the emulsified dispersion is preferably an oilless dispersion with no high-boiling-point solvent therein.

For the development promoter for use in this embodiment, especially preferred are hydrazine compounds of formula (1) in Japanese Patent Application No. 2001-074278, and phenol or naphthol compounds of formula (2) in Japanese Patent Application No. 2000-76240.

Preferred examples of the development promoter for use in this embodiment are mentioned below, to which, however, this embodiment should not be limited.

(A-1)

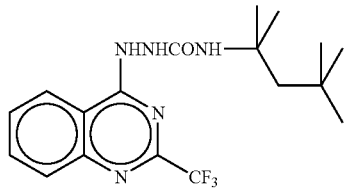

(A-2)

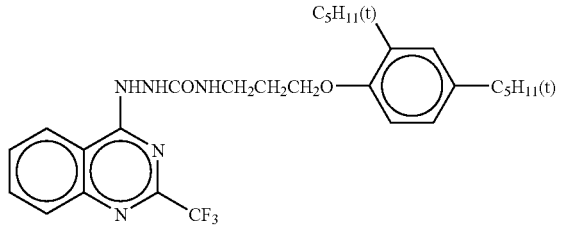

(A-3)

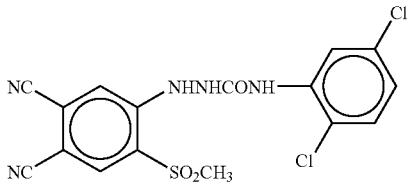

(A-4)

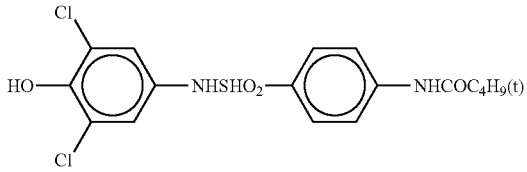

(A-5)

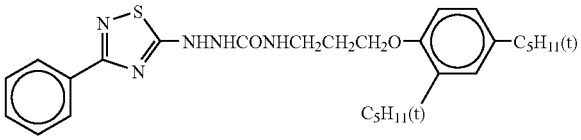

(A-6)

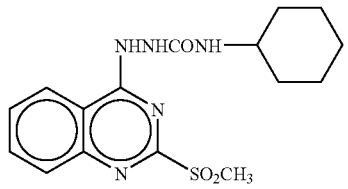

(A-7)

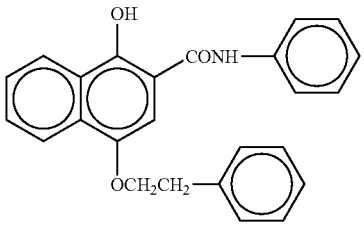

-continued (A-8)

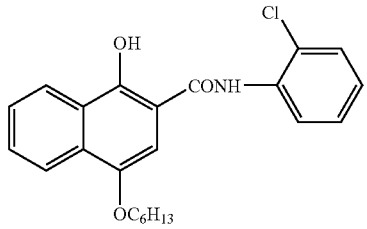

(A-9)

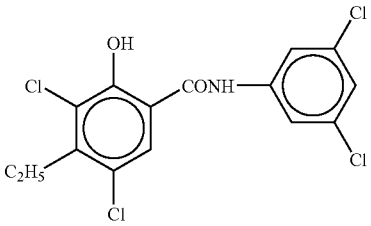

(A-10)

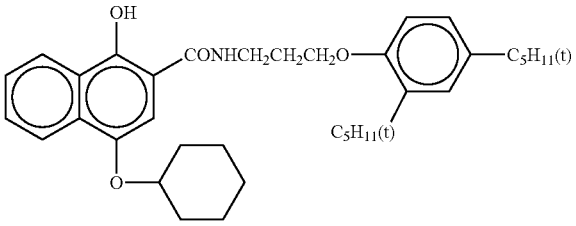

(Description of Hydrogen-Bonding Compound)

In this embodiment, it is desirable that the reducing agent is combined with a non-reducing compound that has a group capable of forming a hydrogen bond with the hydroxyl group (—OH) of the reducing agent or with the amino group, if any, thereof.

The group capable of forming a hydrogen bond with the group in the reducing agent includes, for example, a phosphoryl group, a sulfoxide group, a sulfonyl group, a carbonyl group, an amido group, an ester group, an urethane group, an ureido group, a tertiary amino group, and a nitrogen-containing aromatic group. Of those, preferred are a phosphoryl group, a sulfoxide group, an amido group (not having a group of >N—H but is blocked to form >N—Ra, in which Ra is a substituent except hydrogen), an urethane group (not having a group of >N—H but is blocked to form >N—Ra, in which Ra is a substituent except hydrogen), and an ureido group (not having a group of >N—H but is blocked to form >N—Ra, in which Ra is a substituent except hydrogen).

Especially preferred examples of the hydrogen-bonding compound for use in this embodiment are those of the following general formula (D):

(D)

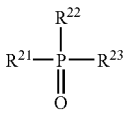

In formula (D), $R^{21}$ to $R^{23}$ each independently represent an alkyl group, an aryl group, an alkoxy group, an aryloxy group, an amino group or a heterocyclic group, and these may be unsubstituted or substituted.

The substituents for the substituted groups for $R^{21}$ to $R^{23}$ are, for example, a halogen atom, an alkyl group, an aryl group, an alkoxy group, an amino group, an acyl group, an acylamino group, an alkylthio group, an arylthio group, a sulfonamido group, an acyloxy group, an oxycarbonyl group, a carbamoyl group, a sulfamoyl group, a sulfonyl group and a phosphoryl group. Of the substituents, preferred are an alkyl group and an aryl group including, for example, methyl, ethyl, isopropyl, t-butyl, t-octyl, phenyl, 4-alkoxyphenyl and 4-acyloxyphenyl groups.

The alkyl group for $R^{21}$ to $R^{23}$ includes, for example, methyl, ethyl, butyl, octyl, dodecyl, isopropyl, t-butyl, t-amyl, t-octyl, cyclohexyl, 1-methylcyclohexyl, benzyl, phenethyl and 2-phenoxypropyl groups.

The aryl group includes, for example, phenyl, cresyl, xylyl, naphthyl, 4-t-butylphenyl, 4-t-octylphenyl, 4-anisidyl and 3,5-dichlorophenyl groups.

The alkoxy group includes, for example, methoxy, ethoxy, butoxy, octyloxy, 2-ethylhexyloxy, 3,5,5-trimethylhexyloxy, dodecyloxy, cyclohexyloxy, 4-methylcyclohexyloxy and benzyloxy groups.

The aryloxy group includes, for example, phenoxy, cresyloxy, isopropylphenoxy, 4-t-butylphenoxy, naphthoxy and biphenyloxy groups.

The amino group includes, for example, dimethylamino, diethylamino, dibutylamino, dioctylamino, N-methyl-N-hexylamino, dicyclohexylamino, diphenylamino and N-methyl-N-phenylamino groups.

For $R^{21}$ to $R^{23}$, preferred are an alkyl group, an aryl group, an alkoxy group and an aryloxy group. From the viewpoint of the advantages of this embodiment, it is preferable that at least one of $R^{21}$ to $R^{23}$ is an alkyl group or an aryl group, and it is more desirable that at least two of them are any of an alkyl group and an aryl group. Even more preferably, $R^{21}$ to $R^{23}$ are the same as the compounds of the type are inexpensive.

Specific examples of the compounds of formula (D) and other hydrogen-bonding compounds usable in this embodiment are mentioned below, to which, however, this embodiment should not be limited.

(D-1)

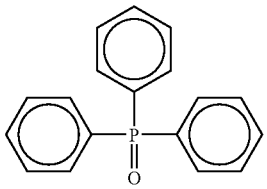

(D-2)

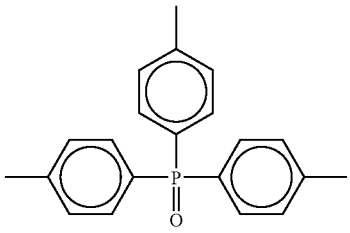

-continued
(D-3)
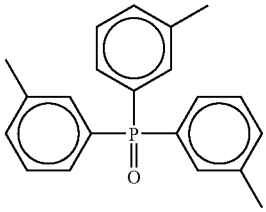
(D-4)
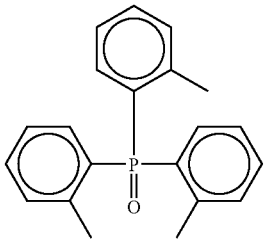
(D-5)
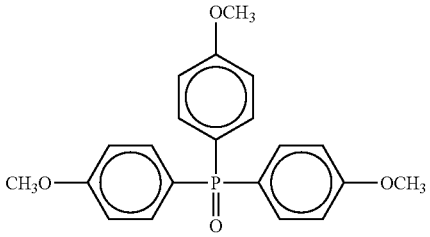
(D-6)
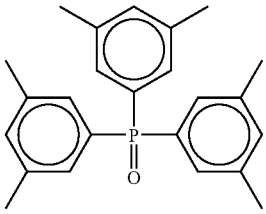
(D-7)
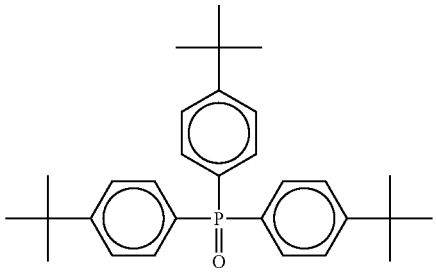
(D-8)
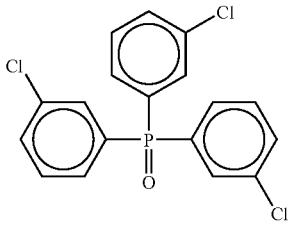
(D-9)
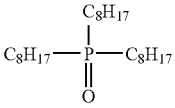
-continued
(D-10)
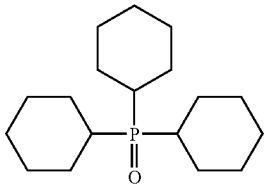
(D-11)
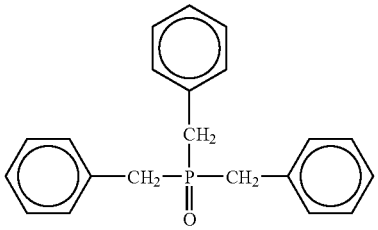
(D-12)
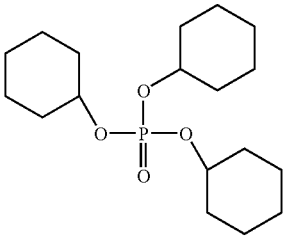
(D-13)
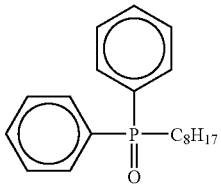
(D-14)
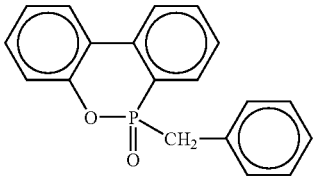
(D-15)
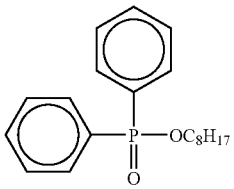
(D-16)
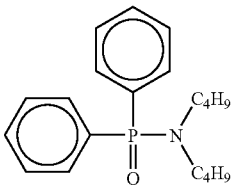

-continued (D-17)

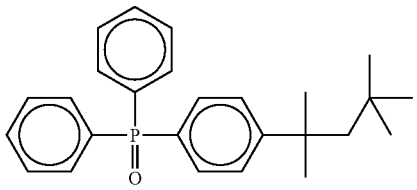

(D-18)

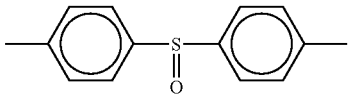

(D-19)

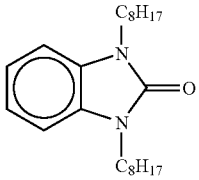

(D-20)

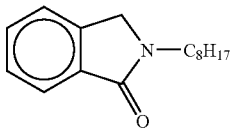

(D-21)

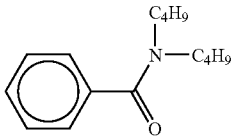

Apart from the above, other hydrogen-bonding compounds such as those described in Japanese Patent Application Nos. 2000-192191 and 2000-194811 are also usable herein.

Like the reducing agent mentioned above, the hydrogen-bonding compound in this embodiment may be added to the coating liquid for the photosensitive thermal developable recording material, for example, in the form of its solution, emulsified dispersion or solid particle dispersion. In its solution, the compound in this embodiment may form a hydrogen-bonding complex with a compound having a phenolic hydroxyl group. Depending on the combination of the reducing agent and the compound of formula (D) for use herein, the complex may be isolated as its crystal.

Thus isolated, the crystal powder may be formed into its solid particle dispersion, and the dispersion is especially preferred for use in the invention for stabilizing the photosensitive thermal developable recording material of the invention. As the case may be, the reducing agent and the hydrogen-bonding compound in this embodiment may be mixed both in powder optionally along with a suitable dispersant added thereto in a sand grinder mill or the like to thereby form the intended complex in the resulting dispersion. The method is also preferred in the invention.

Preferably, the amount of the hydrogen-bonding compound in this embodiment falls between 1 and 200 mol %, more preferably between 10 and 150 mol %, even more preferably between 20 and 100 mol % relative to the reducing agent.

(Description of Binder)

The binder to be in the organic silver salt-containing layer in this embodiment may be polymer of any type, but is preferably transparent or semitransparent and is generally colorless. For it, for example, preferred are natural resins, polymers and copolymers; synthetic resins, polymers and copolymers; and other film-forming media. More concretely, they include, for example, gelatins, rubbers, poly (vinyl alcohols), hydroxyethyl celluloses, cellulose acetates, cellulose acetate butyrates, poly(vinylpyrrolidones), casein, starch, poly(acrylic acids), poly(methyl methacrylates), poly (vinyl chlorides), poly(methacrylicacids), styrene-maleic anhydride copolymers, styrene-acrylonitrile copolymers, styrene-butadiene copolymers, poly(vinylacetals) (e.g., poly (vinylformal), poly(vinylbutyral)), poly(esters), poly(urethanes), phenoxy resins, poly(vinylidene chlorides), poly (epoxides), poly(carbonates), poly(vinyl acetates), poly (olefins), cellulose esters, and poly(amides). The binder may be prepared from water or an organic solvent or an emulsion through microencapsulation.

The glass transition point (Tg) of the binder to be in the organic silver salt-containing layer in this embodiment preferably falls between 10° C. and 80° C., more preferably between 20° C. and 70° C., even more preferably between 23° C. and 65° C.

In this description, Tg is calculated according to the following equation:

$$1/Tg=\Sigma(Xi/Tgi)$$

The polymer of which the glass transition point Tg is calculated as in the above comprises n's monomers copolymerized (i indicates the number of the monomers copolymerized, falling between 1 and n); Xi indicates the weight fraction of i'th monomer ($\Sigma Xi=1$); Tgi indicates the glass transition point (in terms of the absolute temperature) of the homopolymer of i'th monomer alone; and $\Sigma$ indicates the sum total of i falling between 1 and n.

For the glass transition point (Tgi) of the homopolymer of each monomer alone, referred to is the description in *Polymer Handbook* (3rd edition) (written by J. Brandrup, E. H. Immergut (Wiley-Interscience, 1989)).

If desired, two or more different types of binders may be combined and used herein. For example, a binder having a glass transition point of 20° C. or higher and a binder having a glass transition point of lower than 20° C. may be combined. In case where at least two polymers that differ in Tg are blended for use herein, it is desirable that the weight-average Tg of the resulting blend falls within the range defined as above.

In case where the organic silver salt-containing layer in this embodiment is formed by using a coating liquid in which at least 30% by weight of the solvent is water, followed by drying it, and in case where the binder in the organic silver salt-containing layer is soluble or dispersible in an aqueous solvent (watery solvent), then the photosensitive thermal developable recording material having the layer of the type enjoys better properties especially when the binder in the organic silver salt-containing layer is a polymer latex that has an equilibrium water content at 25° C. and 60% RH of at most 2% by weight.

Most preferably, the binder for use in the invention is so designed that its ionic conductivity is at most 2.5 mS/cm. For preparing the binder of the type, for example, employable is a method of preparing a polymer for the binder followed by purifying it through a functional membrane for fractionation.

The aqueous solvent in which the polymer binder is soluble or dispersible is water or a mixed solvent of water and at most 70% by weight of a water-miscible organic solvent.

The water-miscible organic solvent includes, for example, alcohols such as methyl alcohol, ethyl alcohol, propyl alcohol; cellosolves such as methyl cellosolve, ethyl cellosolve, butyl cellosolve; ethyl acetate, and dimethylformamide.

The "equilibrium water content at 25° C. and 60% RH" referred to herein for polymer latex is represented by the following equation, in which $W_1$ indicates the weight of a polymer in humidity-conditioned equilibrium at 25° C. and 60% RH, and $W_0$ indicates the absolute dry weight of the polymer at 25° C.

$$\text{Equilibrium water content at 25° C. and 60\% RH} = [(W_1 - W_0)/W_0] \times 100 \text{ (weight \%)}$$

For the details of the definition of water content and the method for measuring it, for example, referred to is *Polymer Engineering*, Lecture 14, Test Methods for Polymer Materials (by the Polymer Society of Japan, Chijin Shokan Publishing).

Preferably, the equilibrium water content at 25° C. and 60% RH of the binder polymer for use in this embodiment is at most 2% by weight, more preferably from 0.01 to 1.5% by weight, even more preferably from 0.02 to 1% by weight.

Polymers that serve as the binder in this embodiment are preferably dispersible in aqueous solvents. Polymer dispersions include, for example, latex with water-insoluble hydrophobic polymer particles dispersed therein, and molecular or micellar polymer dispersion with polymer molecules or micelles dispersed therein. Any of these are preferred for use herein. The particles in the polymer dispersions preferably have a mean particle size falling between 1 and 50000 nm, more preferably between 5 and 1000 nm or so. The particle size distribution of the dispersed polymer particles is not specifically defined. For example, the dispersed polymer particles may have a broad particle size distribution, or may have a particle size distribution of monodispersion.

Preferred examples of the polymer dispersible in aqueous solvents in this embodiment are hydrophobic polymers such as acrylic polymers, poly(esters), rubbers (e.g., SBR resins), poly(urethanes), poly(vinyl chlorides), poly(vinyl acetates), poly(vinylidene chlorides), and poly(olefins). These polymers may be linear, branched or crosslinked ones. They may be homopolymers from one type of monomer, or copolymers from two or more different types of monomers. The copolymers may be random copolymers or block copolymers.

The polymers for use herein preferably have a number-average molecular weight falling between 5000 and 1000000, more preferably between 10000 and 200000. Polymers of which the molecular weight is too small are unfavorable to the invention, since the mechanical strength of the emulsion layer comprising such a polymer is low; but others of which the molecular weight is too large are also unfavorable since their workability into films is not good.

Preferred examples of polymer latex for use herein are mentioned below. They are expressed by the constituent monomers, in which each numeral parenthesized indicates the proportion, in terms of % by weight, of the monomer unit, and the molecular weight of each constituent monomer is in terms of the number-average molecular weight thereof. Polyfunctional monomers form a crosslinked structure in polymer latex comprising them, to which, therefore, the concept of molecular weight does not apply. The polymer latex of the type is referred to as "crosslinked", and the molecular weight of the constituent monomers is omitted. Tg indicates the glass transition point of the polymer latex.

P-1: Latex of -MMA(70)-EA(27)-MAA(3)-(molecular weight 37000, Tg 61° C.)

P-2: Latex of -MMA(70)-2EHA(20)-St(5)-AA(5)-(molecular weight 40000, Tg 59° C.)

P-3: Latex of -St(50)-Bu(47)-MMA(3)-(crosslinked, Tg −17° C.)

P-4: Latex of -St(68)-Bu(29)-AA(3)-(crosslinked, Tg 17° C.)

P-5: Latex of -St(71)-Bu(26)-AA(3)-(crosslinked, Tg 24° C.)

P-6: Latex of -St(70)-Bu(27)-IA(3)-(crosslinked)

P-7: Latex of -St(75)-Bu(24)-AA(1)-(crosslinked, Tg 29° C.)

P-8: Latex of -St(60)-Bu(35)-DVB(3)-MAA(2)-(crosslinked)

P-9: Latex of -St(70)-Bu(25)-DVB(2)-AA(3)-(crosslinked)

P-10: Latex of -VC(50)-MMA(20)-EA(20)-AN-(5)-AA(5)-(molecular weight 80000)

P-11: Latex of -VDC(85)-MMA(5)-EA(5)-MAA(5)-(molecular weight 67000)

P-12: Latex of -Et(90)-MAA(10)-(molecular weight 12000)

P-13: Latex of -St(70)-2EHA(27)-AA(3)-(molecular weigh: 130000, Tg 43° C.)

P-14: Latex of -MMA(63)-EA(35)-AA(2)-(molecular weight 33000, Tg 47° C.)

P-15: Latex of -St(70.5)-Bu(26.5)-AA(3)-(crosslinked, Tg. 23° C.)

P-16: Latex of -St(69.5)-Bu(27.5)-AA(3)-(crosslinked, Tg 20.5° C.)

P-17: Latex of -St(61.3)-isoprene(35.5)-AA(3)-(crosslinked, Tg 17° C.)

P-18: Latex of -St(67)-isoprene(28)-Bu(2)-AA(3)-(crosslinked, Tg 27° C.)

Abbreviations of the constituent monomers are as follows:

MMA: methyl methacrylate
EA: ethyl acrylate
MAA: methacrylic acid
2EHA: 2-ethylhexyl acrylate
St: styrene
Bu: butadiene
AA: acrylic acid
DVB: divinylbenzene
VC: vinyl chloride
AN: acrylonitrile
VDC: vinylidene chloride
Et: ethylene
IA: itaconic acid The polymer latexes mentioned above are available on the market. Some commercial products employable herein are mentioned below. Examples of acrylic polymers are CEBIAN A-4635, 4718, 4601 (all from Daicel Chemical Industries), and Nipol Lx811, 814, 821, 820, 857 (all from Nippon Zeon); examples of poly(esters) are FINETEX ES650, 611, 675, 850 (all from Dai-Nippon Ink & Chemicals), and WD-size, WMS (both from Eastman Chemical); examples of poly(urethanes) are HYDRAN AP10, 20, 30, 40 (all from Dai-Nippon Ink & Chemicals); examples of rubbers are LACSTAR 7310K, 3307B, 4700H, 7132C (all from Dai-Nippon Ink & Chemicals), and Nipol Lx416, 410, 438C, 2507 (all from Nippon Zeon); examples of poly (vinyl chlorides) are G351, G576 (both from Nippon Zeon); examples of poly(vinylidene chlorides) are L502, L513 (both from Asahi Kasei); and examples of poly(olefins) are CHEMIPEARL S120, SA100 (both from Mitsui Petrochemical).

These polymer latexes may be used either singly or as combined in any desired manner.

For the polymer latex for use in this embodiment, especially preferred is styrene-butadiene copolymer or styrene-isoprene copolymer latex. In the styrene-butadiene copolymer, the ratio of styrene monomer units to butadiene monomer units preferably falls between 40/60 and 95/5 by weight. Also preferably, the styrene monomer units and the butadiene monomer units account for from 60to 99% by weight of the copolymer. The preferred range of the molecular weight of the copolymer may be the same as mentioned above.

Still preferably, the polymer latex for use in the invention contains from 1 to 6% by weight, more preferably from 2 to 5% by weight of acrylic acid or methacrylic acid relative to the sum of styrene and butadiene.

Even more preferably, the polymer latex for use in the invention contains acrylic acid. The preferred range of the monomer content of the copolymer may be the same as mentioned above. The copolymerization ratio in the styrene-isoprene copolymer may be the same as that in the styrene-butadiene copolymer.

Preferred examples of the styrene-butadiene copolymer latex for use in this embodiment are the above-mentioned P-3 to P-8 and P-15, and commercial products, LACSTAR-3307B, 7132C, and Nipol Lx416. Preferred examples of the styrene-isoprene copolymer are the above-mentioned P-17 and P-18.

The organic silver salt-containing layer of the photosensitive thermal developable recording material of this embodiment may optionally contain a hydrophilic polymer such as gelatin, polyvinyl alcohol, methyl cellulose, hydroxypropyl cellulose or carboxymethyl cellulose.

The amount of the hydrophilic polymer that may be in the layer is preferably at most 30% by weight, more preferably at most 20% by weight of all the binder in the organic silver salt-containing layer.

Preferably, the polymer latex as above is used as a binder in forming the organic silver salt-containing layer (that is, the image-forming layer) of the photosensitive thermal developable recording material of this embodiment. Concretely, the amount of the binder in the organic silver salt-containing layer is preferably such that the ratio by weight of total binder/organic silver salt falls between 1/10 and 10/1, more preferably between 1/3 and 4/1.

The organic silver salt-containing layer is a photosensitive layer (emulsion layer) generally containing a photosensitive silver salt, that is, a photosensitive silver halide. In the layer, the ratio by weight of total binder/silver halide preferably falls between 5 and 400, more preferably between 10 and 200.

The overall amount of the binder in the image-forming layer of the photosensitive thermal developable recording material of this embodiment preferably falls between 0.2 and 30 g/m$^2$, more preferably between 1 and 15 g/m$^2$. The image-forming layer may optionally contain a crosslinking agent, and a surfactant which is for improving the coatability of the coating liquid for the layer.

Preferably, the solvent for the coating liquid for the organic silver salt-containing layer of the photosensitive thermal developable recording material of this embodiment is an aqueous solvent that contains at least 30% by weight of water. The solvent referred to herein is meant to indicate both solvent and dispersion medium for simple expression. Except water, the other components of the aqueous solvent may be any organic solvents that are miscible with water, including, for example, methyl alcohol, ethyl alcohol, isopropyl alcohol, methyl cellosolve, ethyl cellosolve, dimethylformamide, ethyl acetate. The water content of the solvent for the coating liquid is preferably at least 50% by weight, more preferably at least 70% by weight.

Preferred examples of the solvent composition are water alone, water/methyl alcohol=90/10, water/methyl alcohol=70/30, water/methyl alcohol/dimethylformamide=80/15/5, water/methyl alcohol/ethyl cellosolve=85/10/5, water/methyl alcohol/isopropyl alcohol=85/10/5. The ratio is % by weight.

(Description of Antifoggant)

Preferably, the photosensitive thermal developable recording material of this embodiment contains, as an antifoggant, a compound of the following formula (H):

$$Q\text{-}(Y)n\text{-}C(Z_1)(Z_2)X \qquad (H)$$

In formula (H), Q represents an alkyl, aryl or heterocyclic group; Y represents a divalent linking group; n indicates 0 or 1; $Z_1$ and $Z_2$ each represent a halogen atom; and X represents a hydrogen atom or an electron-attracting group.

Preferably, Q is a phenyl group substituted with an electron-attracting group having a positive Hammett's substituent constant $\sigma_p$. For the Hammett's substituent constant, referred to is, for example, *Journal of Medicinal Chemistry,* 1973, Vol. 16, No. 11, 1207-1216.

Preferred examples of the electron-attracting group are a halogen atom (fluorine atom with $\sigma_p$ of 0.06, chlorine atom with $\sigma_p$ of 0.23, bromine atom with $\sigma_p$ of 0.23, iodine atom with $\sigma_p$ of 0.18), a trihalomethyl group (tribromomethyl with $\sigma_p$ of 0.29, trichloromethyl with $\sigma_p$ of 0.33, trifluoromethyl with $\sigma_p$ of 0.54), a cyano group (with $\sigma_p$ of 0.66), a nitro group (with $\sigma_p$ of 0.78), an aliphatic, aryl or heterocyclic sulfonyl group (e.g., methanesulfonyl with $\sigma_p$ of 0.72), an aliphatic, aryl or heterocyclic acyl group (e.g., acetyl with $\sigma_p$ of 0.50, benzoyl with $\sigma_p$ of 0.43), an alkynyl group (e.g., C≡CH with $\sigma_p$ of 0.23), an aliphatic, aryl or heterocyclic oxycarbonyl group (e.g., methoxycarbonyl with $\sigma_p$ of 0.45, phenoxycarbonyl with $\sigma_p$ of 0.44), a carbamoyl group (with $\sigma_p$ of 0.36), a sulfamoyl group (with $\sigma_p$ of 0.57), a sulfoxide group, a heterocyclic group, and a phosphoryl group.

The $\sigma_p$ of the electron-attracting group preferably falls between 0.2 and 2.0, more preferably between 0.4 and 1.0.

Of the electron-attracting groups mentioned above, preferred are a carbamoyl group, an alkoxycarbonyl group, an alkylsulfonyl group, an alkylphosphoryl group a carboxyl group, an alkyl or arylcarbonyl group, and an arylsulfonyl group; more preferred are a carbamoyl group, an alkoxycarbonyl group, an alkylsulfonyl group, and an alkylphosphoryl group; and most preferred is a carbamoyl group.

X is preferably an electron-attracting group, more preferably a halogen atom, an aliphatic, aryl or heterocyclic sulfonyl group, an aliphatic, aryl or heterocyclic acyl group, analiphatic, aryl or heterocyclic oxycarbonyl group, a carbamoyl group, or a sulfamoyl group. Even more preferably, it is a halogen atom.

For the halogen atom for X, preferred are chlorine, bromine and iodine atoms, more preferred are chlorine and bromine atoms, and even more preferred is a bromine atom.

Y is preferably —C(═O)—, —SO— or —$SO_2$—, more preferably —C(═O)— or —$SO_2$—, even more preferably —$SO_2$—. n is 0 or 1, but preferably 1.

Specific examples of the compounds of formula (H) for use in this embodiment are mentioned below, to which, however, this embodiment should not be limited.

(H-1)
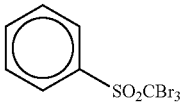
(H-2)
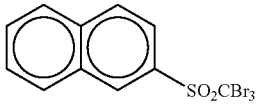
(H-3)
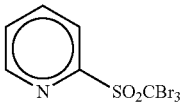
(H-5)
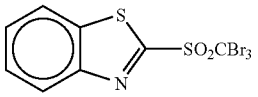
(H-6)
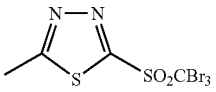
(H-7)
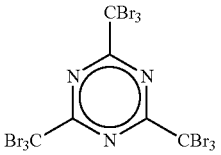
(H-8)
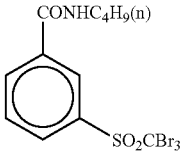
(H-9)
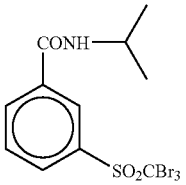
(H-10)
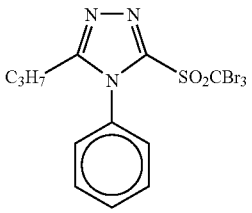
(H-11)
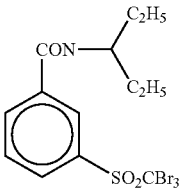
-continued
(H-12)
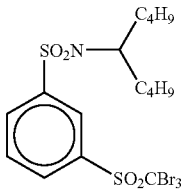
(H-13)
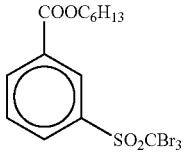
(H-14)
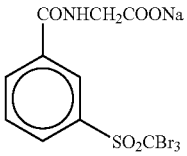
(H-15)
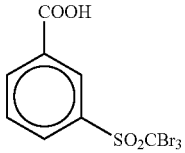
(H-16)
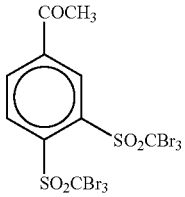
(H-17)
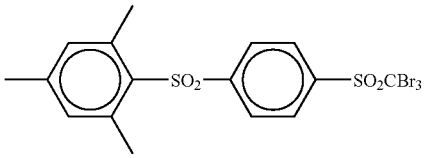
(H-18)
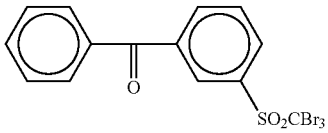
(H-19)
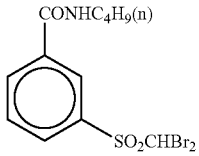
(H-20)
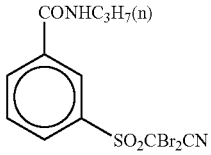

-continued (H-21)

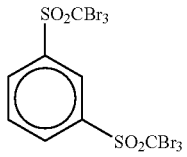

(H-22)

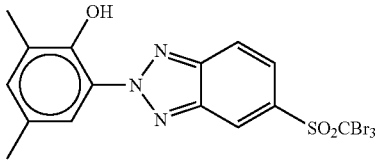

(H-23)

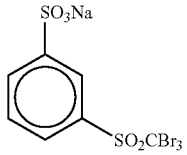

(H-24)

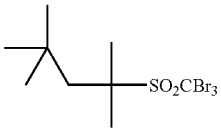

Preferably, the amount of the compound of formula (H) to be in the photosensitive thermal developable recording material of this embodiment falls between $10^{-4}$ and 0.8 mols, more preferably between $10^{-3}$ and 0.1 mols, even more preferably between $5\times10^{-3}$ and 0.05 mols per mol of the non-photosensitive organic silver salt in the image-forming layer of the material.

Especially when a silver halide having a high silver iodide content is used in the photosensitive thermal developable recording material of this embodiment, the amount of the compound of formula (H) to be added to the material is critical in order to that the material may enjoy good fogging resistance. Most preferably, therefore, the amount of the compound in the material falls between $5\times10^{-3}$ and 0.03 mols.

For adding the compound of formula (H) to the photosensitive thermal developable recording material of this embodiment, for example, referred to is the method of adding a reducing agent to the material described hereinabove.

Preferably, the compounds of formula (H) have a melting point not higher than 200° C., more preferably not higher than 170° C.

Other organic polyhalogen compounds that may be used in this embodiment are described, for example, in paragraphs [0111] and [0112] of JP-A11-65021. In particular, the organic halogen compounds of formula (P) disclosed in Japanese Patent Application No. 11-87297; the organic polyhalogen compounds of formula (II) in JP-A 10-339934; and the organic polyhalogen compounds in Japanese Patent Application No. 11-205330 are preferred for use herein.

(Other Antifoggants)

Other antifoggants usable herein are mercury(II) salts as in JP-A 11-65021, paragraph [0113]; benzoic acids as in JP-A 11-65021, paragraph [0114]; salicylic acid derivatives as in JP-A 2000-206642; formalin scavenger compounds of formula (S) in JP-A 2000-221634; triazine compounds claimed in claim 9 in JP-A 11-352624; compounds of formula (III) in JP-A 6-11791; and 4-hydroxy-6-methyl-1,3,3a,7-tetrazaindene.

The compounds described in JP-A 10-62899, paragraph [0070]; European Patent No. 0803764A1, from page 20, line 57 to page 21, line 7; JP-A 9-281637 and 9-329864 are usable as antifoggants, stabilizers and stabilizer precursors in this embodiment.

The photosensitive thermal developable recording material of this embodiment may also contain an azolium salt serving as an antifoggant. The azolium salt includes, for example, compounds of formula (XI) in JP-A 59-193447, compounds as in JP-B 55-12581, and compounds of formula (II) in JP-A 60-153039. The azolium salt may be present in any site of the photosensitive thermal developable recording material, but is preferably in some layer on the surface of the material on which is present a photosensitive layer. More preferably, it is added to the organic silver salt-containing layer of the material.

Regarding the time at which the azolium salt is added to the material, it may be added to the coating liquid in any stage of preparing the liquid. In case where it is to be present in the organic silver salt-containing layer, the azolium salt may be added to any of the reaction system to prepare the organic silver salt or the reaction system to prepare the coating liquid in any stage of preparing them. Preferably, however, it is added to the coating liquid after the stage of preparing the organic silver salt and just before the stage of coating with the liquid. The azolium salt to be added may be in any form of powder, solution or fine particle dispersion. It may be added along with other additives such as sensitizing dye, reducing agent and color toning agent, for example, in the form of their solution.

The amount of the azolium salt to be added to the photosensitive thermal developable recording material of this embodiment is not specifically defined, but preferably falls between $1\times10^{-6}$ mols and 2 mols, more preferably between $1\times10^{-3}$ mols and 0.5 mols, per mol of silver in the material.

(Other Additives)

1) Mercapto Compounds, Disulfide Compounds and Thione Compounds:

The photosensitive thermal developable recording material of this embodiment may optionally contain any of mercapto compounds, disulfide compounds and thione compounds which are for retarding, promoting or controlling the developability of the material, or for enhancing the spectral sensitivity thereof, or for improving the storage stability thereof before and after development. For the additive compounds, for example, referred to are JP-A10-62899, paragraphs [0067] to [0069]; compounds of formula (I) in JP-A 10-186572, and their examples in paragraphs [0033] to [0052]; EP-A No. 0803764A1, page 20, lines 36 to 56; and Japanese Patent Application No. 11-273670. Of those, especially preferred are mercapto-substituted hetero-aromatic compounds.

2) Color Toning Agent:

Adding a color toning agent to the photosensitive thermal developable recording material of this embodiment is preferred. Examples of the color toning agent usable herein are described in JP-A10-62899, paragraphs [0054] to [0055], EP-A No. 0803764A1, page 21, lines 23 to 48; JP-A 2000-356317; and Japanese Patent Application No. 2000-187298. Preferred for use herein are phthalazinones (phthalazinone, phthalazinone derivatives and their metal salts, e.g., 4-(1-naphthyl)phthalazinone, 6-chlorophthalazinone, 5,7-dimethoxyphthalazinone, 2,3-dihydro-1,4-phthalazinedione); combinations of phthalazinones and phthalic acids (e.g., phthalic acid, 4-methylphthalic acid, 4-nitrophthalic acid, diammonium phthalate, sodium phthalate, potassium phthalate, tetrachlorophthalic anhydride); phthalazines (phthalazine, phthalazine derivatives and their salts, e.g., 4-(1-naphthyl)phthalazine, 6-isopropylphthalazine, 6-tert-butylphthalazihe, 6-chlorophthalazine, 5,7-dimethoxyphthalazine, 2,3-dihydrophthalazine). More preferred are combinations of phthalazines and phthalic acids to be combined with a silver halide having a high silver iodide content.

Preferably, the amount of phthalazines to be added to the material is from 0.01 mols to 0.3 mols, more preferably from 0.02 to 0.2 mols, even more preferably from 0.02 to 0.1 mols per mol of the organic silver salt in the material. The amount is a critical factor for development promotion of the silver halide emulsion having a high silver iodide content in this embodiment. Selecting the suitable amount attains both sufficient developability and sufficient fogging resistance.

3) Plasticizer, Lubricant:

Plasticizer and lubricant that may be in the photosensitive layer of the photosensitive thermal developable recording material of this embodiment are described in, for example, JP-A 11-65021, paragraph [0117]. Lubricant is described also in JP-A 11-84573, paragraphs [0061] to [0064] and Japanese Patent Application No. 11-106881, paragraphs [0049] to [0062].

4) Dye, Pigment:

The photosensitive layer of the photosensitive thermal developable recording material of this embodiment may contain various types of dyes and pigments (e.g., C.I. Pigment Blue 60, C.I. Pigment Blue 64, C.I. Pigment Blue 15:6) for improving the color image tone, for preventing interference fringes during laser exposure, and for preventing irradiation. The details of such dyes and pigments are described in, for example, WO98/36322, and JP-A 10-268465 and 11-338098.

5) Ultra-Hard Gradation Enhancing Agent:

For forming ultra-hard images suitable to printing plates, it is desirable to add an ultra-hard gradation enhancing agent to the image-forming layer of the photosensitive thermal developable recording material of the invention. For the ultra-hard gradation enhancing agent, the method of using it, and its amount applicable to the invention, for example, referred to are JP-A 11-65021, paragraph [0118]; JP-A 11-223898, paragraphs [0136] to [0193]; compounds of formula (H), those of formulae (1) to (3) and those of formulae (A) and (B) in Japanese Patent Application No. 11-87297; and compounds of formulae (III) to (V) in Japanese Patent Application No. 11-91652, especially concrete compounds in [Formula 21] to [Formula 24] therein. For hardening promoters also applicable to the invention, referred to are JP-A 11-65021, paragraph [0102]; and JP-A 11-223898, paragraphs [0194] to [0195].

In case where formic acid or its salt is used for a strong foggant in the invention, it may be added to the side of the photosensitive thermal developable recording material that has thereon a photosensitive silver halide-containing, image-forming layer, and its amount is preferably at most 5 mmols, more preferably at most 1 mmol per mol of silver in the layer.

In case where an ultra-hard gradation enhancing agent is used in the photosensitive thermal developable recording material of this embodiment, it is preferably combined with an acid formed through hydration of diphosphorus pentoxide or its salt. The acid to be formed through hydration of diphosphorus pentoxide and its salts include, for example, metaphosphoric acid (and its salts), pyrophosphoric acid (and its salts), orthophosphoric acid (and its salts), triphosphoric acid (and its salts), tetraphosphoric acid (and its salts), and hexametaphosphoric acid (and its salts). For the acid to be formed through hydration of diphosphorus pentoxide and its salts, preferred for use herein are orthophosphoric acid (and its salts ), and hexametaphosphoric acid (and its salts). Concretely, their salts are sodium orthophosphate, sodium dihydrogen-orthophosphate, sodium hexametaphosphate, and ammonium hexametaphosphate.

The amount of the acid to be formed through hydration of diphosphorus pentoxide or its salt to be used herein (that is, the amount thereof to be in the unit area, one $m^2$, of the photosensitive thermal developable recording material) may be any desired one and may be defined in any desired manner depending on the sensitivity, the fogging resistance and other properties of the material. Preferably, however, it falls between 0.1 and 500 $mg/m^2$, more preferably between 0.5 and 100 $mg/m^2$.

(Preparation of Coating Liquid and Coating with it)

The temperature at which the coating liquid for the image-forming layer is prepared preferably falls between 30° C. and 65° C., more preferably between 35° C. and lower than 60° C., even more preferably between 35° C. and 55° C. Also preferably, the temperature of the coating liquid is kept between 30° C. and 65° C. immediately after a polymer latex is added thereto.

2. Layer Constitution and Other Constituent Components:

The photosensitive thermal developable recording material of the invention has non-photosensitive layers in addition to image-forming layers. Depending on their positions, the non-photosensitive layers are grouped into (a) a surface-protective layer to be disposed on an image-forming layer (remoter from the support than the image-forming layer); (b) an interlayer to be disposed between adjacent image-forming layers or between an image-forming layer and a protective layer; (c) a subbing layer to be disposed between an image-forming layer and a support; (d) a back layer to be disposed on a support opposite to an image-forming layer.

A layer that serves as an optical filter may be disposed in the material, and it may be the layer (a) or (b). An antihalation layer may be disposed in the material, and it may be the layer (c) or (d).

1) Surface-Protective Layer:

The photosensitive thermal developable recording material of this embodiment may have a surface-protective layer for preventing surface blocking of the image-forming layer thereof. The surface-protective layer may have a single-layered structure or a multi-layered structure. The details of the surface-protective layer are described, for example, in JP-A 11-65021, paragraphs [0119] to [0120], and Japanese Patent Application No. 2000-171936.

Gelatin is preferred for the binder in the surface-protective layer in this embodiment, but polyvinyl alcohol (PVA) is also usable for it. Combining the two for the binder is also preferred. Gelatin for use herein may be inert gelatin (e.g., Nitta Gelatin 750), or gelatin phthalide (e.g., Nitta Gelatin 801).

For PVA usable herein, referred to are those described in JP-A 2000-171936, paragraphs [0009] to [0020]. Preferred for PVA for use herein are, for example, completely saponified PVA-105; partially saponified PVA-205, PVA-355; and modified polyvinyl alcohol, MP-203 (all commercial products of Kuraray).

The polyvinyl alcohol content (per $m^2$ of the support) of one surface-protective layer preferably falls between 0.3 and 4.0 $g/m^2$, more preferably between 0.3 and 2.0 $g/m^2$.

The overall binder content (including water-soluble polymer and latex polymer) (per $m^2$ of the support) of one surface-protective layer preferably falls between 0.3 and 5.0 $g/m^2$, more preferably between 0.3 and 2.0 $g/m^2$.

2) Antihalation Layer:

An antihalation layer may be disposed in the photosensitive thermal developable recording material of this embodiment remoter from the light source for exposure than the photosensitive layer therein. The antihalation layer is described in, for example, JP-A 11-65021, paragraphs [0123] to [0124]; JP-A 11-223898, 9-230531, 10-36695, 10-104779, 11-231457, 11-352625 and 11-352626.

The antihalation layer contains an antihalation dye capable of absorbing the light to which the photosensitive thermal developable recording material is exposed. In case where the photosensitive thermal developable recording material is exposed to IR rays, IR-absorbing dyes may be used for antihalation. In that case, it is desirable that the dyes do not absorb visible light.

On the other hand, in case where visible light-absorbing dyes are used for antihalation, it is desirable that the dyes used are substantially decolored after image formation on the material, for which, for example, usable are decoloring agents that have the ability to decolor the dyes when heated in the step of thermal development. Preferably, a thermal decoloring dye and a base precursor are added to a non-photosensitive layer so that the layer containing them may function as an antihalation layer. The details of this technique are described in, for example, JP-A 11-231457.

The amount of the decoloring dye to be added shall be determined, depending on the use of the dye. In general, its amount is so determined that the dye added could ensure an optical density (absorbance), measured at an intended wavelength, of larger than 1.0. The optical density preferably falls between 0.2 and 2. The amount of the dye capable of ensuring the optical density falling within the range may be generally from 0.001 to 1 $g/m^2$or so.

Decoloring the dyes in the photosensitive thermal developable recording material in that manner can lower the optical density of the material to 0.1 or less after thermal development. Two or more different types of decoloring dyes may be in the thermodecoloring recording material or the photosensitive thermal developable recording material. Similarly, two or more different types of base precursors may be in the material.

In the thermodecoloring material of the type that contains such a decoloring dye and a base precursor, it is desirable in view of the thermodecoloring ability of the material that the base precursor therein is combined with a substance which, when mixed with the base precursor, can lower the melting point of the mixture by at least 3° C. (e.g., diphenyl sulfone, 4-chlorophenyl(phenyl) sulfone) as in JP-A 11-352626.

3) Back Layer:

For the back layer applicable to this embodiment, referred to is the description in JP-A 11-65021, paragraphs [0128] to [0130].

In this embodiment, a coloring agent having an absorption maximum in a range falling between 300 and 450 nm may be added to the photosensitive thermal developable recording material for improving the silver tone and the image stability of the material. The coloring agent is described in, for example, JP-A 62-210458, 63-104046, 63-1003235, 63-208846, 63-306436, 63-314535, 01-61745; and Japanese Patent Application No. 11-276751. In general, the amount of the coloring agent to be added to the material falls between 0.1 $mg/m^2$ and 1 $g/m^2$. Preferably, it is added to the back layer that is opposite to the photosensitive layer of the material.

4) Matting Agent:

Preferably, the photosensitive thermal developable recording material of this embodiment contains a matting agent which is for improving the transferability of the material, in the surface-protective layer and the back layer of the material. Matting agents are described in JP-A 11-65021, paragraphs [0126] to [0127].

The amount of the matting agent to be added to the photosensitive thermal developable recording material preferably falls between 1 and 400 $mg/m^2$, more preferably between 5 and 300 $mg/m^2$ of the material.

The degree to which the surface of the emulsion layer of the photosensitive thermal developable recording material of the invention is matted is not specifically defined, so far as the matted emulsion layer surface is free from star dust trouble (the image area of the layer has small white spots through which light leaks out), but is preferably such that the Beck's smoothness of the matted surface could fall between 30 seconds and 2000 seconds, more preferably between 40 seconds and 1500 seconds. The Beck's smoothness is readily obtained according to JIS P8119 (method of testing surface smoothness of paper and paper boards with Beck tester), and to TAPPI Standard T479.

Regarding the matting degree of the back layer of the photosensitive thermal developable recording material of this embodiment, the Beck's smoothness of the matted back layer preferably falls between 10 seconds and 1200 seconds, more preferably between 20 seconds and 800 seconds, even more preferably between 40 seconds and 500 seconds.

Preferably, the photosensitive thermal developable recording material of this embodiment contains a matting agent in the outermost surface layer, or in a layer functioning as an outermost surface layer, or in a layer nearer to the outermost surface of the material. Also preferably, it may contain a matting agent in a layer of the material that functions as a protective layer.

5) Polymer Latex:

A polymer latex may be added to the surface-protective layer or the back layer in this embodiment.

The polymer latex is described in, for example, *Synthetic Resin Emulsions* (by Taira Okuda & Hiroshi Inagaki, the Polymer Publishing Association of Japan, 1978); *Applications of Synthetic Latexes* (by Takaaki Sugimura, Yasuo Kataoka, Sohichi Suzuki & Keiji Kasahara, the Polymer Publishing Association of Japan, 1993); and *Chemistry of Synthetic Latexes* (by Sohichi Muroi, the Polymer Publishing Association of Japan, 1970). Concretely, it includes methyl methacrylate (33.5 weight %)/ethyl acrylate (50 weight %)/methacrylic acid (16.5 weight %) copolymer latex; methyl methacrylate (47.5 weight %)/butadiene (47.5 weight %)/itaconic acid (5 weight %) copolymer latex; ethyl acrylate/methacrylic acid copolymer latex; methyl methacrylate (58.9 weight %)/2-ethylhexyl acrylate (25.4 weight %)/styrene (8.6 weight %)/2-hydroxyethyl methacrylate (5.1 weight%)/acrylic acid (2.0 weight %) copolymer latex; and methyl methacrylate (64.0 weight %)/styrene (9.0 weight %)/butyl acrylate (20.0 weight %)/2-hydroxyethyl methacrylate (5.0 weight %)/acrylic acid (2.0 weight %) copolymer latex.

The ratio of the polymer latex in the surface-protective layer or the back layer preferably falls between 10% by weight and 90% by weight, more preferably between 20% by weight and 80% by weight of all the binder (including water-soluble polymer and latex polymer) in the layer.

6) Surface pH:

Preferably, the surface of the photosensitive thermal developable recording material of this embodiment has a pH of at most 7.0, more preferably at most 6.6, before developed under heat. The lowermost limit of the pH is not specifically defined, but may be at least 3 or so. Most preferably, the pH range falls between 4 and 6.2.

For controlling the surface pH of the photosensitive thermal developable recording material, employable are nonvolatile acids, for example, organic acids such as phthalic acid derivatives, or sulfuric acid, or nonvolatile bases such as ammonia. These are preferred as effective for reducing the surface pH of the material. Especially preferred for the surface pH-lowering agent is ammonia, as it is highly volatile, and therefore can be readily removed during coating or before thermal development. Also preferred is combining ammonia with a nonvolatile base such as sodium hydroxide, potassium hydroxide or lithium hydroxide. For measuring the surface pH of the photosensitive thermal developable recording material, referred to is the description in Japanese Patent Application No. 11-87297, paragraph (0123).

7) Hardening Agent:

A hardening agent may be added to the photosensitive layer, the protective layer, the back layer and other layers constituting the photosensitive thermal developable recording material of this embodiment.

The details of the hardening agent applicable to the invention are described in T. H. James' *The Theory of the Photographic Process,* 4th Ed. (Macmillan Publishing Co., Inc., 1977), pp. 77-87. For example, preferred for use herein are chromium alum, 2,4-dichloro-6-hydroxy-s-triazine sodium salt, N,N-ethylenebis(vinylsulfonacetamide), N,N-propylenebis (vinylsulfonacetamide); as well as polyvalent metal ions described on page 78 of that reference; polyisocyanates described in U.S. Pat. No. 4,281,060and JP-A6-208193; epoxy compounds described in U.S. Pat. No. 4,791,042; and vinylsulfone compounds described in JP-A 62-89048.

The hardening agent is added to the coating liquids in the form of its solution. The time at which the solution is added to the coating liquid for the protective layer may fall between 180 minutes before coating the liquid and a time just before the coating, preferably between 60 minutes before the coating and 10 seconds before it. However, there is no specific limitation thereon, so far as the method and the condition employed for adding the hardening agent to the coating liquid ensure the advantages of the invention.

Concretely for adding it, employable is a method of mixing a hardening agent with a coating liquid in a tank in such a controlled manner that the mean residence time for the agent as calculated from the amount of the agent added and the flow rate of the coating liquid to a coater could be a predetermined period of time; or a method of mixing them with a static mixer, for example, as in N. Harunby, M. F. Edwards & A. W. Nienow's *Liquid Mixing Technology*, Chap. 8 (translated by Koji Takahasi, published by Nikkan Kogyo Shinbun, 1989).

8) Surfactant:

Surfactants applicable to the photosensitive thermal developable recording material of this embodiment are described in JP-A 11-65021, paragraph [0132].

The photosensitive thermal developable recording material of this embodiment preferably contains a fluorine-containing surfactant. Examples of fluorine-containing surfactants that are preferred for use herein are given, for example, in JP-A 10-197985, 2000-19680 and 2000-214554. Also preferred for use herein are fluorine-containing polymer surfactants such as those in JP-A 9-281636. In this embodiment, especially preferred are the fluorine-containing surfactants described in Japanese Patent Application No. 2000-206560.

9) Antistatic Agent:

The photosensitive thermal developable recording material of this embodiment may have an antistatic layer that contains a known metal oxide or electroconductive polymer. The antistatic layer may serve also as the subbing layer or the back surface-protective layer of the material, but may be disposed separately from them. The techniques described in JP-A 11-65021, paragraph [0135]; JP-A 56-143430, 56-143431, 58-62646, 56-120519; JP-A 11-84573, paragraphs [0040] to [0051]; U.S. Pat. No. 5,575,957; and JP-A 11-223898, paragraphs [0078] to [0084] may apply to the antistatic layer in this embodiment.

10) Support:

The support of the photosensitive thermal developable recording material of the invention may be a transparent support. For the transparent support, preferred are biaxially-stretched films of polyesters, especially polyethylene terephthalate heated at a temperature falling between 130 and 185° C. The heat treatment is for removing the internal strain that may remain in the biaxially-stretched films and for preventing the film supports from being thermally shrunk during thermal development of the material.

PEN is preferred for the support of the photosensitive thermal developable recording material to be combined with a UV light-emitting screen, which, however, is not limitative. More preferably, PEN is polyethylene 2,6-naphthalate. Polyethylene 2,6-naphthalate for use in this embodiment may be any one substantially comprising ethylene 2,6-naphthalenedicarboxylate units as the repetitive units thereof. It includes not only non-copolymerized polyethylene 2,6-naphthalenedicarboxylate but also copolymers in which at most 10% by number, preferably at most 5% by number of the repetitive structural units are modified with any other component, and mixtures and compositions with any other polymer.

Polyethylene 2,6-naphthalate may be produced by bonding naphthalene-2,6-dicarboxylic acid or its functional derivative to ethylene glycol or its functional derivative in the presence of a catalyst under suitable reaction condition. Polyethylene 2,6-naphthalate for use in this embodiment may be a copolymer or a mixed polyester that is prepared by adding one or more types of a third component (modifier) before the completion of polymerization to give the polymer, polyethylene 2,6-naphthalate. Suitable examples of the third component are divalent ester-forming functional group-having compounds, for example, dicarboxylic acids and their lower alkyl esters, such as oxalic acid, adipic acid, phthalic acid, isophthalic acid, terephthalic acid, naphthalene-2,7-dicarboxylic acid, succinic acid, diphenylether-dicarboxylic acid; hydroxycarboxylic acids and their lower alkyl esters, such as p-hydroxybenzoic acid, p-hydroxyethoxybenzoic acid; and dialcohols such as propylene glycol, trimethylene glycol. Polyethylene 2,6-naphthalate and its modified polymers may be blocked at the terminal hydroxyl group and/or carboxyl group thereof, with a monofunctional compound such as benzoic acid, benzoylbenzoic acid, benzyloxybenzoic acid, methoxypolyalkylene glycol, or may be modified with an extremely minor amount of a trifunctional or tetrafunctional ester-forming compound such as glycerin or pentaerythritol to such a degree that it could be a substantially linear copolymer.

In case where the photosensitive thermal developable recording material is for medical treatment, the transparent support for it may be colored with a blue dye (for example, with Dye-1 used in the examples in JP-A8-240877), or may not be colored.

Specific examples of the support are described in JP-A 11-65021, paragraph [0134].

Preferably, the support is undercoated, for example, with a water-soluble polyester as in JP-A 11-84574; a styrene-butadiene copolymer as in JP-A10-186565; or a vinylidene chloride copolymer as in JP-A 2000-39684 or in Japanese Patent Application No. 11-106881, paragraphs [0063] to [0080].

11) Other Additives:

The photosensitive thermal developable recording material of the invention may optionally contain an antioxidant, a stabilizer, a plasticizer, a UV absorbent or a coating aid. A solvent as in JP-A 11-65021, paragraph [0133] may also be added to it. The additives may be in any of the photosensitive layers or the non-photosensitive layers of the material. For the additives, for example, referred to are WO 98/36322, EP-A No. 803764A1, and JP-A 10-186567 and 10-18568.

12) Coating Mode:

To fabricate the photosensitive thermal developable recording material of this embodiment, the coating liquids may be applied onto the support in any desired manner. Concretely, various types of coating techniques are employable herein, including, for example, extrusion coating, slide coating, curtain coating, dipping, knife coating, and flow coating. Various types of hoppers for extrusion coating employable herein are described in U.S. Pat. No. 2,681,294. Preferred for the photosensitive thermal developable recording material of the invention is extrusion coating or slide coating described in Stephen F. Kistler & Petert M. Schweizer's *Liquid Film Coating* (Chapman & Hall, 1997), pp. 399-536. More preferred is slide coating.

One example of the shape of a slide coater for slide coating is in FIG. 11b-1, on page 427 of that reference. If desired, two or more layers may be formed at the same time, for example, according to the methods described from page 399 to page 536 of that reference, or to the methods described in U.S. Pat. No. 2,761,791 and BP No. 837,095.

Preferably, the coating liquid for the organic silver salt-containing layer of the photosensitive thermal developable recording material of this embodiment is a thixotropic flow. For it, referred to is the technique described in JP-A 11-52509.

Preferably, the coating liquid for the organic silver salt-containing layer in this embodiment has a viscosity falling between 400 mPa.s and 100,000 mPa.s, more preferably between 500 mPa.s and 20,000 mPa.s, at a shear rate of 0.1 $sec^{-1}$.

Also preferably, the viscosity falls between 1 mPa·s and 200 mPa·s, more preferably between 5 mPa·s and 80 mPa·s, at a shear rate of 1000 $sec^{-1}$.

13) Wrapping Material:

Preferably, the photographic material of this embodiment is airtightly wrapped with a material of low oxygen and/or moisture permeability for preventing its photographic properties from varying and for preventing the rolled products from curling or from having a curled habit while stored as unprocessed stocks. Preferably, the oxygen permeability at 25° C. of the wrapping material for use herein is at most 50 ml/atm/$m^2$·day, more preferably at most 10 ml/atm/$m^2$·day, even more preferably at most 1.0 ml/atm/$m^2$·day. Also preferably, the moisture permeability thereof is at most 10 g/atm/$m^2$·day, more preferably at most 5 g/atm/$m^2$·day, even more preferably at most 1 g/atm/$m^2$·day. Preferred examples of the wrapping material of low oxygen and/or moisture permeability for use herein are described, for example, in JP-A 8-254793 and 2000-206653.

14) Other Employable Techniques:

Other techniques applicable to the photosensitive thermal developable recording material of this embodiemnt are, for example, in EP-A Nos. 803764A1 and 883022A1, WO98/36322; JP-A56-62648, 58-62644, 9-43766, 9-281637, 9-297367, 9-304869, 9-311405, 9-329865, 10-10669, 10-62899, 10-69023, 10-186568, 10-90823, 10-171063, 10-186565, 10-186567, 10-186569 to 10-186572, 10-197974, 10-197982, 10-197983, 10-197985 to 10-197987, 10-207001, 10-207004, 10-221807, 10-282601, 10-288823, 10-288824, 10-307365, 10-312038, 10-339934, 11-7100, 11-15105, 11-24200, 11-24201, 11-30832, 11-84574, 11-65021, 11-109547, 11-125880, 11-129629, 11-1.33536 to 11-133539, 11-133542, 11-133543, 11-223898, 11-352627, 11-305377, 11-305378, 11-305384, 11-305380, 11-316435, 11-327076, 11-338096, 11-338098, 11-338099, 11-343420, 2000-187298, 2001-200414, 2001-234635, 2002-20699, 2001-275471, 2001-275461, 2000-313204, 2001-292844, 2000-324888, 2001-239864, 2001-348546.

15) Color Image Formation:

Regarding its constitution, the multi-color photosensitive thermal developable recording material of the invention may have combinations of two layers for different colors, or may contain all the necessary ingredients in a single layer, for example, as in U.S. Pat. No. 4,708,928.

In the multi-color photosensitive thermal developable recording material, the individual photosensitive emulsion layers are differentiated and spaced from the others via a functional or non-functional barrier layer between the adjacent emulsion layers, for example, as in U.S. Pat. No. 4,460,681.

3. Method of Image Formation:

3-1. Exposure:

The photosensitive thermal developable recording material of this embodiment may be either a "single-coated type" having an image-forming layer on only one face of the support, or a "double-coated (double-sided) type" having it on both faces of the support.

(Double-Sided Photosensitive Thermal Developable Recording Material)

The photosensitive thermal developable recording material of this embodiment is preferably used in an image-forming method of recording X-ray images on an X-ray intensifying screen.

The photosensitive thermal developable recording material preferred for the image-forming method is as follows:

The material is exposed to monochromatic light having the same wavelength range as the main emission peak wavelength of the X-ray intensifying screen used for it and having a half-value width of 15±5 nm, and then thermally developed, and the image-forming layer on the opposite side to the exposed side is removed, and the image density of the processed material is measured. The necessary amount of exposure to give the image density that is equal to the minimum density plus 0.5 is from $1\times10^{-6}$ W·sec/m$^2$ to $1\times10^{-3}$ W·sec/m$^2$, preferably from $6\times10^{-6}$ W·sec/m$^2$ to $6\times10^{-4}$ W·sec/m$^2$.

The method of forming an image on the photosensitive thermal developable recording material of the type comprises the following steps:

(a) a step of putting the photosensitive thermal developable recording material between a pair of X-ray intensifying screen to construct an image-forming assembly;

(b) a step of putting an object to be analyzed between the assembly and an X-ray source;

(c) a step of irradiating the object with an X-ray of which the energy level falls between 25 kVp and 125 kVp;

(d) a step of taking the photosensitive thermal developable recording material out of the assembly;

(e) a step of heating the thus taken-out photosensitive thermal developable recording material at a temperature falling between 90° C. and 180° C.

Preferably, the photosensitive thermal developable recording material to be processed in the assembly in this embodiment is designed as follows: When the material is stepwise exposed to X-ray and then thermally developed to give an image, then the optical density (D) of the image and the exposure amount (log E) to form a characteristic curve on perpendicular coordinates where the optical density and the exposure amount both have the same coordinate axis unit length gives a mean gamma (γ) of from 0.5 to 0.9, formed by a point of the minimum density (Dmin)+density 0.1 and a point of the minimum density (Dmin)+density 0.5 on the characteristic curve, and gives a mean gamma (γ) of from 3.2 to 4.0, formed by a point of the minimum density (Dmin)+density 1.2 and a point of the minimum density (Dmin)+density 1.6 on the characteristic curve. When the photosensitive thermal developable recording material of which the characteristic curve satisfies the condition as above is used in the X-ray image formation system in this embodiment, then it gives an excellent X-ray image of which the leg is extremely prolonged and which has a high gamma in the middle density area thereof. Owing to the photographic properties thereof, the photosensitive thermal developable recording material of the type enables good image formation of even the low-density region such as the mediastinal parts and the heart shadow through which the X-ray transmission is small. Other advantages of the material are that even the image of a lung window area through which the X-ray transmission is large is clearly visible and its contrast is good.

The photosensitive thermal developable recording material having the preferred characteristic curve as above may be readily fabricated, for example, by forming at least two, image-forming silver halide emulsion layers each having a different sensitivity on both faces of the material. Especially preferably, the image-forming layers are so designed that the upper layer is formed of a high-sensitivity emulsion and the lower layer is formed of a low-sensitivity hard emulsion. In the material of the type having such two image-forming layers, the sensitivity difference between the silver halide emulsions of the layers may be from 1.5 to 20 times, preferably from 2 to 15 times. The ratio of the emulsions for the respective layers varies, depending on the sensitivity difference and the covering power of the emulsions used. In general, when the sensitivity difference is larger, then the proportion of the high-sensitivity emulsion shall be lower. For example, when the sensitivity difference between the two emulsions is 2 times and when the covering power is almost the same in the two, then the preferred ratio of the emulsions, high-sensitivity emulsion/low-sensitivity emulsion is controlled to fall between 1/20 and 1/50 in terms of silver.

For the techniques of crossover cut (double-sided photosensitive thermal developable recording material) and antihalation (single-coated photosensitive thermal developable recording material), employable are dyes, or dyes and mordant agents described in JP-A2-68539, from page 13, left lower column, line 1 to page 14, left lower column line 9.

The fluorescent intensifying screen (radiation intensifying screen) in this embodiment is described. The basic structure of the radiation intensifying screen comprises a support, and a fluorescent layer formed on one face thereof. The fluorescent layer has a phosphor dispersed in a binder. The surface of the fluorescent layer opposite to the support (not in contact with the support) is generally coated with a transparent protective layer, and it protects the fluorescent layer from chemical degradation or physical shock.

Preferred examples of the phosphor for use in this embodiment are mentioned below. Tungstate phosphors (e.g., $CaWO_4$, $MgWO_4$, $CaWO_4$:Pb), terbium-activated rare earth acid sulfide phosphors (e.g., $Y_2O_2S$:Tb, $Gd_2O_2S$:Tb, $La_2O_2S$:Tb, $(Y,Gd)_2O_2S$:Tb, $(Y,Gd)_{O2}S$:Tb,Tm), terbium-activated rare earth phosphate phosphors (e.g., $YPO_4$:Tb, $GdPO_4$:Tb, $LaPO_4$:Tb), terbium-activated rare earth oxyhalide phosphors (e.g., LaOBr:Tb, LaOBr:Tb,Tm, LaOCl;Tb, LaOCl:Tb,Tm, LaOBr:Tb, GdOBr:Tb, GdOCl:Tb), thulium-activated rare earth oxyhalide phosphors (e.g., LaOBr:Tm, LaOCl:Tm), barium sulfate phosphors (e.g., $BaSO_4$:Pb, $BaSO_4$:$Eu^{2+}$, (Ba, Sr) $SO_4$:$E^{2+}$), divalent europium-activated alkaline earth metal phosphate phosphors (e.g., $(Ba_2PO_4)2$:$Eu^{2+}$, $(Ba_2PO_4)2$:$Eu^{2+}$), divalent europium-activated alkaline earth metal fluoride phosphors (e.g., BaFCl:$Eu^{2+}$, BaFBr:$Eu^{2+}$, BaFCl:$Eu^{2+}$,Tb, BaFBr:$Eu^{2+}$,Tb, $BaF_2$.BaCl.KCl:$Eu^{2+}$, (Ba,Mg)Fe.BaCl.KCl:$Eu^{2+}$), iodide phosphors (e.g., CsI:Na, CsI:Tl, NaI, KI:T;), sulfide phosphors (e.g., ZnS:Ag(Zn,Cd)S:Ag, (Zn,Cd)S:Cu, (Zn,Cd)S:Cu,Al), hafnium phosphate phosphors (e.g., $HfP_2O_7$:Cu), $YTaO_4$, and those prepared by adding various activators to the emission center of the phosphors. However, the phosphors for use in this embodiment should not be limited to these mentioned above, including all phosphors capable of emitting visible or near-UV light through exposure to radiation.

The X-ray fluorescent intensifying screen preferred for use in the invention is so designed that at least 50% of the emission light from it falls within a wavelength range of from 350 nm to 420 nm. Especially preferably, the phosphor of the fluorescent intensifying screen is a divalent Eu-activated phosphor, even more preferably a divalent Eu-activated barium halide phosphor. The wavelength range of the emission light from the fluorescent intensifying screen is preferably from 360 nm to 420 nm, more preferably from 370 nm to 420 nm. Even more preferably, at least 70%, still more preferably at least 85% of the light emission from the fluorescent intensifying screen falls within the range.

The proportion of the light emission may be calculated according to the following method. The emission spectrum is drawn on a graph where the horizontal axis indicates the anti-logarithm of the wavelength of light emission, and the vertical axis indicates the number of light emission photons.

The area from 350 nm to 420 nm on the chart is divided by the area of the overall light emission spectrum, and this is defined as the proportion of the light emission falling within a wavelength range of from 350 nm to 420 nm. Combined with the fluorescent intensifying screen having a light emission wavelength range as above, the photosensitive thermal developable recording material of the invention enables high sensitivity.

In order that almost all light emission from the phosphor for use herein could fall within the wavelength range as above, it is desirable that the half-value width of the emitted light is as narrow as possible. Preferably, the half-value width of the emitted light is from 1 nm to 70 nm, more preferably from 5 nm to 50 nm, even more preferably from 10 nm to 40 nm.

So far as its light emission is as above, the phosphor for use in the invention is not specifically defined. For further increasing the sensitivity of the photosensitive thermal developable recording material in the invention, however, the phosphor is preferably an Eu-activated phosphor where a divalent Eu is the emission center.

Specific examples of the phosphor of the type are mentioned below, to which, however, the invention should not be limited.

BaFCl:Eu, BaFBr:Eu, BaFI:Eu and those derived from them by changing the halogen composition; $BaSO_4$:Eu, SrFBr:Eu, SrFCl:Eu, SrFI:Eu, $(Sr,Ba)Al_2Si_2O_8$:Eu, $SrB_4O_7F$:Eu, $SrMgP_2O_7$:Eu, $Sr_3(PO_4)_2$:Eu, $Sr_2P_2O_7$:Eu.

More preferred phosphors for use herein are divalent Eu-activated barium halide phosphors of a general formula MX1X2:Eu. The essential ingredient of M is Ba, but it may contain a minor amount of any other compound such as Mg, Ca or Sr. X1 and X2 each are a halogen atom, and may be suitably selected from F, C, Br and In in any desired manner. X1 is preferably a fluorine atom. X2 may be selected from Cl, Br and I, and may be a halogen composition of any of these. More preferably, X=Br. Eu is europium. It is desirable that the proportion of the emission center Eu is from $10^{-7}$ to 0.1 relative to Ba, more preferably from $10^{-4}$ to 0.05. Also preferably, a minor amount of any other compound may be incorporated into the phosphor. Most preferred examples of the phosphor are BaFCl:Eu, BaFBr:Eu, $BaFBr_{(1-x)}I_x$:Eu.

<Fluorescent Intensifying Screen>

The fluorescent intensifying screen for use herein preferably comprises a support, a subbing layer of the support, a fluorescent layer, and a surface-protective layer.

The fluorescent layer may be formed by preparing a dispersion of phosphor particles such as those mentioned above and a binder resin in an organic solvent, directly applying the resulting dispersion onto a support (when the support has a subbing layer such as a light-reflecting layer or the like thereon, then the dispersion is applied onto the subbing layer), and drying it. Alternatively, a temporary support is prepared, the dispersion is applied onto it and dried to give a fluorescent sheet, then the fluorescent sheet is peeled from the temporary support, and this is attached to the support with an adhesive.

The particle size of the phosphor particles is not specifically defined. In general, it may be from about 1 μm to 15 μm, preferably from about 2 μm to 10 μm. The volume fill factor of the phosphor particles in the fluorescent layer is preferably as high as possible. In general, it falls between 60 and 85%, preferably between 65 and 80%, more preferably between 68 and 75%. (The proportion of the phosphor particles in the fluorescent layer is generally at least 80% by weight, preferably at least 90% by weight, more preferably at least 95% by weight.) The binder resin, the organic solvent and optional additives to be used for forming the fluorescent layer are described in various known references. The thickness of the fluorescent layer may be determined in accordance with the intended sensitivity thereof. Preferably, it falls between 70 μm and 150 μm on the front side of the screen, and between 80 μm and 400 μm on the back side thereof. The X-ray absorbance of the fluorescent layer is determined depending on the coating amount of the phosphor particles.

The fluorescent layer may have a single-layered structure or a two-layered or more multi-layered structure. Preferably, it has a single-layered to three-layered structure, more preferably a single-layered or two-layered structure. For example, layers of phosphor particles having a relatively narrow particle size distribution and having a different particle size may be laminated. In that case, the phosphor particles in the layer nearer to the support may have a smaller particle size. In particular, it is desirable that a layer of larger phosphor particles is formed on the side adjacent to the surface protective layer, and a layer of smaller phosphor particles is formed on the side nearer to the support. Preferably, the small phosphor particles may have a particle size of from 0.5 μm to 2.0 μm; and the large phosphor particles may have a particle size of from 10 μm to 30 μm. If desired, phosphor particles having a different particle size may be mixed to form a fluorescent layer. As the case may be, the fluorescent layer may be so designed that the particle size distribution of the phosphor particles constituting it may have a gradually-varying profile, for example, as in JP-B 55-33560, from page 3, left column, line 3 to page 4, left column, line 39. In general, the fluctuation coefficient of the particle size distribution of the phosphor particles for use herein falls between 30 and 50%. Monodispersed phosphor particles having a particle size fluctuation coefficient of 30% or less are also preferably used herein.

A trial of coloring the fluorescent layer relative to the light emission wavelength for attaining the intended sharpness has been made. Preferably, however, the layer is so designed that it is colored as small as possible. The absorption length of the fluorescent layer is preferably at least 100 μm, more preferably at least 1000 μm.

The fluorescent layer is preferably so designed that the scattering length thereof falls between 0.1 μm and 100 μm, more preferably between 1 μm and 100 μm. The scattering length and the absorption length may be calculated according to the calculation equations based on the Kubelka-Munk theory mentioned below.

The support for use herein may be suitably selected from various supports in known radiation intensifying screens in accordance with the object thereof. For example, preferred are polymer films containing white pigment such as titanium dioxide; or polymer films containing black pigment such as carbon black. The surface of the support (on which a fluorescent layer is to be formed) may be coated with a subbing layer such as a light-reflecting layer that contains a light-reflecting material. The light-reflecting layer described in JP-A 2001-127898 is preferred. In particular, the light-reflecting layer with yttrium oxide as in Example 1 of the patent reference, and the light-reflecting layer as in Example 4 thereof are preferred. The description given in JP-A 23001-124898, from page 3, right side, line 15 to page 4, right side, line 23 is preferably referred to for the light-reflecting layer in the invention.

Preferably, the surface of the fluorescent layer is coated with a surface-protective layer. The light scattering length seen in the main light emission wavelength of the phosphor preferably falls between 5 μm and 80 μm, more preferably between 10 μm and 70 μm, even more preferably between 10 μm and 60 μm. The light scattering length means the mean distance for which the light straightly runs while it scatters once. The light having a shorter scattering length means that its light scatterability is high. The light absorption length that indicates the mean free distance until light absorption is any desired one, but in view of the screen sensitivity, the surface-protective layer has no absorption since its desensitization is low. For compensating the scattering insufficiency, the screen may be modified to have an extremely minor absorption. The absorption length is preferably at least 800 μm, more preferably at least 1200 μm. Using the, data determined according to the method mentioned below, the light scattering length and the light absorption length may be calculated according to the calculation equations based on the Kubelka-Munk theory mentioned below.

At least three film samples all having the same composition as that of the surface-protective layer to be analyzed but having a different thickness are prepared. The thickness (μm) and the diffusion transmittance (%) of these film samples are measured. The diffusion transmittance may be measured by the use of an ordinary spectrophotometer equipped with an integrating sphere. In the present case, a 150-ϕ integrating sphere (150-0901) is fitted to an automatic spectrophotometer (Hitachi's U-3210 Model). The wavelength for the measurement must be equal to the peak wavelength of the main emission of the phosphor of the fluorescent layer to which the surface-protective layer is applied. Next, the data of the film thickness (μm) and the diffusion transmittance (%) are introduced into the following equation (A) that is derived from the Kubelka-Munk theoretical formula. The equation (A) can be readily derived under the boundary condition of the diffusion transmittance T (%), for example, from *Phosphor Handbook* (edited by the Society of Phosphor of Japan, published by Ohm, 1987), page 403, formulas 5.1.12 to 1.1.15.

$$T/100=4\beta/[(1+\beta)^2\cdot\exp(\alpha d)-(-1-\beta)^2\cdot\exp(-\alpha d)] \quad (A)$$

In formula (A), T indicates the diffusion transmittance (%), d is the film thickness (μm), and α and β are defined by the following equations:

$$\alpha=[K\cdot(K+2S)]^{1/2}$$

$$\beta=[K/(K+2S)]^{1/2}$$

T (diffusion transmittance, %) and d (film thickness, μm) of at least three films measured as above are introduced into the above-mentioned formula (A), and K and S that satisfy the formula (A) are calculated out. The scattering length (μm) is defined as 1/S; and the absorption length (μm) is defined as 1/K.

Preferably, the surface-protective layer contains light-scattering particles dispersed in a resin material. In general, the light refractivity of the light-scattering particles is at least 1.6, preferably at least 1.9. The particle size of the light-scattering particles generally falls between 0.1 μm and 1.0 μm. Examples of the light-scattering particles are fine particles of aluminium oxide, magnesium oxide, zinc oxide, zinc sulfide, titanium oxide, niobium oxide, barium sulfate, lead carbonate, silicon oxide, polymethyl methacrylate, styrene, and melamine.

The resin material to form the surface-protective layer is not specifically defined, but is preferably polyethylene terephthalate, polyethylene naphthalate, polyamide, aramide, fluororesin, and polyester. The surface-protective layer may be formed by dispersing the light-scattering particles as above in an organic solvent solution that contains the resin material (binder resin) to prepare a dispersion, and directly applying the dispersion onto the fluorescent layer (or via an optional auxiliary layer) and drying it thereon. Alternatively, a sheet for a protective layer is separately prepared, and this may be attached to the fluorescent layer with an adhesive. The thickness of the surface-protective layer generally falls between 2 μm and 12 μm, preferably between 3.5 μm and 10 μm.

Preferred methods for producing radiation intensifying screens and the materials for them are described in detail, for example, in JP-A 9-21899, from page 6, left column, line 47 to page 8, left column, line 5; and JP-A 6-347598, from page 2, right column, line 17 to page 3, left column, line 33, and from page 3, left column, line 42 to page 4, left column, line 22. These are referred to herein in forming the fluorescent intensifying screen for use herein.

Preferably, the fluorescent intensifying screen for use in this embodiment is so designed that the phosphor particles filled therein may have a gradient particle size distribution profile. In particular, it is desirable that large phosphor particles are on the side of the surface-protective layer, and small phosphor particles are on the side of the support. Preferably, the small particles have a particle size of from 0.5 to 2.0 μm, and the large particles have a particle size of from 10 to 30 μm.

(Single-Coated Photosensitive Thermal Developable Recording Material)

The single-coated photosensitive thermal developable recording material in this embodiment is preferably used for X-ray photosensitive thermal developable recording material for mammography.

It is important that the single-coated photosensitive thermal developable recording material for this purpose is specifically so designed that the image contrast could fall within a suitable range.

For the preferred constituent requirements of X-ray photosensitive thermal developable recording material for mammography, referred to are the descriptions given in JP-A 5-45807, 10-62881, 10-54900, 11-109564.

(Combination with UV Fluorescent Intensifying Screen)

For image formation on the photosensitive thermal developable recording material in this embodiment, the material is preferably combined with a phosphor having a main peak at 400 nm or shorter. More preferably, the material is combined with a phosphor having a main peak at 380 nm or shorter. Both the double-sided material and the single-coated material may be processed as assemblies with a fluorescent intensifying screen. Examples of the screen having a main light emission peak at 400 nm or shorter and usable herein are described in JP-A 6-11804 and WO93/01521, to which, however, the invention should not be limited. For the techniques of UV crossover cut (double-sided photosensitive thermal developable recording material) and antihalation (single-coated photosensitive thermal developable recording material), employable are dyes, referred to are the description in JP-A 8-76307. For the UV-absorbing dyes for use herein, those described in Japanese Patent Application No. 2000-320809 are especially preferred.

3-2. Thermal Development:

The photosensitive thermal developable recording material of this embodiment may be developed in any manner. In general, after having been imagewise exposed, it is developed under heat. Preferably, the temperature for the thermal development falls between 80 and 250° C., more preferably between 100 and 140° C.

The time for the development preferably falls between 1 and 60 seconds, more preferably between 5 and 30 seconds, even more preferably between 5 and 20 seconds.

For thermal development of the photosensitive thermal developable recording material, employable is the thermal development apparatus of the invention or, apart from it, also employable is a plate heater system. For the plate heater system for the material, preferred is the method described in JP-A 11-133572. The plate heater system described therein is for thermal development of photosensitive thermal developable recording materials, in which a photosensitive thermal developable recording material having been exposed to have a latent image thereon is brought into contact with a heating unit in the thermal development section to thereby convert the latent image into a visible image. In this, the heating unit comprises a plate heater, and multiple presser rolls are disposed in series on one surface of the plate heater. The exposed photosensitive thermal developable recording material is passed between the multiple pressure rolls and the plate heater, whereby it is developed under heat. The plate heater is sectioned into 2 to 6 stages, and it is desirable that the temperature of the top stage is kept lower by 1 to 10° C. or so than that of the others.

The system of the type is described in JP-54-30032. In the system, water and the organic solvent that remain in the photosensitive thermal developable recording material being processed can be removed out of the material. In this, in addition, the support of the photosensitive thermal developable recording material rapidly heated is prevented from being deformed.

3-3. System:

Apart from the thermal development apparatus of the invention, also usable are laser imagers for medical treatment equipped with an exposure unit and a thermal development unit, for example, Fuji Medical Dry Laser Imager FM-DPL. The system FM-DPL is described in *Fuji Medical Review* No. 8, pp. 39-55. The technique disclosed therein is usable herein. In addition, the photosensitive thermal developable recording material of the invention can be processed with the laser imager in the AD Network which Fuji Medical System has proposed for a network system under DICOM Standards.

4. Applications of the Invention:

The photosensitive thermal developable recording material of this embodiment that comprises a high-silver iodide photographic emulsion forms a monochromatic silver image, and is favorable for use in medical diagnosis, industrial photography, printing, and COM.

The photosensitive thermal developable recording material mentioned above is described concretely with reference to the following Examples, which, however, are not intended to restrict the scope of the invention.

EXAMPLES

1. Formation of PET Support, and Undercoating:

1-1. Film Formation:

From terephthalic acid and ethylene glycol, formed was PET in an ordinary manner, which had an intrinsic viscosity, IV of 0.66 (measured in phenol/tetrachloroethane=6/4 by weight at 25° C.). This was pelletized, and dried at 130° C. for 4 hours. This was colored with a blue dye (1,4-bis(2,6-diethylanilinoanthraquinone), then extruded out through a T-die, and rapidly cooled to form an unstretched film.

The film was stretched 3.3 times in MD (machine direction), for which were used rolls rotating at different speeds. Next, this was stretched 4.5 times in CD (cross direction) in a tenter. The temperature for MD and CD stretching was 110° C. and 130° C., respectively. Next, this was thermally fixed at 240° C. for 20 seconds, and then relaxed by 4% in CD at the same temperature. Next, the chuck of the tenter was released, the both edges of the film were knurled, and the film was rolled up under 4 kg/cm$^2$. The rolled film had a thickness of 175 μm.

1-2. Surface Corona Treatment:

Both surfaces of the support were subjected to corona treatment at room temperature at a speed of 20 m/min, for which was used a Pillar's solid-state corona processor, Model 6KVA. The data of the current and the voltage read on the apparatus confirmed that the support was processed at 0.375 kV·A·min/m$^2$. The frequency for the treatment was 9.6 kHz, and the gap clearance between the electrode and the dielectric roll was 1.6 mm.

1-3. Formation of Undercoated Support:

(1) Preparation of Coating Liquid for Subbing Layer:

Formulation (1) (for Subbing Layer to be Below Photosensitive Layer):

| | |
|---|---|
| SnO2/SbO (9/1 by weight, mean particle size 0.5 μm, 17 weight % dispersion) | 84 g |
| Takamatsu Yushi's PESURESIN A-520 (30 weight % solution) | 46.8 g |
| Toyo Spinning's Vylonal MD-1200 | 10.4 g |
| Polyethylene glycol monononylphenyl ether (mean number of ethylene oxides = 8.5, 1 weight % solution) | 11.0 g |
| Soken Chemical's MP-1000 (PMMA polymer particles having a mean particle size 0.4 μm) | 0.91 g |
| Distilled water | 847 ml |

Both surfaces of the bi-oriented polyethylene terephthalate support (thickness: 175 μm) were subjected to corona discharge treatment in the manner as above. The two surfaces of the support were coated with the coating liquid of subbing layer formulation (1) by the use of a wire bar, and then dried at 180° C. for 5 minutes. The wet volume of the layer formed was 6.6 ml/m$^2$ (one surface)

2. Preparation of Coating Materials:

1) Silver Halide Emulsions:

(Preparation of Silver Halide Emulsion A)

To 1421 ml of distilled water, added were 4.3 ml of 1 weight % potassium iodide solution, and then 3.5 ml of sulfuric acid solution (0.5 mol/liter), 36.5 g of phthaloylgelatin and 160 ml of 5 weight % 2,2'-(ethylenedithio) diethanol in methanol thereto. The resulting solution was kept stirred at 75° C. in a stainless reactor, to which were added 218 ml of a solution A of 22.22 g of silver nitrate diluted with distilled water, and 366 ml of a solution B of 36.6 g of potassium iodide diluted with distilled water, as constant double jets within 16 minutes of such that the flow rate of the solution A was kept constant while the flow rate of the solution B was so controlled as to make the system have a constant pAg of 10.2. Next, 10 ml of aqueous 3.5 weight % hydrogen peroxide and then 10.8 ml of aqueous 10 weight % solution of benzimidazole were added thereto.

Next, 508.2 ml of a solution C of 51.86 g of silver nitrate diluted with distilled water, and 639 ml of a solution D of 63.9 g of potassium iodide diluted with distilled water were added thereto, as controlled double jets within 20 minutes of such that the flow rate of the solution C was kept constant while the flow rate of the solution D was so controlled as to make the system have a constant pAg of 10.2. 10 minutes after the start of the addition of the solutions C and D to it, $1\times10^{-4}$ mols, per mol of silver in the system, of potassium hexachloroiridate(III) was added thereto. Five seconds after the end of the addition of the solution C, $3\times10^{-4}$ mols, per mol of silver in the system, of aqueous potassium hexacyano-iron(II) solution was added to it. The pH of the system was controlled to be 3.8 with sulfuric acid (0.5 mol/liter) added thereto. Stirring this was stopped, and this was precipitated, desalted and washed with water. Its pH was controlled to be 5.9 with sodium hydroxide (1 mol/liter) added thereto. The silver halide dispersion thus prepared had a pAg of 11.0.

The thus-prepared silver halide emulsion A was a pure silver iodide emulsion, in which tabular grains having a mean projected area diameter of 0.93 μm, a the mean projected area diameter fluctuation coefficient of 17.7%, a mean thickness of 0.057 μm and a mean aspect ratio of 16.3 accounted for at least 80% of the projected area of all the grains in the emulsion. The sphere-corresponding diameter of the grains was 0.42 μm. As a result of X-ray powdery diffractiometry, at least 30% of silver iodide had a γ-phase.

<<Preparation of Silver Halide Emulsion B>>

One mol of the silver halide emulsion A of tabular AgI grains was put into a reactor. Its pAg was 10.2 at 38° C. Next, a KBr solution (0.5 mol/liter) and an $AgNO_3$ solution (0.5 mol/liter) were added to it as constant double jets at a rate of 10 ml/min, taking 20 minutes. With that, substantially 10 mol % silver bromide was epitaxially deposited on the AgI host grains. During the treatment, the pAg of the system was kept at 10.2. Further, the pH of the system was controlled to 3.8 with sulfuric acid (0.5 mol/liter) added thereto. Stirring this was stopped, and this was precipitated, desalted and washed with water. Its pH was controlled to be 5.9 with sodium hydroxide (1 mol/liter) added thereto. The silver halide dispersion thus prepared had a pAg of 11.0.

With stirring the silver halide dispersion at 38° C., 5 ml of 0.34 weight % 1,2-benzoisothiazolin-3-one in methanol was added thereto. After 40 minutes, this was heated up to 47° C. 20 minutes after the heating, $7.6\times10^{-5}$ mols, per mol of silver in the system, of a methanolic solution of sodium benzenethiosulfonate was added to it; and after 5 minutes, $2.9\times10^{-5}$ mols, per mol of silver therein, of a methanolic solution of tellurium sensitizer C was added thereto. In that condition, this was ripened for 91 minutes. Then, 1.3 ml of a methanolic solution of 0.8 weight % N,N'-dihydroxy-N"-diethylmelamine was added to it; and after 4 minutes, $4.8\times10^{-3}$ mols, per mol of silver in the system, of a methanolic solution of 5-methyl-2-mercaptobenzimidazole, $5.4\times10^{-3}$ mols, per mol of silver, of a methanolic solution of 1-phenyl-2-heptyl-5-mercapto-1,3,4-triazole, and $8.5\times10^{-3}$ mols, per mol of silver, of an aqueous solution of 1-(3-methylureidophenyl)-5-mercaptotetrazole sodium salt were added thereto. Thus prepared, this is silver halide emulsion B.

<<Preparation of Silver Halide Emulsion C>>

To 1421 ml of distilled water, added were 8 ml of 10 weight % potassium iodide solution, and then 4.6 g of phthaloylgelatin and 160 ml of 5 weight % 2,2'-(ethylenedithio)diethanol in methanol thereto. The resulting solution was kept stirred at 75° C. in a stainless reactor, to which were added 223 ml of a solution A of 22.7 g of silver nitrate diluted with distilled water, and 366 ml of a solution B of 36.6 g of potassium iodide diluted with distilled water, as constant double jets within 15 minutes and 22 seconds of such that the flow rate of the solution A was kept constant while the flow rate of the solution B was so controlled as to make the system have a constant pAg of 9.96. Next, 10 ml of aqueous 3.5 weight % hydrogen peroxide and then 10.8 ml of aqueous 10 weight % solution of benzimidazole were added thereto. Next, 520.2 ml of a solution C of 53.1 g of silver nitrate diluted with distilled water, and 639 ml of a solution D of 63.9 g of potassium iodide diluted with distilled water were added thereto, as controlled double jets within 80 minutes of such that the flow rate of the solution C was kept constant while the flow rate of the solution D was so controlled as to make the system have a constant pAg of 9.96. 10 minutes after the start of the addition of the solutions C and D to it, $1\times10^{-4}$ mols, per mol of silver in the system, of potassium hexachloroiridate(III) was added thereto. Five seconds after the end of the addition of the solution C, $3\times10^{-4}$ mols, per mol of silver in the system, of aqueous potassium hexacyano-iron(II) solution was added to it. The pH of the system was controlled to be 3.8 with sulfuric acid (0.5 mol/liter) added thereto. Stirring this was stopped, and this was precipitated, desalted and washed with water. Its pH was controlled to be 5.9 with sodium hydroxide (1 mol/liter) added thereto. The silver halide dispersion thus prepared had a pAg of 11.0.

In the thus-prepared emulsion, the host grains were pure silver iodide, having a mean projected area diameter of 1.36 μm, a the mean projected area diameter fluctuation coefficient of 17.7%, a mean thickness of 0.113 μm and a mean aspect ratio of 12.0, and they accounted for at least 80% of the projected area of all the grains in the emulsion. The sphere-corresponding diameter of the grains was 0.68 μm. As a result of X-ray powdery diffractiometry, at least 15% of silver iodide had a γ-phase.

<Preparation of Silver Halide Emulsion D>

One mol of the AgI host grains were put into a reactor. Its pAg was 9.1 at 40° C. Next, a halide solution containing 0.088 mol/liter of KBr and 0.038 mol/liter of NaCl, and an $AgNO_3$ solution (0.125 mol/liter) were added to it as constant double jets at a rate of 28.7 ml/min, taking 31 minutes. With that, 10 mol %, relative to all silver, of silver chlorobromide was epitaxially deposited on 6 corners of the AgI host grains. During the treatment, the pAg of the system was kept at 7.13.

Further, the pH of the system was controlled to 3.8 with sulfuric acid (0.5 mol/liter) added thereto. Stirring this was stopped, and this was precipitated, desalted and washed with water. Its pH was controlled to be 5.9 with sodium hydroxide (1 mol/liter) added thereto. The silver halide dispersion thus prepared had a pAg of 11.0.

The mean halogen composition in the epitaxial area was determined as follows: An extra-thin piece of the epitaxial area of the silver halide grain was prepared, and it was observed with a field-emission analytical electronic microscope. The halogen composition of the sample was comprised of 80 mol % of bromine, 17 mol % of chloride and 3 mol % of iodide.

With stirring the silver halide dispersion at 38° C., 5 ml of 0.34 weight % 1,2-benzoisothiazolin-3-one in methanol was added thereto. After 40 minutes, this was heated up to 60° C. 20 minutes after the heating, $7.6\times10^{-5}$ mols, per mol of silver in the system, of a methanolic solution of sodium benzenethiosulfonate was added to it; and after 5 minutes, $2.9\times10^{-3}$ mols, per mol of silver therein, of a methanolic solution of tellurium sensitizer C was added thereto. In that condition, this was ripened for 91 minutes. Then, 1.3 ml of a methanolic solution of 0.8 weight % N,N'-dihydroxy-N", N"-diethylmelamine was added to it; and after 4 minutes, $4.8\times10^{-3}$ mols, per mol of silver in the system, of a methanolic solution of 5-methyl-2-mercaptobenzimidazole, $5.4\times10^{-3}$ mols, per mol of silver, of a methanolic solution of 1-phenyl-2-heptyl-5-mercapto-1,3,4-triazole, and $8.5\times10^{-3}$ mols, per mol of silver, of an aqueous solution of 1-(3-methylureidophenyl)-5-mercaptotetrazole sodium salt were added thereto. Thus prepared, this is epitaxial junction-having silver halide emulsion D.

<<Preparation of Mixed Emulsion for Coating Liquid>>

The silver halide emulsion B and the silver halide emulsion D were mixed in a ratio of 5/1 by mol of silver, and $7\times10^{-3}$ mols, per mol of silver, of aqueous 1 weight % benzothiazolium iodide solution was added to it.

Further, compounds 1, 2 and 3 (their one-electron oxidation products formed through one-electron oxidation can release one or more electrons) were added to the mixed emulsion, each in an amount of $2\times10^{-3}$ mols per mol of silver.

Compounds 1, 2 and 3 (these have an adsorptive group and a reducing group) were added to it, each in an amount of $8\times10^{-3}$ mols per mol of silver.

Finally, water was added to it so that the silver halide content, in terms of silver, could be 15.6 g per liter of the resulting mixed emulsion.

2) Preparation of Fatty Acid Silver Salt Dispersion:

<Preparation of Recrystallized Behenic Acid>

100 kg of benenic acid (Henkel's EDENOR C22-85R) was mixed with 1200 kg of isopropyl alcohol and dissolved at 50° C. This was filtered through a 10-μm filter, cooled to 30° C. and recrystallized. The cooling speed in recrystallization was controlled to 3° C./hr. The resulting crystal was taken out through centrifugal filtration, washed with 100 kg of isopropyl alcohol sprayed thereto, and dried. The thus-obtained crystal was esterified and analyzed for GC-FID, which confirmed that its behenic acid content was 96%, and in addition, it contained 2% lignoceric acid, 2% arachidic acid and 0.001% erucic acid.

<Preparation of Fatty Acid Silver Salt Dispersion>

88 kg of the recrystallized behenic acid, 422 liters of distilled water, 49.2 liters of aqueous NaOH solution (5 mol/liter) and 120 liters of t-butyl alcohol were mixed and reacted with stirring at 75° C. for 1 hour to obtain sodium behenate solution B. Separately, 206.2 liters of aqueous solution of 40.0 kg of silver nitrate (pH 4.0) was prepared, and kept at 10° C. 635 liters of distilled water and 30 liters of t-butyl alcohol were put into a reactor and kept at 30° C. With well stirring, all the sodium behenate solution and all the aqueous silver nitrate solution mentioned above were added to it at a constant rate, taking 93 minutes and 15 seconds, and 90 minutes, respectively. The addition mode was so controlled that only the aqueous silver nitrate solution could be added for the first 11 minutes just after the start of its addition, and then adding the sodium behenate solution was started. After the end of the addition of the aqueous silver nitrate solution, only the sodium behenate solution was added for 14 minutes and 15 seconds. In this step, the temperature in the reactor was kept at 30° C., for which the external temperature around the reactor was so controlled that the liquid temperature in the reactor could be kept constant. The pipe line for the sodium behenate solution was kept warmed by circulating hot water through the interspace of the double-walled pipe, and the liquid temperature at the outlet of the addition nozzle was kept at 75° C. The pipe line for the aqueous silver nitrate solution was thermally insulated by circulating cold water through the interspace of the double-walled pipe. Regarding the position at which the sodium behenate solution is added to the reaction system and that at which the aqueous silver nitrate solution is added thereto, the two were disposed symmetrically to each other relative to the shaft of the stirrer disposed in the reactor, were spaced from the reaction liquid in the reactor.

After adding the sodium behenate solution was finished, the reaction system was kept stirred for 20 minutes at the determined temperature, and then heated up to 35° C. within 30 minutes. Then, this was ripened for 210 minutes. Immediately after thus ripened, this was centrifuged to take out the solid, which was then washed with water until the conductivity of the wash waste reached 30 μS/cm. The solid thus obtained is of a silver salt of the fatty acid. Not dried, this was stored as wet cake.

The silver behenate grains obtained herein were analyzed for morphology on their images taken through electron microscopic photography. Their data were as follows: a=0.21 μm, b=0.4 μm and c=0.4 μm all on average (a, b and c are defined herein above) The mean aspect ratio was 2.1. The sphere-corresponding diameter fluctuation coefficient was 11%.

To the wet cake corresponding to 260 kg of its dry weight, added was 19.3 kg of polyvinyl alcohol (trade name, PVA-217) along with water to make 1000 kg in total. The resulting mixture was formed into slurry in a blade dissolver, and then pre-dispersed in a pipe-line mixer (Model PM-10 by Mizuho Industry).

Next, the pre-dispersed stock was processed three times in a dispersion mixer (trade name, MICROFLUIDIZER M-610 by Microfluidex International Corporation, equipped with a Z-type interaction chamber) under a controlled pressure of 1150 kg/cm$^2$. Thus prepared, this is a silver behenate dispersion. To cool it, bellows-type heat exchangers were disposed before and after the interaction chamber. The temperature of the coolant in these heat exchangers was so controlled that the system could be processed at a constant temperature of 18° C.

3) Preparation of Reducing Agent Dispersion:

<<Preparation of Reducing Agent-1 Dispersion>>

10 kg of water was added to 10 kg of a reducing agent 1 (1,1-bis(2-hydroxy-3,5-dimethylphenyl)-3,5,5-trimethylhexane)) and 16 kg of aqueous 10 weight % solution of modified polyvinyl alcohol (Kuraray's POVAL MP203), and well mixed to give a slurry. Via a diaphragm pump, the slurry was fed into a horizontal sand mill (Imex's UVM-2) filled with zirconia beads having a mean diameter of 0.5 mm, and dispersed therein for 3 hours. Then, 0.2 g of benzoisothiazolinone sodium salt was added thereto along with water to prepare a reducing agent dispersion having a concentration of 25% by weight. The dispersion was heated at 60° C. for 5 hours. Thus prepared, this is a reducing agent-1 dispersion. The reducing agent grains in the dispersion had a median diameter of 0.40 μm, and a maximum grain size of at most 1.4 μm. The reducing agent dispersion was filtered through a polypropylene filter having a pore size of 3.0 μm to remove impurities from it, and then stored.

4) Preparation of Hydrogen-Bonding Compound Dispersion:

<<Preparation of Hydrogen-Bonding Compound-1 Dispersion>>

10 kg of water was added to 10 kg of a hydrogen-bonding compound 1 (tri(4-t-butylphenyl)phosphine oxide) and 16 kg of aqueous 10 weight % solution of modified polyvinyl alcohol (Kuraray's POVAL MP203), and well mixed to give a slurry. Via a diaphragm pump, the slurry was fed into a horizontal sand mill (Imex's UVM-2) filled with zirconia beads having a mean diameter of 0.5 mm, and dispersed therein for 4 hours. Then, 0.2 g of benzoisothiazolinone sodium salt was added thereto along with water to make it have a hydrogen-bonding compound concentration of 25% by weight. The dispersion was heated at 40° C. for 1 hour and then at 80° C. for 1 hour. Thus prepared, this is a hydrogen-bonding compound-1 dispersion. The hydrogen-bonding compound grains in the dispersion had a median diameter of 0.45 μm, and a maximum grain size of at most 1.3 μm. The hydrogen-bonding compound dispersion-was filtered through a polypropylene filter having a pore size of 3.0 μm to remove impurities from it, and then stored.

5) Preparation of Development Promoter Dispersion, and Toning Regulator Dispersion:

<<Preparation of Development Promoter-1 Dispersion>>

10 kg of water was added to 10 kg of a development promoter 1 and 20 kg of aqueous 10 weight % solution of modified polyvinyl alcohol (Kuraray's POVALMP203), and well mixed to give a slurry. Via a diaphragm pump, the slurry was fed into a horizontal sand mill (Imex's UVM-2) filled with zirconia beads having a mean diameter of 0.5 mm, and dispersed therein for 3 hours and 30 minutes. Then, 0.2 g of benzoisothiazolinone sodium salt was added thereto along with water to prepare a development promoter-1 dispersion having a concentration of 20% by weight. The development promoter grains in the dispersion had a median diameter of 0.48 μm, and a maximum grain size of at most 1.4 μm. The development promoter dispersion was filtered through a polypropylene filter having a pore size of 3.0 μm to remove impurities from it, and then stored.

Like the development promoter-1 dispersion, prepared were development promoter-2 and toning regulator solid dispersions of 20% by weight and 15% by weight, respectively.

6) Preparation of Polyhalogen Compound Dispersions:

<<Preparation of Organic Polyhalogen Compound-1 Dispersion>>

10 kg of an organic polyhalogen compound-1 (tribromomethanesulfonylbenzene), 10 kg of aqueous 20 weight % solution of modified polyvinyl alcohol (Kuraray's POVALMP203), 0.4 kg of aqueous 20 weight % solution of sodium triisopropylnaphthalenesulfonate, and 14 kg of water were well mixed to prepare a slurry. Via a diaphragm pump, the slurry was fed into a horizontal sand mill (Imex's UVM-2) filled with zirconia beads having a mean diameter of 0.5 mm, and dispersed therein for 5 hours. Then, 0.2 g of benzoisothiazolinone sodium salt was added thereto along with water to prepare a 30 weight % dispersion of the organic polyhalogen compound. This is an organic polyhalogen compound-1 dispersion. The organic polyhalogen compound grains in the dispersion had a median diameter of 0.41 μm, and a maximum grain size of at most 2.0 μm. The organic polyhalogen compound dispersion was filtered through a polypropylene filter having a pore size of 10.0 μm to remove impurities from it, and then stored.

<<Preparation of Organic Polyhalogen Compound-2 Dispersion>>

10 kg of an organic polyhalogen compound-2 (N-butyl-3-tribromomethanesulfonylbenzamide), 20 kg of aqueous 10 weight % solution of modified polyvinyl alcohol (Kuraray's POVALMP203), and 0.4 kg of aqueous 20 weight % solution of sodium triisopropylnaphthalenesulfonate were well mixed to prepare a slurry. Via a diaphragm pump, the slurry was fed into a horizontal sand mill (Imex's UVM-2) filled with zirconia beads having a mean diameter of 0.5 mm, and dispersed therein for 5 hours. Then, 0.2 g of benzoisothiazolinone sodium salt was added thereto along with water to prepare a 30 weight % dispersion of the organic polyhalogen compound. The dispersion was heated at 40° C. for 5 hours. Thus prepared, this is an organic polyhalogen compound-2 dispersion. The organic polyhalogen compound grains in the dispersion had a median diameter of 0.40 μm, and a maximum grain size of at most 1.3 μm. The organic polyhalogen compound dispersion was filtered through a polypropylene filter having a pore size of 3.0 μm to remove impurities from it, and then stored.

7) Preparation of Silver Iodide Complex-Forming Agent:

8 kg of modified polyvinyl alcohol MP203 was dissolved in 174.57 kg of water, and then 3.15 kg of aqueous 20 weight % solution of sodium triisopropylnaphthalenesulfonate and 14.28 kg of aqueous 70 weight % solution of 6-isopropylphthalazine were added to it to prepare a 5 weight % solution of silver iodide complex-forming agent.

8) Preparation of Mercapto Compound:

(Preparation of Mercapto Compound)

<<Preparation of Aqueous Mercapto Compound-1 Solution>>

7 g of a mercapto compound-1 (1-(3-sulfophenyl)-5-mercaptotetrazole sodium salt) was dissolved in 993 g of water to give an aqueous 0.7 weight % solution of the mercapto compound.

<<Preparation of Aqueous Mercapto Compound-2 Solution>>

20 g of a mercapto compound-2 (1-(3-methylureidophenyl)-5-mercaptotetrazole) was dissolved in 980 g of water to give an aqueous 2.0 weight % solution of the mercapto compound.

9-1) Preparation SBR Latex:

SBR latex (TP-1) was prepared as follows:

287 g of distilled water, 7.73 g of surfactant (Takemoto Yushi's PIONINA-43-S, having a solid content of 48.5%), 14.06 ml of NaOH (1 mol/liter), 0.15 g of tetrasodium ethylenediaminetetraacetate, 255 g of styrene, 11.25 g of acrylic acid, and 3.0 g of tert-dodecylmercaptan were put into the polymerization reactor of a gas monomer reaction system (Pressure Glass Industry's TAS-2J Model). The reactor was closed, and the contents therein were stirred at 200 rpm. This was degassed via a vacuum pump, and purged a few times repeatedly with nitrogen. Then, 108.75 g of 1,3-butadiene was introduced into it under pressure, and heated up to 60° C. A solution of 1.875 g of ammonium persulfate dissolved in 50 ml of water was added to it, and stirred as such for 5 hour. This was further heated up to 90° C. and stirred for 3 hours, and after the reaction, this was cooled to room temperature. Then, LiOH (1 mol/liter) was added to it so as to make it have a pH of 8.4. Next, this was filtered through a polypropylene filter having a pore size of 1.0 μm to remove impurities from it, and then stored. Thus obtained, the SBR latex, TP-1 weighed 774.7 g. Its halide ion content was measured through ion chromatography, and the chloride ion concentration of the latex was 3 ppm. The chelating agent concentration therein was measured through high-performance liquid chromatography, and it was 145 ppm.

The mean grain size of the latex was 90 nm, Tg thereof was 17° C., the solid content thereof was 44% by weight, the equilibrium water content thereof at 25° C. and 60% RH was 0.6% by weight, and the ion conductivity thereof was 4.80 mS/cm. To measure the ion conductivity, used was a Toa Denpa Kogyo's conductometer CM-30S at 25° C.

9-2) Preparation of Isoprene Latex:

Isoprene latex (TP-2) was prepared as follows:

1500 g of distilled water was put into the polymerization reactor of a gas monomer reaction system (Pressure Glass Industry's TAS-2JModel), and heated at 90° C. for 3 hours to thereby form a passivated film on the stainless surface of the polymerization reactor and around the members of the stainless stirrer unit therein. 582.28 g of distilled water that had been bubbled with nitrogen gas for 1 hour, 9.49 g of surfactant (Takemoto Yushi's PIONINA-43-S), 19.56 g of NaOH (1 mol/liter), 0.20 g of tetrasodium ethylenediaminetetraacetate, 314.99 g of styrene, 190.87 g of isoprene, 10.43 g of acrylic acid, and 2.09 g of tert-dodecylmercaptan were put into the thus-treated polymerization reactor. The reactor was closed, and the contents therein were stirred at 225 rpm and heated up to 65° C. A solution of 2.61 g of ammonium persulfate dissolved in 40 ml of water was added to it, and stirred as such for 6 hours. In this stage, the degree of conversion was 90%, determined from the solid content of the reaction system. A solution of 5.22 g of acrylic acid dissolved in 46.98 g of water was added to it, and 10 g of water was thereto. Further, a solution of 1.30 g of ammonium persulfate dissolved in 50.7 ml of water was added to it. After the addition, this was heated up to 90° C. and stirred for 3 hours. After the reaction, this was cooled to room temperature, and then controlled to have a pH of 8.4 with LiOH (1 mol/liter) added thereto. Next, this was filtered through a polypropylene filter having a pore size of 1.0 μm to remove impurities from it, and then stored. Thus obtained, the isoprene latex, TP-2 weighed 1248 g. Its halide ion content was measured through ion chromatography, and the chloride ion concentration of the latex was 3 ppm. The chelating agent concentration therein was measured through high-performance liquid chromatography, and it was 142 ppm.

The mean grain size of the latex was 113 nm, Tg thereof was 15° C., the solid content thereof was 41.3% by weight, the equilibrium water content thereof at 25° C. and 60% RH was 0.4% by weight, and the ion conductivity thereof was 5.23 mS/cm. To measure the ion conductivity, used was a Toa Denpa Kogyo's conductometer CM-30S at 25° C.

10) Preparation of Nucleating Agent Dispersion:

To 10 g of a nucleating agent, compound No. SH-7, added were 2.5 g of polyvinyl alcohol (Kuraray's PVA-217) and 87.5 g of water, and well stirred to give a slurry. This was left as such for 3 hours. Next, the slurry was put into a vessel along with 240 g of 0.5-mm zirconia beads thereinto, and milled with a disperser (Imex's ¼ G sand grinder mill) for 10 hours to prepare a solid particle dispersion of the nucleating agent. 80% by weight of the solid particles had a particle size of from 0.1 μm to 1.0 μm, and the mean particle size thereof was 0.5 μm.

1-3-2. Preparation of Coating Liquids:

1) Preparation of Coating Liquid-1 for Emulsion Layer (Photosensitive Layer):

To 1000 g of the fatty acid silver salt dispersion prepared in the above and 276 ml of water, added were the organic polyhalogen compound-1 dispersion, the organic polyhalogen compound-2 dispersion, the SBR latex (TP-1), the isopropylene latex (TP-2), the reducing agent-1 dispersion, the nucleating agent dispersion, the hydrogen-bonding compound-1 dispersion, the development promoter-1 dispersion, the development promoter-2 dispersion, the toning regulator-1 dispersion, the mercapto compound-1 solution and the mercapto compound-2 solution in order, and the silver iodide complex-forming agent was added thereto. Just before coating with it, the resulting mixture was well mixed with 0.22 mols, per mol of silver of the fatty acid silver salt therein, of the mixed silver halide emulsion. Then, this was directly fed into a coating die, and used for coating with it.

The viscosity of the emulsion layer coating liquid was measured with a B-type viscometer by Tokyo Meter, and was 25 [mPa·s] at 40° C. (No. 1 rotor, 60 rpm).

Using an RFS field spectrometer by Rheometrics Far-East, the viscosity of the coating liquid was measured at 25° C. and at a shear rate of 0.1, 1, 10, 100 or 1000 (1/sec) and was 242, 65, 48, 26, and 20 [mPa·s], respectively.

The zirconium content of the coating liquid was 0.52 mg/g of Ag.

2) Preparation of Coating Liquid for Interlayer on Emulsion Surface:

To 1000 g of a polyvinyl alcohol, Kuraray's PVA-205 and 4200 ml of 19 weight % latex of methylmethacrylate/styrene/butyl acrylate/hydroxyethyl methacrylate/acrylic acid copolymer (copolymerization ratio 64/9/20/5/2 by weight), added were 27 ml of aqueous 5 weight % solution of AEROSOL OT (from American Cyanamid), 135 ml of aqueous 20 weight % solution of diammonium phthalate, and water to make 10000 g in total. This was controlled to have a pH of 7.5 with NaOH added thereto. The resulting mixture is a coating liquid for interlayer. This was fed into a coating die, with its flow rate being so controlled that its coating amount could be 9.1 ml/m$^2$.

The viscosity of the coating liquid, measured with a B-type viscometer (with No. 1 rotor at 60 rpm), was 58 [mPa·s] at 40° C.

3) Preparation of Coating Liquid for First Emulsion Surface-Protective Layer:

64 g of inert gelatin was dissolved in water, to which were added 112 g of 19.0 weight % latex of methyl methacrylate/styrene/butyl acrylate/hydroxyethyl methacrylate/acrylic acid copolymer (copolymerization ratio 64/9/20/5/2 by weight), 30 ml of 15 weight % solution of phthalic acid in methanol, 23 ml of aqueous 10 weight % solution of 4-methylphthalic acid, 28 ml of sulfuric acid (0.5 mol/liter), 5 ml of aqueous 5 weight % solution of AEROSOL OT (from American Cyanamid), 0.5 g of phenoxyethanol, 0.1 g of benzoisothiazolinone, and water to make 750 g in total. Just before use, 26 ml of 4 weight % chromium alum was added to the mixture, and stirred with a static mixer. Thus prepared, the coating liquid was fed into a coating die, with its flow rate being so controlled that its coating amount could be 18.6 ml/m$^2$.

The viscosity of the coating liquid, measured with a B-type viscometer (with No. 1 rotor at 60 rpm), was 20 [mPa·s] at 40° C.

4) Preparation of Coating Liquid for Second Emulsion Surface-Protective Layer:

80 g of inert gelatin was dissolved in water, to which were added 102 g of 27.5 weight % latex of methyl methacrylate/styrene/butyl acrylate/hydroxyethyl methacrylate/acrylic acid copolymer (copolymerization ratio 64/9/20/5/2 by weight), 5.4 ml of 2 weight % solution of a fluorine-containing surfactant (F-1), 5.4 ml of aqueous 2 weight % solution of a fluorine-containing surfactant (F-2), 23 ml of 5 weight % solution of AEROSOLOT (from American Cyanamid), 4 g of fine polymethyl methacrylate particles (mean particle size 0.7 μm, body weighted average distribution 30%), 21 g of fine polymethyl methacrylate particles (mean particle size 3.6 μm, body weighted average distribution 60%), 1.6 g of 4-methylphthalic acid, 4.8 g of phthalic acid, 44 ml of sulfuric acid (0.5 mol/liter), 10 mg of benzoisothiazolinone, and water to make 650 g in total. Just before use, 445 ml of aqueous solution of 4 weight % chromium alum with 0.67 weight % phthalic acid was added to the mixture, and stirred with a static mixer. This is a coating liquid for surface-protective layer. The coating liquid was fed into a coating die, with its flow rate being so controlled that its coating amount could be 8.3 ml/m$^2$.

The viscosity of the coating liquid, measured with a B-type viscometer (with No. 1 rotor at 60 rpm), was 19 [mPa.s] at 40° C.

1-4. Fabrication of Photosensitive Thermal Developable Recording Material 1:

Onto both surfaces of the support, simultaneously applied were the coating liquid for image-forming layer, that for interlayer, that for first surface-protective layer and that for second surface-protective layer in that order according to a slide bead coating system to fabricate photosensitive thermal developable recording material 1. Fabricating them, the temperature was so controlled that both the coating liquid for image-forming layer and the coating liquid for interlayer could beat 31° C., the coating liquid for first surface-protective layer could be at 36° C. and the coating liquid for second surface-protective layer could be at 37° C.

The coating amount (g/m$^2$) of silver was 0.861 g/m$^2$ as a total of the fatty acid silver salt and the silver halide on one surface of the material, and was 1.72 g/m$^2$ in the image-forming layers on both surfaces thereof.

The overall coating amount (g/m$^2$) of the constitutive components of the image-forming layer on one surface of the material is mentioned below.

| | |
|---|---|
| Fatty acid silver salt (as silver) | 0.686 |
| Polyhalogen compound 1 | 0.028 |
| Polyhalogen compound 2 | 0.094 |
| Silver iodide complex-forming agent | 0.46 |
| SBR latex | 5.20 |
| SBR latex (TP-1) | 2.09 |
| Isoprene latex (TP-2 | 3.13 |
| Reducing agent 1 | 0.46 |
| Nucleating agent | 0.036 |
| Hydrogen-bonding compound 1 | 0.15 |
| Development promoter 1 | 0.005 |
| Development promoter 2 | 0.035 |
| Toning regulator 1 | 0.002 |
| Mercapto compound 1 | 0.001 |
| Mercapto compound 2 | 0.003 |
| Silver halide (as Ag) | 0.175 |

The coating and drying condition is mentioned below.

Before coated, the support was destaticized with an ion blow applied thereto. The coating speed was 160 m/min. The coating and drying condition was controlled for each sample within the range mentioned below so that the coated surface could be stabilized to the best.

The distance between the coating die tip and the support fell between 0.10 and 0.30 mm.

The pressure in the degassing chamber was kept lower by 196 to 882 Pa than the atmospheric pressure.

In the subsequent chilling section, the coated support was chilled with an air blow (its dry-bulb temperature fell between 10 and 20° C.) applied thereto.

In the next helical lifting-up drying section, this was dried with a dry air blow (its dry-bulb temperature fell between 23 and 45° C., and its wet-bulb temperature fell between 15 and 21° C.) applied thereto. In this section, the coated support to be dried was kept not in contact with the drier.

After thus dried, this was conditioned at 25° C. and 40 to 60% RH, and then heated so that its surface could have a temperature falling between 70 and 90° C. After thus heated, this was cooled to have a surface temperature of 25° C.

The degree of matting, in terms of the Beck's smoothness, of the thus-fabricated photosensitive thermal developable recording material was 250 seconds. The pH of the photosensitive layer-coated surface of the sample was measured and was 6.0.

Chemical structures of the compounds used in this Example are shown below.

Tellurium Sensitizer C:

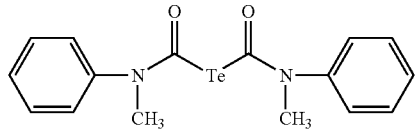

Compound 1 of which one-electron oxidation product formed through one-electron oxidation can release one or more electrons:

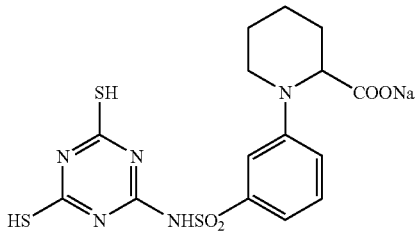

Compound 2 of which one-electron oxidation product formed through one-electron oxidation can release one or more electrons:

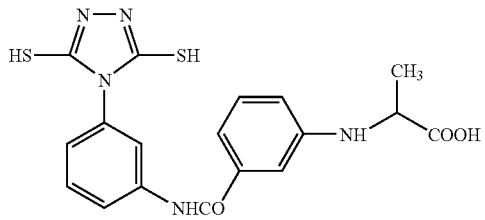

Compound 3 of which one-electron oxidation product formed through one-electron oxidation can release one or more electrons:

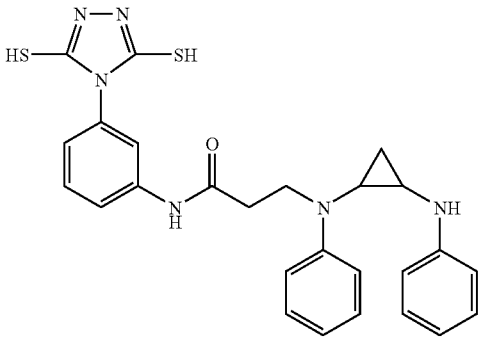

Compound 1 having adsorptive group and reducing group:

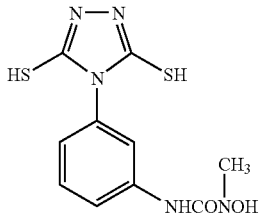

Compound 2 having adsorptive group and reducing group:

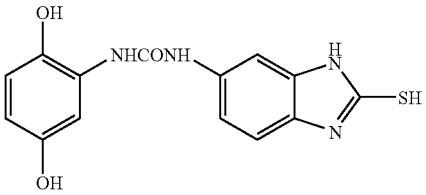

Compound 3 having adsorptive group and reducing group:

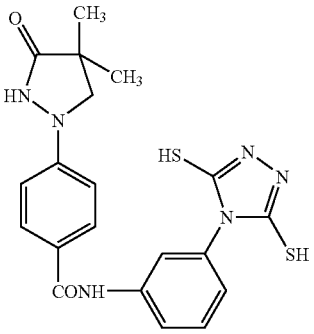

Reducing agent 1:

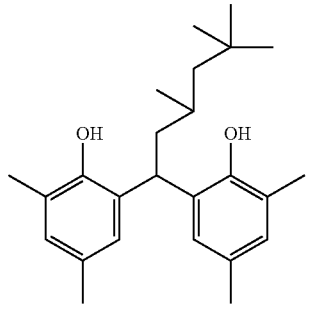

Hydrogen-bonding compound 1:

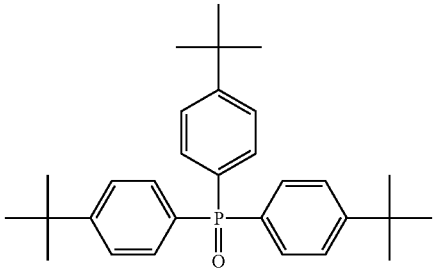

Polyhalogen compound 1:

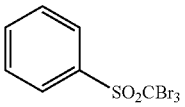

Polyhalogen compound 2:

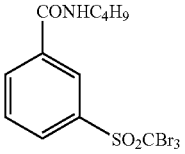

Mercapto compound 1:

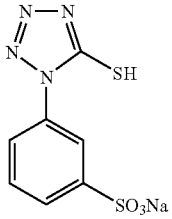

Mercapto compound 2:

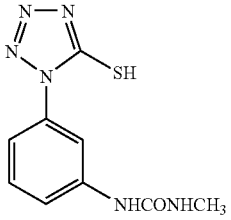

Silver iodide complex-forming agent:

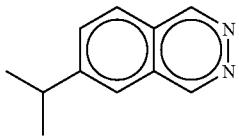

-continued

Development promoter 1:

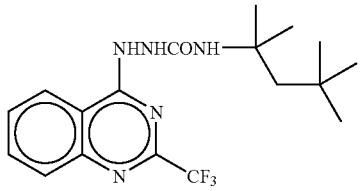

Development promoter 2:

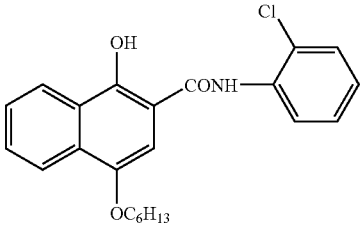

Toning regulator 1:

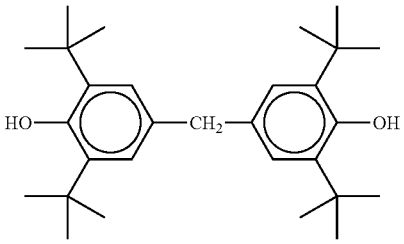

(F-1):

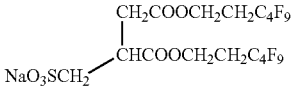

(F-2):

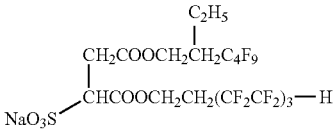

(Evaluation of Photographic Properties)

The sample was cut into a half-cut size, wrapped with a wrapping material mentioned below in an atmosphere of 25° C. and 50% RH, stored at room temperature for 2 weeks, and tested in the manner mentioned below.

(Wrapping Material)

PET 10 μ/PE 12 μ/aluminium foil 9 μ/Ny 15 μ/3% carbon-containing PE 50μ, having an oxygen permeability of 0.02 ml/atm·$m^2$·25° C.·day and a moisture permeability of 0.10 g/atm·$m^2$·25° C.·day.

The thus-fabricated, double-sided photosensitive thermal developable recording material was tested in the manner mentioned below.

The sample is sandwiched between a pair of fluorescent intensifying screens A mentioned below to construct an image-forming assembly. This is exposed to X-ray for 0.05 seconds for X-ray sensitometry. The X-ray apparatus used is Toshiba's DRX-3724HD with a tungsten target. Using a pulse generator, a power of 80 kVp was applied to the three phases in the apparatus, and X-ray having passed through a filer with 7-cm water of which the absorption is almost equivalent to that of human bodies is used as the light source. The amount of X-ray to which the sample is exposed is varied according to a distance process, the sample is subjected to step exposure at regular intervals of log E=0.15. After thus exposed, the sample is thermally developed with the thermal development apparatus of the invention under the thermal development condition defined herein. The image thus formed is evaluated with a densitometer.

<Formation of Fluorescent Intensifying Screen A>

(1) Formation of Undercoating Layer:

In the same manner as in Example 4 in JP-A 2001-124898, a light-reflecting layer of alumina powder, having a dry thickness of 50 μm, was formed on a 250-μm polyethylene terephthalate (support).

(2) Production of Fluorescent Sheet:

250 g of BaFBr:Eu phosphor (mean particle size 3.5 μm), 8 g of polyurethane binder resin (Dai-Nippon Ink Chemical Industry's PANDEX T5265M), 2 g of epoxy binder resin (Yuka Shell Epoxy's Epikote 1001), and 0.5 g of isocyanate compound (Nippon Polyurethane Industry's Coronate HX) were added to methyl ethyl ketone, and milled with a propeller mixer to prepare a coating liquid for fluorescent layer, having a viscosity of 25 ps (25° C.). The coating liquid was applied to the surface or a temporary support (polyethylene terephthalate sheet previously coated with a silicone release agent), and dried to form a fluorescent layer thereon. The fluorescent layer was peeled from the temporary support to give a fluorescent sheet.

(3) Attachment of Fluorescent Sheet to Light-Reflecting Layer:

The fluorescent sheet was put on the surface of the light-reflecting layer of the support produced in the previous step (1), and heated under a pressure of 400 kgw/$cm^2$ with a calender roll to thereby attach the fluorescent layer onto the light-reflecting layer. Thus formed, the thickness of the fluorescent layer was 125 μm, and the volume fill factor of the phosphor particles in the fluorescent layer was 68%.

(4) Formation of Surface-Protective Layer:

A polyester adhesive was applied onto one face of a 6-μm polyethylene terephthalate (PET). This was laminated on the fluorescent layer to form thereon a surface-protective layer. The process gave a fluorescent intensifying screen A comprising the support, the light-reflecting layer, the fluorescent layer and the surface-protective layer.

Figure 5:
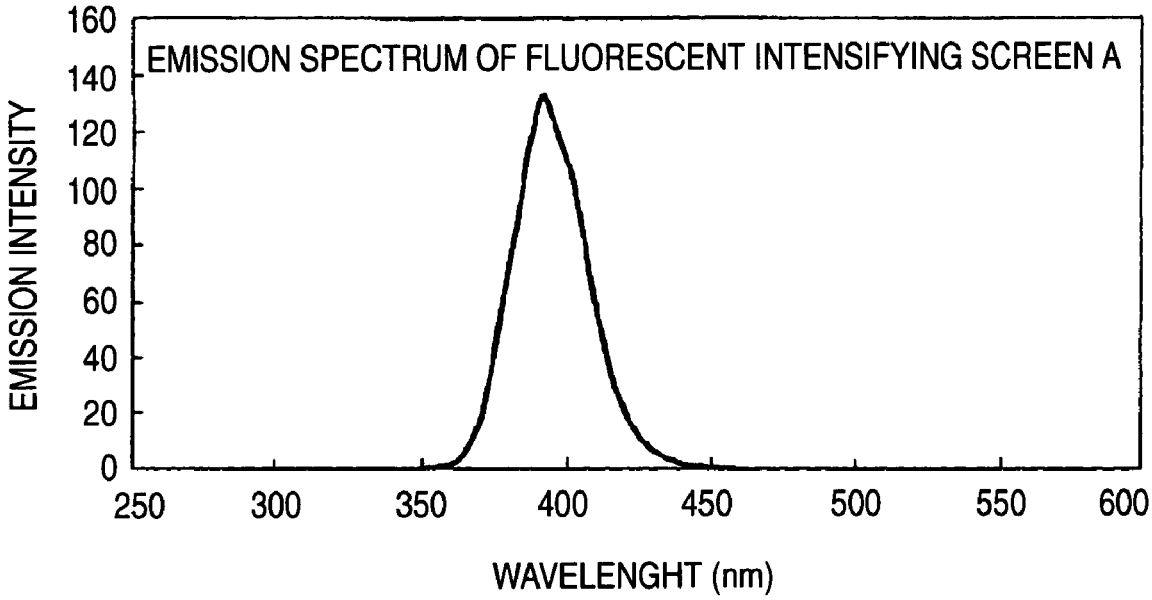
FIG. 5 is a graph showing the emission spectrum of a fluorescent intensifying screen.
Figure 6:
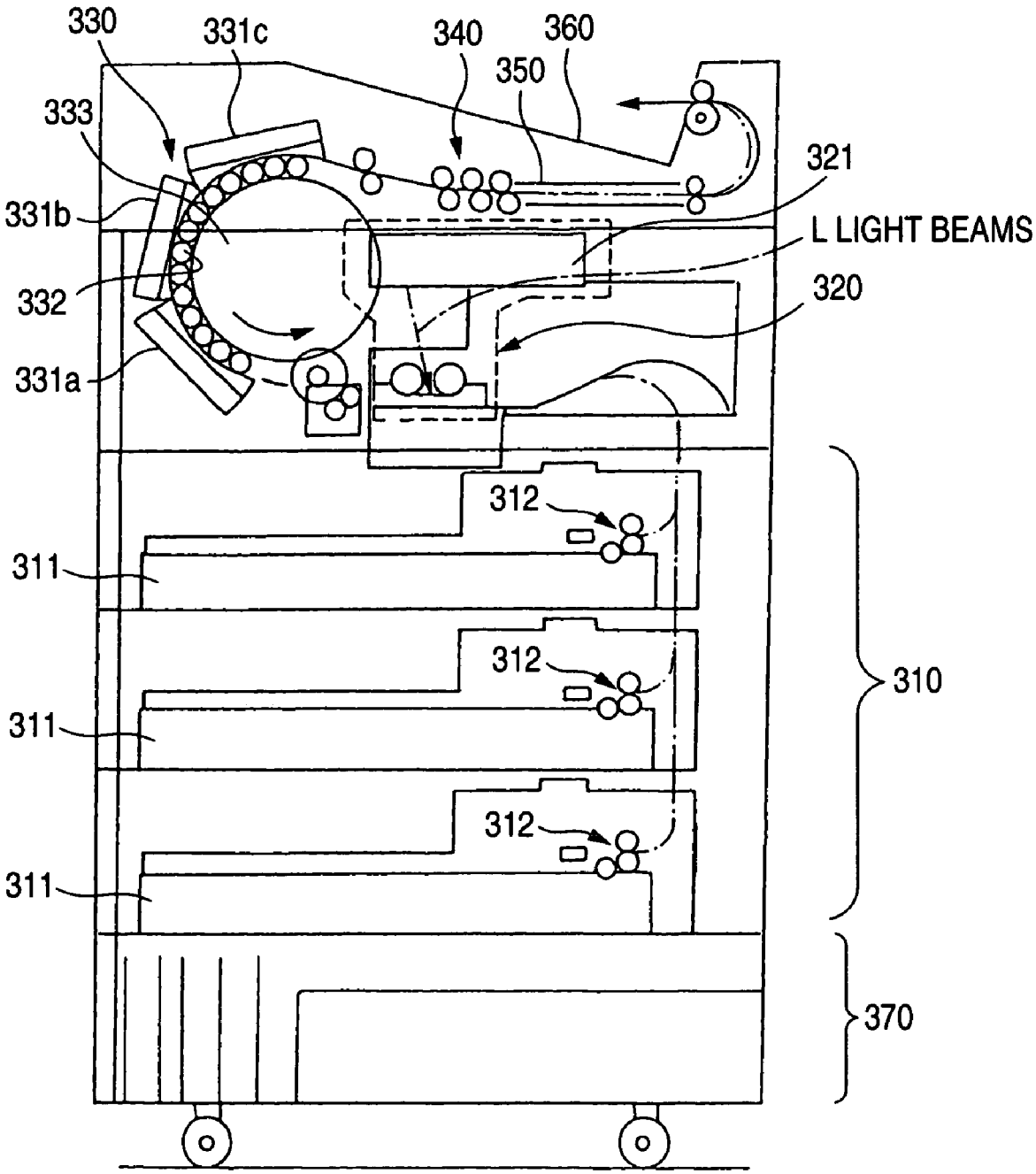
FIG. 6 shows an ordinary thermal development apparatus such as medical imager.

(5) Light Emission Property:

The emission spectrum of the fluorescent intensifying screen, measured with 40 kVp X-ray, is shown in FIG. 5. The emission profile of the fluorescent intensifying screen A had a peak at 390 nm and had a narrow half-value width.

On the other hand, a regular photographic material for wet development, Fuji Photo Film's RX-U was exposed under the same condition as above, using a pair of X-ray regular screens HI-SCREEN B3 (its phosphor is $CaWO_4$, and its emission peak wavelength is 425 nm), and processed with an automatic processor, Fuji Photo Film's CEPROS-M2 with a processor CE-D1, for 45 seconds.

The image formed on the photosensitive thermal developable recording material processed according to the embodiment of the invention was compared with that formed on the photographic material for wet process, in point of their photographic properties, and the two were both on the same level and were both good.

As described hereinabove, the thermal development apparatus of the invention enables not only ordinary thermal development of CT films that are exposed and thermally developed in one and the same system, but also thermal development of double-sided photosensitive thermal developable recording materials such as roentgen films that require development on both faces thereof. Therefore, the thermal development apparatus of the invention is inexpensive and space-saving, not requiring any broad space for setting it. In addition, it does not require a film loader and does not require the skill for loading raw films in the apparatus.

The present invention is not limited to the specific above-described embodiments. It is contemplated that numerous modifications may be made to the present invention without departing from the spirit and scope of the invention as defined in the following claims.

What is claimed:

1. A thermal development apparatus comprising:

a thermal development section for heating a photosensitive thermal developable recording material to visualize a latent image recorded on an image-forming layer on both faces of the photosensitive thermal developable recording material by a heating unit, a cassette holder section for holding a cassette that houses the photosensitive thermal developable recording material therein, a conveyor unit for taking the photosensitive thermal developable recording material out of the cassette held in the cassette holder section and conveying the photosensitive thermal developable recording material to the thermal development section, and a control unit for controlling at least one of a heating temperature and a conveyance speed in the heating unit of the thermal development section, a moisture sensor to determine the moisture content of the photosensitive thermal developable recording material by detecting a moisture content inside or around the thermal development apparatus, wherein the control unit is provided with a moisture correction information of the photosensitive thermal developable recording material and the control unit suitably corrects and controls the at least one of a heating temperature and a conveyance speed in the heating unit from a moisture content of the photosensitive thermal developable recording material on the basis of the moisture correction information thereof during thermal development of the photosensitive thermal developable recording material.

2. The thermal development apparatus according to claim 1, which comprises a moisture information receiver unit for receiving a moisture information memorized by memory unit for memorizing a monitor information from the moisture sensor.

3. A cassette to be held in a thermal development apparatus, which houses a photosensitive thermal developable recording material therein and comprises a moisture sensor, wherein the moisture sensor is for detecting a moisture content inside or around the cassette, and which further comprises a memory unit for memorizing a monitor information from the moisture sensor.

4. The cassette according to claim 3, wherein the moisture sensor and the memory unit are on a side face of the cassette.

5. A thermal development process for thermally developing a photosensitive thermal developable recording material, comprising:

detecting a moisture content of the photosensitive thermal developable recording material by a moisture sensor disposed inside or around a thermal development apparatus;

transmitting the detected moisture content from the moisture sensor to a control unit; and controlling at least one of a heating temperature and a conveyance speed in a heating unit of a thermal development section from the detected moisture content on the basis of a moisture correction information.

6. A thermal development process for thermally developing a photosensitive thermal developable recording material, comprising:

detecting a moisture content of the photosensitive thermal developable recording material by a moisture sensor disposed inside or around a cassette;

transmitting the detected moisture content from the moisture sensor to a control unit; and controlling at least one of a heating temperature and a conveyance speed in a heating unit of a thermal development section from the detected moisture content on the basis of a moisture correction information.

* * * * *